US012305459B2

(12) United States Patent
Least et al.

(10) Patent No.: US 12,305,459 B2
(45) Date of Patent: May 20, 2025

(54) SEALING/ANCHORING TOOL EMPLOYING AN EXPANDABLE METAL CIRCLET

(71) Applicant: Halliburton Energy Services, Inc., Houston, TX (US)

(72) Inventors: Brandon T. Least, Carrollton, TX (US); Stephen Michael Greci, Carrollton, TX (US); Chris M. Pelto, Carrollton, TX (US); Rutger Evers, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/334,903

(22) Filed: Jun. 14, 2023

(65) Prior Publication Data

US 2023/0407717 A1 Dec. 21, 2023

Related U.S. Application Data

(60) Provisional application No. 63/352,347, filed on Jun. 15, 2022.

(51) Int. Cl.
*E21B 23/01* (2006.01)
*E21B 33/12* (2006.01)

(52) U.S. Cl.
CPC ..... *E21B 23/01* (2013.01); *E21B 33/12* (2013.01)

(58) Field of Classification Search
CPC ..... E21B 23/01; E21B 33/12; E21B 33/1208; E21B 33/128
See application file for complete search history.

(56) References Cited

U.S. PATENT DOCUMENTS

| | | | |
|---|---|---|---|
| 1,525,740 | A | 2/1925 | Howard |
| 2,075,912 | A | 4/1937 | Roye |
| 2,590,931 | A | 4/1952 | Cabaniss |
| 2,743,781 | A | 5/1956 | Lane |
| 2,865,454 | A | 12/1958 | Richards |
| 3,206,536 | A | 9/1965 | Goodloe |
| 3,371,716 | A | 3/1968 | Current |

(Continued)

FOREIGN PATENT DOCUMENTS

| | | | |
|---|---|---|---|
| CA | 2820742 | A1 | 9/2013 |
| CN | 203308412 | U | 11/2013 |

(Continued)

*Primary Examiner* — Steven A MacDonald
(74) *Attorney, Agent, or Firm* — Scott Richardson; Parker Justiss, P.C.

(57) ABSTRACT

Provided is a sealing/anchoring element, a sealing/anchoring tool, a well system, and a method for sealing/anchoring within a wellbore. The sealing/anchoring element, in one aspect, includes a circlet having an inside surface having an inside diameter ($d_i$), an outside surface having an outside diameter ($d_o$), a width (w), and a wall thickness (t), the circlet having one or more geometric features that allow it to mechanically deform when moved from a radially reduced mechanical state to a radially enlarged mechanical state, the circlet comprising an expandable metal configured to expand in response to hydrolysis to chemically deform the circlet from a radially reduced chemical state to a radially enlarged chemical state.

16 Claims, 56 Drawing Sheets

(56) References Cited

U.S. PATENT DOCUMENTS 3,616,354 A 10/1971 Russell
3,706,125 A 12/1972 Hopkins
4,270,608 A 6/1981 Hendrickson
4,424,859 A 1/1984 Sims
4,424,861 A 1/1984 Carter
4,442,908 A 4/1984 Steenbock
4,446,932 A 5/1984 Hipp
4,457,369 A * 7/1984 Henderson ..... E21B 33/1293 166/134
4,457,379 A 7/1984 McStravick
4,527,815 A 7/1985 Frick
4,886,117 A * 12/1989 Patel ..... E21B 33/1277 166/187
4,892,144 A * 1/1990 Coone ..... E21B 33/1295 166/134
4,977,636 A 12/1990 King
4,979,585 A 12/1990 Chesnutt
5,139,274 A 8/1992 Oseman
5,220,959 A 6/1993 Vance
5,424,139 A 6/1995 Shuler
5,492,173 A 2/1996 Kilgore
5,517,981 A 5/1996 Taub et al.
5,662,341 A 9/1997 Ezell et al.
5,667,015 A 9/1997 Harestad
5,803,173 A 9/1998 Fraser et al.
6,089,320 A 7/2000 LaGrange
6,106,024 A 8/2000 Herman et al.
6,564,870 B1 * 5/2003 Grigsby ..... E21B 41/0042 166/207
6,840,325 B2 1/2005 Stephenson
6,907,930 B2 6/2005 Cavender
6,942,039 B2 9/2005 Tinker
7,104,322 B2 9/2006 Whanger et al.
7,152,687 B2 12/2006 Gano
7,322,408 B2 1/2008 Howlett
7,347,274 B2 3/2008 Patel
7,350,590 B2 4/2008 Hosie et al.
7,402,277 B2 7/2008 Ayer
7,578,043 B2 8/2009 Simpson et al.
7,673,688 B1 3/2010 Jones
7,677,303 B2 3/2010 Coronado
7,696,275 B2 4/2010 Slay et al.
7,963,321 B2 6/2011 Kutac
7,996,945 B2 8/2011 Nosker
8,042,841 B2 10/2011 Viegener
8,109,339 B2 2/2012 Xu
8,225,861 B2 7/2012 Foster et al.
8,266,751 B2 9/2012 He
8,430,176 B2 4/2013 Xu
8,453,736 B2 6/2013 Constantine
8,459,367 B2 6/2013 Nutley et al.
8,469,084 B2 6/2013 Clark et al.
8,479,808 B2 * 7/2013 Gouthaman ..... E21B 41/00 166/317
8,490,707 B2 7/2013 Robisson
8,579,024 B2 11/2013 Mailand et al.
8,684,096 B2 4/2014 Harris
8,794,330 B2 8/2014 Stout
8,807,209 B2 8/2014 King
8,875,800 B2 11/2014 Wood et al.
8,894,070 B2 11/2014 Bhat et al.
8,960,277 B2 2/2015 Braekke et al.
8,993,491 B2 3/2015 James
9,004,173 B2 4/2015 Richard
9,217,311 B2 12/2015 Slup
9,249,904 B2 2/2016 Duquette
9,279,295 B2 3/2016 Williamson et al.
9,347,272 B2 5/2016 Hewson et al.
9,353,606 B2 5/2016 Bruce et al.
9,393,601 B2 7/2016 Ranck
9,404,030 B2 8/2016 Mazyar
9,534,460 B2 1/2017 Watson et al.
9,611,715 B1 4/2017 Smith
9,644,459 B2 5/2017 Themig
9,708,880 B2 7/2017 Solhaug
9,725,979 B2 8/2017 Mazyar et al.
9,732,578 B2 8/2017 McRobb
9,745,451 B2 8/2017 Zhao et al.
9,765,595 B2 9/2017 Themig et al.
9,771,510 B2 9/2017 James et al.
9,945,190 B2 4/2018 Crowley
9,976,380 B2 5/2018 Davis et al.
9,976,381 B2 5/2018 Martin et al.
10,030,467 B2 7/2018 Al-Gouhi
10,060,225 B2 8/2018 Wolf
10,119,011 B2 11/2018 Zhao et al.
10,179,873 B1 1/2019 Meng
10,316,601 B2 6/2019 Walton et al.
10,337,298 B2 7/2019 Braddick
10,344,570 B2 7/2019 Steele
10,352,109 B2 7/2019 Sanchez
10,364,636 B2 7/2019 Davis
10,472,933 B2 11/2019 Steele
10,533,392 B2 1/2020 Walton et al.
10,718,183 B2 7/2020 Bruce et al.
10,758,974 B2 9/2020 Sherman
10,794,152 B2 10/2020 Lang et al.
10,961,804 B1 3/2021 Fripp
11,359,448 B2 6/2022 Fripp
11,365,611 B2 6/2022 Gibb
11,428,066 B2 8/2022 Andersen
11,512,552 B2 11/2022 Fripp
2002/0088616 A1 7/2002 Swor et al.
2003/0132001 A1 7/2003 Wilson
2003/0164236 A1 9/2003 Thornton
2003/0164237 A1 9/2003 Butterfield, Jr.
2003/0205377 A1 11/2003 Streater
2004/0194970 A1 10/2004 Eatwell
2005/0051333 A1 3/2005 Weber
2005/0061369 A1 3/2005 De Almeida
2005/0072576 A1 4/2005 Henriksen
2005/0093250 A1 5/2005 Santi et al.
2005/0199401 A1 9/2005 Patel et al.
2006/0144591 A1 7/2006 Gonzalez
2006/0272806 A1 12/2006 Wilkie et al.
2007/0089875 A1 4/2007 Steele et al.
2007/0089910 A1 4/2007 Hewson et al.
2007/0095532 A1 5/2007 Head
2007/0137826 A1 6/2007 Bosma et al.
2007/0144734 A1 6/2007 Xu et al.
2007/0151724 A1 7/2007 Ohmer et al.
2007/0163781 A1 7/2007 Walker
2007/0221387 A1 9/2007 Levy
2007/0246213 A1 10/2007 Hailey
2007/0267824 A1 11/2007 Baugh et al.
2007/0277979 A1 12/2007 Todd et al.
2008/0047708 A1 2/2008 Spencer
2008/0135249 A1 6/2008 Fripp
2008/0149351 A1 6/2008 Marya
2008/0290603 A1 11/2008 Laflin
2009/0014173 A1 1/2009 Macleod
2009/0084555 A1 4/2009 Lee
2009/0102133 A1 4/2009 Ruddock
2009/0159278 A1 6/2009 Corre
2009/0200028 A1 8/2009 Dewar
2009/0250227 A1 10/2009 Brown et al.
2009/0250228 A1 10/2009 Loretz
2009/0272546 A1 11/2009 Nutley et al.
2009/0283279 A1 * 11/2009 Patel ..... E21B 33/129 166/382
2009/0321087 A1 12/2009 Victorov
2010/0072711 A1 3/2010 Doane
2010/0078173 A1 4/2010 Buytaert et al.
2010/0096143 A1 4/2010 Angman
2010/0108148 A1 5/2010 Chen
2010/0122819 A1 5/2010 Wildman
2010/0139930 A1 6/2010 Patel
2010/0155083 A1 6/2010 Lynde et al.
2010/0181080 A1 7/2010 Levy
2010/0225107 A1 9/2010 Tverlid
2010/0257913 A1 10/2010 Storm, Jr. et al.
2010/0307737 A1 12/2010 Mellemstrand
2011/0061876 A1 3/2011 Johnson et al.

(56) References Cited

U.S. PATENT DOCUMENTS

2011/0098202 A1 4/2011 James
2011/0101615 A1 5/2011 Clarke
2011/0147014 A1 6/2011 Chen et al.
2012/0018143 A1 1/2012 Lembcke
2012/0048531 A1 3/2012 Marzouk
2012/0048561 A1 3/2012 Holderman
2012/0048623 A1 3/2012 Lafuente et al.
2012/0049462 A1 3/2012 Pitman
2012/0168147 A1 7/2012 Bowersock
2012/0175134 A1 7/2012 Robisson
2012/0273236 A1 11/2012 Gandikota et al.
2012/0305236 A1* 12/2012 Gouthaman ..... E21B 33/1285 166/118
2013/0048289 A1 2/2013 Mazyar et al.
2013/0056207 A1 3/2013 Wood et al.
2013/0081815 A1 4/2013 Mazyar et al.
2013/0152824 A1 6/2013 Crews
2013/0153236 A1 6/2013 Bishop
2013/0161006 A1 6/2013 Robisson et al.
2013/0186615 A1 7/2013 Hallunbaek et al.
2013/0192853 A1 8/2013 Themig
2013/0292117 A1 11/2013 Robisson
2014/0026335 A1 1/2014 Smith
2014/0034308 A1 2/2014 Holderman
2014/0051612 A1 2/2014 Mazyar
2014/0262352 A1 9/2014 Lembcke
2015/0021049 A1 1/2015 Davis et al.
2015/0075768 A1 3/2015 Wright et al.
2015/0101813 A1 4/2015 Zhao
2015/0113913 A1 4/2015 Kim
2015/0184486 A1 7/2015 Epstein
2015/0233190 A1 8/2015 Wolf et al.
2015/0275587 A1 10/2015 Wolf et al.
2015/0337615 A1 11/2015 Epstein et al.
2015/0345248 A1 12/2015 Carragher
2015/0345249 A1* 12/2015 Gorrara ..... E21B 23/06 166/138
2015/0368990 A1 12/2015 Jewett
2015/0369003 A1 12/2015 Hajjari et al.
2016/0024896 A1 1/2016 Johnson et al.
2016/0024902 A1 1/2016 Richter
2016/0137912 A1 5/2016 Sherman et al.
2016/0138359 A1 5/2016 Zhao
2016/0145488 A1 5/2016 Aines et al.
2016/0145968 A1 5/2016 Marya
2016/0177668 A1 6/2016 Watson et al.
2016/0194936 A1 7/2016 Allen
2016/0208569 A1 7/2016 Anderson et al.
2016/0230495 A1 8/2016 Mazyar et al.
2016/0273312 A1 9/2016 Steele et al.
2016/0319633 A1 11/2016 Cooper et al.
2016/0326830 A1 11/2016 Hallundbaek
2016/0326849 A1 11/2016 Bruce
2016/0333187 A1 11/2016 Bauer et al.
2017/0015824 A1 1/2017 Gozalo
2017/0022778 A1 1/2017 Fripp et al.
2017/0107419 A1 4/2017 Roy et al.
2017/0107794 A1 4/2017 Steele
2017/0113275 A1 4/2017 Roy et al.
2017/0159401 A1 6/2017 Saltel et al.
2017/0175487 A1 6/2017 Marcin et al.
2017/0175488 A1 6/2017 Lisowski
2017/0191342 A1 7/2017 Turley
2017/0198191 A1 7/2017 Potapenko
2017/0234103 A1 8/2017 Frazier
2017/0306714 A1 10/2017 Haugland
2017/0314372 A1 11/2017 Tolman
2017/0350237 A1 12/2017 Giem et al.
2017/0356266 A1 12/2017 Arackakudiyil
2018/0023362 A1 1/2018 Makowiecki et al.
2018/0023366 A1 1/2018 Deng et al.
2018/0038193 A1 2/2018 Walton
2018/0080304 A1 3/2018 Cortez et al.
2018/0081468 A1 3/2018 Bruce et al.
2018/0086894 A1 3/2018 Roy
2018/0087350 A1 3/2018 Sherman
2018/0094508 A1 4/2018 Smith et al.
2018/0100367 A1 4/2018 Perez
2018/0128072 A1 5/2018 Larsen
2018/0128082 A1 5/2018 Hollan et al.
2018/0209234 A1 7/2018 Manera
2018/0223624 A1 8/2018 Fripp
2018/0298708 A1 10/2018 Schmidt et al.
2018/0334882 A1 11/2018 Brandsdal
2018/0347288 A1 12/2018 Fripp
2018/0363409 A1 12/2018 Frazier
2019/0016951 A1 1/2019 Sherman et al.
2019/0032435 A1 1/2019 Kochanek et al.
2019/0039126 A1 2/2019 Sherman
2019/0078414 A1 3/2019 Frazier
2019/0093448 A1 3/2019 Rochen et al.
2019/0128092 A1 5/2019 Mueller et al.
2019/0136666 A1 5/2019 Kent
2019/0178054 A1 6/2019 Bruce
2019/0186228 A1 6/2019 Beckett et al.
2019/0225861 A1 7/2019 Reddy
2019/0249510 A1 8/2019 Deng et al.
2019/0316025 A1 10/2019 Sherman
2019/0383115 A1 12/2019 Lees
2020/0011327 A1* 1/2020 Stachowiak, Jr. .... F04C 13/008
2020/0032574 A1 1/2020 Fripp et al.
2020/0056435 A1 2/2020 Sherman
2020/0072019 A1 3/2020 Onti et al.
2020/0080401 A1 3/2020 Sherman
2020/0080402 A1 3/2020 Lang et al.
2020/0240235 A1* 7/2020 Fripp ..... E21B 33/10
2020/0300057 A1* 9/2020 Vasques ..... E21B 33/128
2020/0308945 A1 10/2020 Surjaatmadja et al.
2020/0325749 A1* 10/2020 Fripp ..... E21B 33/10
2020/0362224 A1* 11/2020 Wellhoefer ..... E21B 33/1208
2020/0370391 A1* 11/2020 Fripp ..... E21B 33/1277
2021/0017835 A1* 1/2021 Pelto ..... E21B 33/1212
2021/0040810 A1 2/2021 Evers
2021/0079756 A1* 3/2021 Ornelaz ..... E21B 33/1293
2021/0123310 A1 4/2021 Fripp et al.
2021/0123319 A1 4/2021 Greci
2021/0172286 A1 6/2021 Barlow
2021/0187604 A1 6/2021 Sherman et al.
2021/0222510 A1* 7/2021 Fripp ..... E21B 33/1208
2021/0270093 A1 9/2021 Fripp
2021/0270103 A1 9/2021 Greci et al.
2021/0332659 A1* 10/2021 Fripp ..... E21B 33/1208
2021/0332673 A1 10/2021 Fripp
2021/0363849 A1 11/2021 Al Yahya
2022/0106847 A1 4/2022 Dahl
2022/0186575 A1 6/2022 Fripp
2022/0205336 A1 6/2022 Asthana
2022/0325600 A1 10/2022 Fripp et al.
2022/0372837 A1 11/2022 Holderman et al.
2022/0381106 A1 12/2022 Greci et al.
2022/0381107 A1 12/2022 Greci et al.
2023/0109351 A1 4/2023 Least et al.
2023/0243224 A1* 8/2023 Greci ..... E21B 29/10 166/277
2024/0337172 A1* 10/2024 Roselier ..... E21B 43/103

FOREIGN PATENT DOCUMENTS

CN 205422632 U 8/2016
CN 107148444 A 9/2017
CN 108194756 A 6/2018
CN 107148444 B 1/2019
CN 108194756 B 8/2020
EP 15726 A1 9/1980
EP 869257 A2 10/1998
EP 940558 A1 9/1999
EP 0940558 B1 1/2005
EP 1757770 A1 2/2007
EP 1910728 A1 4/2008
EP 1910728 B1 9/2009
EP 2447466 A2 5/2012
EP 2501890 A2 9/2012
EP 2501890 B 7/2014
EP 2447466 A3 3/2017

(56) References Cited

FOREIGN PATENT DOCUMENTS

| | | | |
|---|---|---|---|
| EP | 3144018 | A1 | 3/2017 |
| EP | 3144018 | A4 | 5/2017 |
| EP | 3196402 | A1 | 7/2017 |
| EP | 3144018 | B1 | 9/2018 |
| EP | 2447466 | B1 | 10/2018 |
| GB | 2444060 | A | 5/2008 |
| GB | 2444060 | B | 12/2008 |
| JP | 2003090037 | A | 3/2003 |
| JP | 2003293354 | A | 10/2003 |
| JP | 2004169303 | A | 6/2004 |
| JP | 2015175449 | A | 10/2015 |
| KR | 20020014619 | A | 2/2002 |
| KR | 20080096576 | A | 10/2008 |
| WO | 02/02900 | A2 | 1/2002 |
| WO | 02/02900 | A3 | 5/2002 |
| WO | 02/02900 | A8 | 12/2003 |
| WO | 2005/022012 | A1 | 3/2005 |
| WO | 2006/045794 | A1 | 5/2006 |
| WO | 2007/047089 | A1 | 4/2007 |
| WO | 2012/094322 | A2 | 7/2012 |
| WO | 2012/125660 | A2 | 9/2012 |
| WO | 2012/094322 | A3 | 10/2012 |
| WO | 2012/125660 | A3 | 2/2013 |
| WO | 2014/028149 | A1 | 2/2014 |
| WO | 2014/182301 | A1 | 11/2014 |
| WO | 2014/193042 | A1 | 12/2014 |
| WO | 2015/057338 | A1 | 4/2015 |
| WO | 2015/069886 | A2 | 5/2015 |
| WO | 2015/069886 | A3 | 9/2015 |
| WO | 2015/183277 | A1 | 12/2015 |
| WO | 2016/000068 | A1 | 1/2016 |
| WO | 2016025682 | A1 | 2/2016 |
| WO | 2016/171666 | A1 | 10/2016 |
| WO | 2017/100417 | A1 | 6/2017 |
| WO | 2018/055382 | A1 | 3/2018 |
| WO | 2019/094044 | A1 | 5/2019 |
| WO | 2019/122857 | A1 | 6/2019 |
| WO | 2019/147285 | A1 | 8/2019 |
| WO | 2019/151870 | A1 | 8/2019 |
| WO | 2019/164499 | A1 | 8/2019 |
| WO | 2020/005252 | A1 | 1/2020 |
| WO | 2020/141203 | A1 | 7/2020 |
| WO | 2019/164499 | A8 | 8/2020 |
| WO | 2020/167288 | A1 | 8/2020 |
| WO | 2020/204940 | A1 | 10/2020 |
| WO | 2021/034325 | A1 | 2/2021 |
| WO | 2021/086317 | A1 | 5/2021 |
| WO | 2021/096519 | A1 | 5/2021 |
| WO | 2021086351 | A1 | 5/2021 |
| WO | 2021/126279 | A1 | 6/2021 |

* cited by examiner

SEALING/ANCHORING TOOL EMPLOYING AN EXPANDABLE METAL CIRCLET

CROSS-REFERENCE TO RELATED APPLICATION

This application claims the benefit of U.S. Provisional Application Ser. No. 63/352,347, filed on Jun. 15, 2022, entitled "EXPANDABLE METAL FOR WASHOUT CONFORMANCE," commonly assigned with this application and incorporated herein by reference in its entirety.

BACKGROUND

A typical sealing/anchoring tool (e.g., packer, bridge plug, frac plug, etc.) generally has one or more sealing elements or "rubbers" that are employed to provide a fluid-tight seal radially between a mandrel of the sealing/anchoring tool, and the casing or wellbore into which the sealing/anchoring tool is disposed. A typical sealing/anchoring tool may additionally include one or more anchoring elements (e.g., slip rings) which grip the casing and prevent movement of the sealing/anchoring tool within the casing after the sealing elements have been set. Thus, if weight or fluid pressure is applied to the sealing/anchoring tool, the anchoring elements resist the axial forces on the sealing/anchoring tool produced thereby, and prevent axial displacement of the sealing/anchoring tool relative to the casing and/or wellbore. Such a sealing/anchoring tool is commonly conveyed into a subterranean wellbore suspended from tubing extending to the earth's surface.

To prevent damage to the elements of the sealing/anchoring tool while the sealing/anchoring tool is being conveyed into the wellbore, the sealing elements and/or anchoring elements may be carried on the mandrel in a relaxed or uncompressed state, in which they are radially inwardly spaced apart from the casing. When the sealing/anchoring tool is set, the sealing elements and/or anchoring elements radially expand (e.g., both radially inward and radially outward in certain instances), thereby sealing and/or anchoring against the mandrel and the casing and/or wellbore. In certain embodiments, the sealing elements and/or anchoring elements are axially compressed between element retainers that straddle them, which in turn radially expand the sealing elements and/or anchoring elements. In other embodiments, the sealing elements and/or anchoring elements are radially expanded by pulling a cone feature therethrough. In yet other embodiments, one or more swellable seal elements are axially positioned between the element retainers, the swellable seal elements configured to radially expand when subjected to one or more different swelling fluids.

BRIEF DESCRIPTION

Reference is now made to the following descriptions taken in conjunction with the accompanying drawings, in which.

DETAILED DESCRIPTION

Figure 1A:
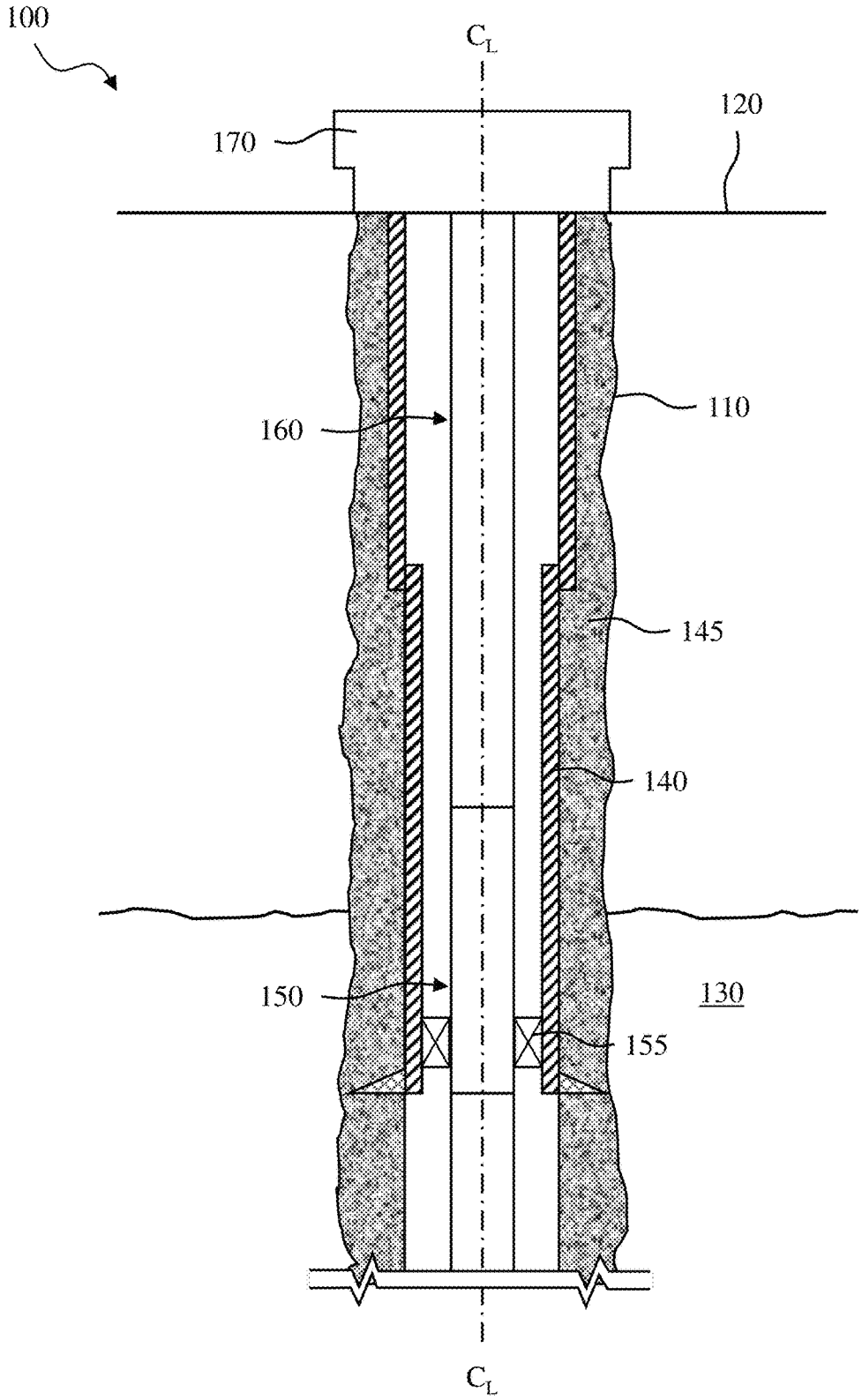
FIG. 1A illustrates a well system designed, manufactured, and operated according to one or more embodiments of the disclosure, the well system including a sealing/anchoring tool including a sealing/anchoring element designed, manufactured and operated according to one or more embodiments of the disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

The present disclosure describes a sealing/anchoring element employing expandable/expanded metal as a seal and/or anchor in a sealing/anchoring tool. The expandable/expanded metal may embody many different locations, sizes and shapes within the sealing/anchoring element while remaining within the scope of the present disclosure. In at least one embodiment, the expandable/expanded metal reacts with fluids within the wellbore to create a sturdy sealing/anchoring tool. Accordingly, the use of the expandable/expanded metal within the sealing/anchoring element minimizes the likelihood of the sealing/anchoring tool leaks and/or axially slips.

FIG. 1A illustrates a well system 100 designed, manufactured, and operated according to one or more embodiments of the disclosure, the well system 100 including a sealing/anchoring tool 150 including a sealing/anchoring element 155 designed, manufactured and operated according to one or more embodiments of the disclosure. The well system 100 includes a wellbore 110 that extends from a terranean surface 120 into one or more subterranean zones 130. When completed, the well system 100 produces reservoir fluids and/or injects fluids into the subterranean zones 130. As those skilled in the art appreciate, the wellbore 110 may be fully cased, partially cased, or an open hole wellbore. In the illustrated embodiment of FIG. 1, the wellbore 110 is at least partially cased, and thus is lined with casing or liner 140. The casing or liner 140, as is depicted, may be held into place by cement 145.

An example well sealing/anchoring tool 150 is coupled with a tubing string 160 that extends from a wellhead 170 into the wellbore 110. The tubing string 160 can be coiled tubing and/or a string of joint tubing coupled end to end. For example, the tubing string 160 may be a working string, an injection string, and/or a production string. The sealing/anchoring tool 150 can include a bridge plug, frac plug, packer (e.g., production packer) and/or other sealing/anchoring tool, having a sealing/anchoring element 155 for sealing/anchoring against the wellbore 110 wall (e.g., the casing 140, a liner and/or the bare rock in an open hole context). The sealing/anchoring element 155 can isolate an interval of the wellbore 110 above the sealing/anchoring element 155 from an interval of the wellbore 110 below the sealing/anchoring element 155, for example, so that a pressure differential can exist between the intervals.

In accordance with the disclosure, the sealing/anchoring element 155 may include a circlet having an inside surface having an inside diameter ($d_i$), an outside surface having an outside diameter ($d_o$), a width (w), and a wall thickness (t), the circlet having one or more geometric features that allow it to mechanically deform when moved from a radially reduced state to a radially enlarged state. In certain embodiments, the circlet may also elasto/plastically deform. The term elasto/plastically, as used herein, refers to mechanical deformation and means that the circlet may elastically deform, may plastically deform, or may both elastically and plastically deform.

In accordance with one embodiment of the disclosure, the circlet comprises an expandable metal configured to expand in response to hydrolysis. The term expandable metal, as used herein, refers to the expandable metal in a pre-expansion form. Similarly, the term expanded metal, as used herein, refers to the resulting expanded metal after the expandable metal has been subjected to reactive fluid, as discussed below. The expanded metal, in accordance with one or more aspects of the disclosure, comprises a metal that has expanded in response to hydrolysis. In certain embodiments, the expanded metal includes residual unreacted metal. For example, in certain embodiments the expanded metal is intentionally designed to include the residual unreacted metal. The residual unreacted metal has the benefit of allowing the expanded metal to self-heal if cracks or other anomalies subsequently arise, or for example to accommodate changes in the tubular or mandrel diameter due to variations in temperature and/or pressure. Nevertheless, other embodiments may exist wherein no residual unreacted metal exists in the expanded metal.

The expandable metal, in some embodiments, may be described as expanding to a cement like material. In other words, the expandable metal goes from metal to micron-scale particles and then these particles expand and lock together to, in essence, seal two or more surfaces together. The reaction may, in certain embodiments, occur in less than 2 days in a reactive fluid and in certain temperatures. Nevertheless, the time of reaction may vary depending on the reactive fluid, the expandable metal used, the downhole temperature, and surface-area-to-volume ratio (SA:V) of the expandable metal.

In some embodiments, the reactive fluid may be a brine solution such as may be produced during well completion activities, and in other embodiments, the reactive fluid may be one of the additional solutions discussed herein. The expandable metal is electrically conductive in certain embodiments. The expandable metal, in certain embodiments, has a yield strength greater than about 8,000 psi, e.g., 8,000 psi+/−50%.

The hydrolysis of the expandable metal can create a metal hydroxide. The formative properties of alkaline earth metals (Mg—Magnesium, Ca—Calcium, etc.) and transition metals (Zn—Zinc, Al—Aluminum, etc.) under hydrolysis reactions demonstrate structural characteristics that are favorable for use with the present disclosure. Hydration results in an increase in size from the hydration reaction and results in a metal hydroxide that can precipitate from the fluid.

It should be noted that the starting expandable metal, unless otherwise indicated, is not a metal oxide (e.g., an insulator). In contrast, the starting expandable metal has the properties of traditional metals: 1) Highly conductive to both electricity and heat (e.g., greater than 1,000,000 siemens per meter); 2) Contains a metallic bond (e.g., the outermost electron shell of each of the metal atoms overlaps with a large number of neighboring atoms). As a consequence, the valence electrons are allowed to move from one atom to another and are not associated with any specific pair of atoms. This gives metals their conductive nature; 3) Are malleable and ductile, for example deforming under stress without cleaving; and 4) Tend to be shiny and lustrous with high density. In other embodiments, however, the starting expandable metal is a metal oxide.

The hydration reaction for magnesium is:

$$Mg+2H_2O \rightarrow Mg(OH)_2+H_2,$$

where $Mg(OH)_2$ is also known as brucite. Another hydration reaction uses aluminum hydrolysis. The reaction forms a material known as Gibbsite, bayerite, boehmite, aluminum oxide, and norstrandite, depending on form. The possible hydration reactions for aluminum are:

$$Al+3H_2O \rightarrow Al(OH)_3+3/2\ H_2.$$

$$Al+2H_2O \rightarrow AlO(OH)+3/2H_2$$

$$Al+3/2H_2O \rightarrow \tfrac{1}{2}Al_2O_3+3/2H_2$$

Another hydration reaction uses calcium hydrolysis. The hydration reaction for calcium is:

$$Ca+2H_2O \rightarrow Ca(OH)_2+H_2,$$

Where $Ca(OH)_2$ is known as portlandite and is a common hydrolysis product of Portland cement. Magnesium hydroxide and calcium hydroxide are considered to be relatively insoluble in water. Aluminum hydroxide can be considered an amphoteric hydroxide, which has solubility in strong acids or in strong bases. Alkaline earth metals (e.g., Mg, Ca, etc.) work well for the expandable metal, but transition metals (Al, etc.) also work well for the expandable metal. In one embodiment, the metal hydroxide is dehydrated by the swell pressure to form a metal oxide.

In at least one embodiment, the expandable metal is a non-graphene based expandable metal. By non-graphene based material, it is meant that is does not contain graphene, graphite, graphene oxide, graphite oxide, graphite intercalation, or in certain embodiments, compounds and their derivatized forms to include a function group, e.g., including carboxy, epoxy, ether, ketone, amine, hydroxy, alkoxy, alkyl, aryl, aralkyl, alkaryl, lactone, functionalized polymeric or oligomeric groups, or a combination comprising at least one of the forgoing functional groups. In at least one other embodiment, the expandable metal does not include a matrix material or an exfoliatable graphene-based material. By not being exfoliatable, it is meant that the expandable metal is not able to undergo an exfoliation process. Exfoliation as used herein refers to the creation of individual sheets, planes, layers, laminae, etc. (generally, "layers") of a graphene-based material; the delamination of the layers; or the enlargement of a planar gap between adjacent ones of the layers, which in at least one embodiment the expandable metal is not capable of.

In yet another embodiment, the expandable metal does not include graphite intercalation compounds, wherein the graphite intercalation compounds include intercalating agents such as, for example, an acid, metal, binary alloy of an alkali metal with mercury or thallium, binary compound of an alkali metal with a Group V element (e.g., P, As, Sb, and Bi), metal chalcogenide (including metal oxides such as, for example, chromium trioxide, $PbO_2$, $MnO_2$, metal sulfides, and metal selenides), metal peroxide, metal hyperoxide, metal hydride, metal hydroxide, metals coordinated by nitrogenous compounds, aromatic hydrocarbons (benzene, toluene), aliphatic hydrocarbons (methane, ethane, ethylene, acetylene, n-hexane) and their oxygen derivatives, halogen, fluoride, metal halide, nitrogenous compound, inorganic compound (e.g., trithiazyl trichloride, thionyl chloride), organometallic compound, oxidizing compound (e.g., peroxide, permanganate ion, chlorite ion, chlorate ion, perchlorate ion, hypochlorite ion, $As_2O_5$, $N_2O_5$, $CH_3ClO_4$, $(NH_4)_2S_2O_8$, chromate ion, dichromate ion), solvent, or a combination comprising at least one of the foregoing. Thus, in at least one embodiment, the expandable metal is a structural solid expanded metal, which means that it is a metal that does not exfoliate and it does not intercalate. In yet another embodiment, the expandable metal does not swell by sorption.

In an embodiment, the expandable metal used can be a metal alloy. The expandable metal alloy can be an alloy of the base expandable metal with other elements in order to either adjust the strength of the expandable metal alloy, to adjust the reaction time of the expandable metal alloy, or to adjust the strength of the resulting metal hydroxide byproduct, among other adjustments. The expandable metal alloy can be alloyed with elements that enhance the strength of the metal such as, but not limited to, Al—Aluminum, Zn—Zinc, Mn—Manganese, Zr—Zirconium, Y—Yttrium, Nd—Neodymium, Gd—Gadolinium, Ag—Silver, Ca—Calcium, Sn—Tin, and Re—Rhenium, Cu—Copper. In some embodiments, the expandable metal alloy can be alloyed with a dopant that promotes corrosion, such as Ni—Nickel, Fe—Iron, Cu—Copper, Co—Cobalt, Ir—Iridium, Au—Gold, C—Carbon, Ga—Gallium, In—Indium, Mg—Mercury, Bi—Bismuth, Sn—Tin, and Pd—Palladium. The expandable metal alloy can be constructed in a solid solution process where the elements are combined with molten metal or metal alloy. Alternatively, the expandable metal alloy could be constructed with a powder metallurgy process. The expandable metal can be cast, forged, extruded, sintered, welded, mill machined, lathe machined, stamped, eroded or a combination thereof. The metal alloy can be a mixture of the metal and metal oxide. For example, a powder mixture of aluminum and aluminum oxide can be ball-milled together to increase the reaction rate.

Optionally, non-expanding components may be added to the starting metallic materials. For example, ceramic, elastomer, plastic, epoxy, glass, or non-reacting metal components can be embedded in the expandable metal or coated on the surface of the expandable metal. In yet other embodiments, the non-expanding components are metal fibers, a composite weave, a polymer ribbon, or ceramic granules, among others. In one variation, the expandable metal is formed in a serpentinite reaction, a hydration and metamorphic reaction. In one variation, the resultant material resembles a mafic material. Additional ions can be added to the reaction, including silicate, sulfate, aluminate, carbonate, and phosphate. The metal can be alloyed to increase the reactivity or to control the formation of oxides.

The expandable metal can be configured in many different fashions, as long as an adequate volume of material is available for anchoring and/or sealing. For example, the expandable metal may be formed into a single long member, multiple short members, rings, among others. In another embodiment, the expandable metal may be formed into a long wire of expandable metal, that can be in turn be wound around a mandrel as a sleeve. The wire diameters $d_o$ not need to be of circular cross-section, but may be of any cross-section. For example, the cross-section of the wire could be oval, rectangle, star, hexagon, keystone, hollow braided, woven, twisted, among others, and remain within the scope of the disclosure. In certain other embodiments, the expandable metal is a collection of individual separate chunks of the metal held together with a binding agent. In yet other embodiments, the expandable metal is a collection of individual separate chunks of the metal that are not held together with a binding agent, but held in place using one or more different techniques, including an enclosure (e.g., an enclosure that could be crushed to expose the individual separate chunks to the reactive fluid), a cage, etc.

Additionally, a delay coating or protective layer may be applied to one or more portions of the expandable metal to delay the expanding reactions. In one embodiment, the material configured to delay the hydrolysis process is a fusible alloy. In another embodiment, the material configured to delay the hydrolysis process is a eutectic material. In yet another embodiment, the material configured to delay the hydrolysis process is a wax, oil, or other non-reactive material. The delay coating or protective layer may be applied to any of the different expandable metal configurations disclosed above.

Figure 1B:
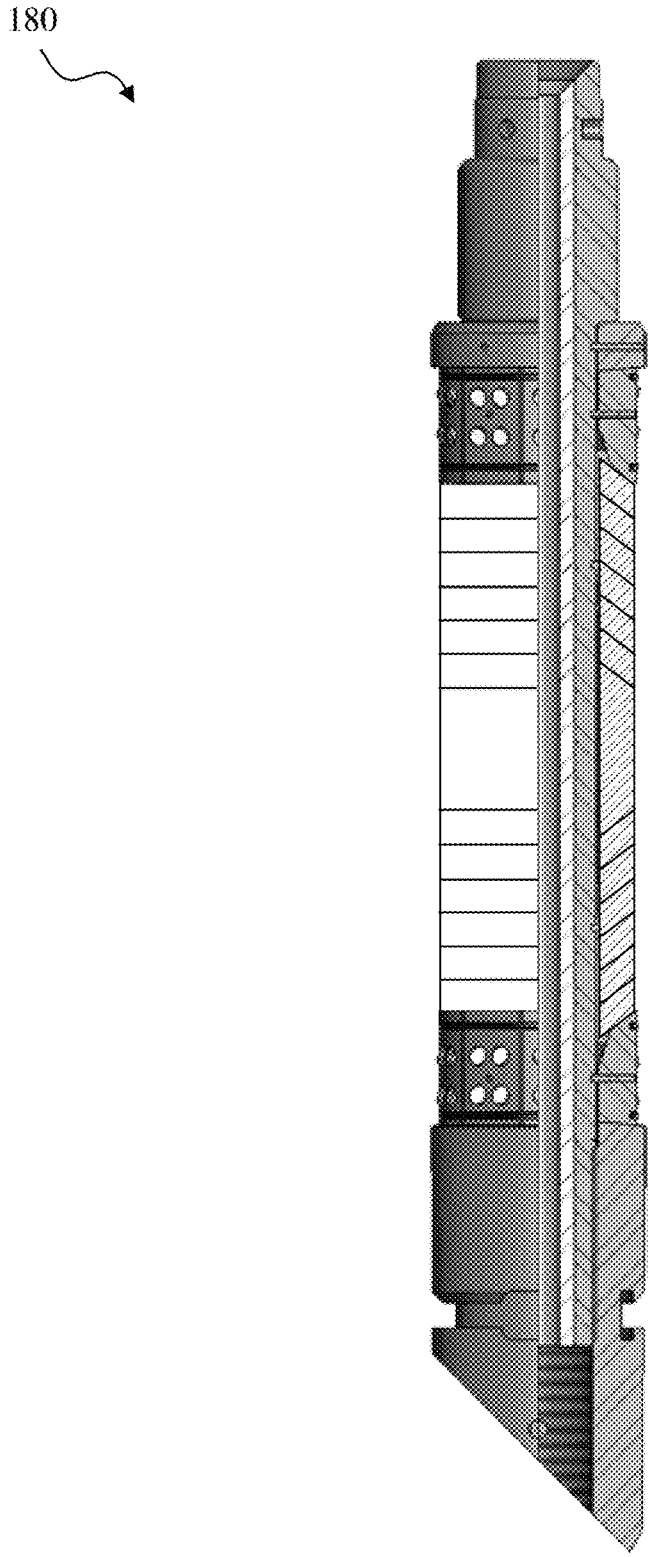
FIG. 1B illustrates one embodiment of a frac plug designed, manufactured and operated according to one or more embodiments of the disclosure.

Turning briefly to FIG. 1B, illustrated is one embodiment of a frac plug 180 designed, manufactured and operated according to one or more embodiments of the disclosure. The frac plug 180, in the illustrated embodiment, could function as the sealing/anchoring element 150 of FIG. 1A. Accordingly, the frac plug 180 could include the aforementioned circlet, for example a circlet comprising an expandable metal configured to expand in response to hydrolysis.

Figure 1C:
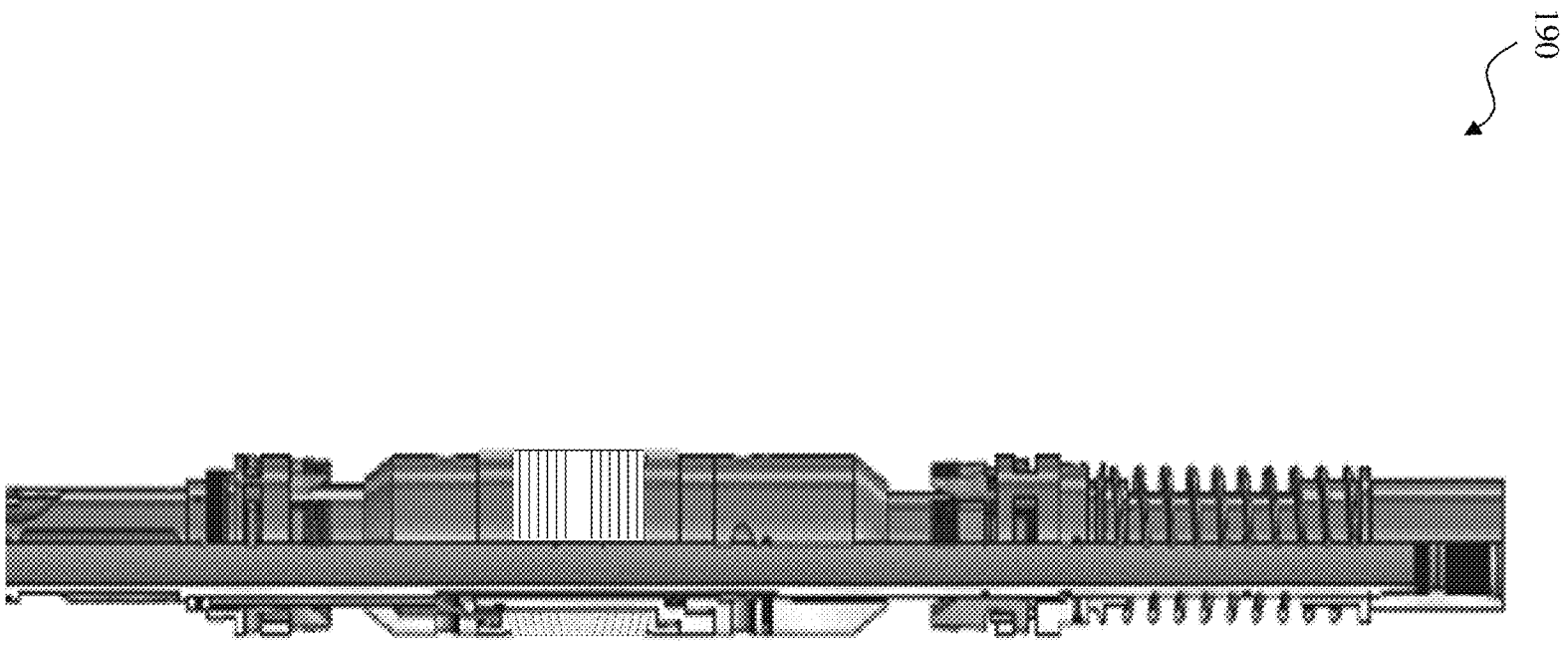
FIG. 1C illustrates one embodiment of a production packer designed, manufactured and operated according to one or more embodiments of the disclosure.

Turning briefly to FIG. 1C, illustrated is one embodiment of a production packer 190 designed, manufactured and operated according to one or more embodiments of the disclosure. The production packer 190, in the illustrated embodiment, could function as the sealing/anchoring element 150 of FIG. 1A. Accordingly, the production packer 190 could include the aforementioned circlet, for example a circlet comprising an expandable metal configured to expand in response to hydrolysis.

Figure 2A:
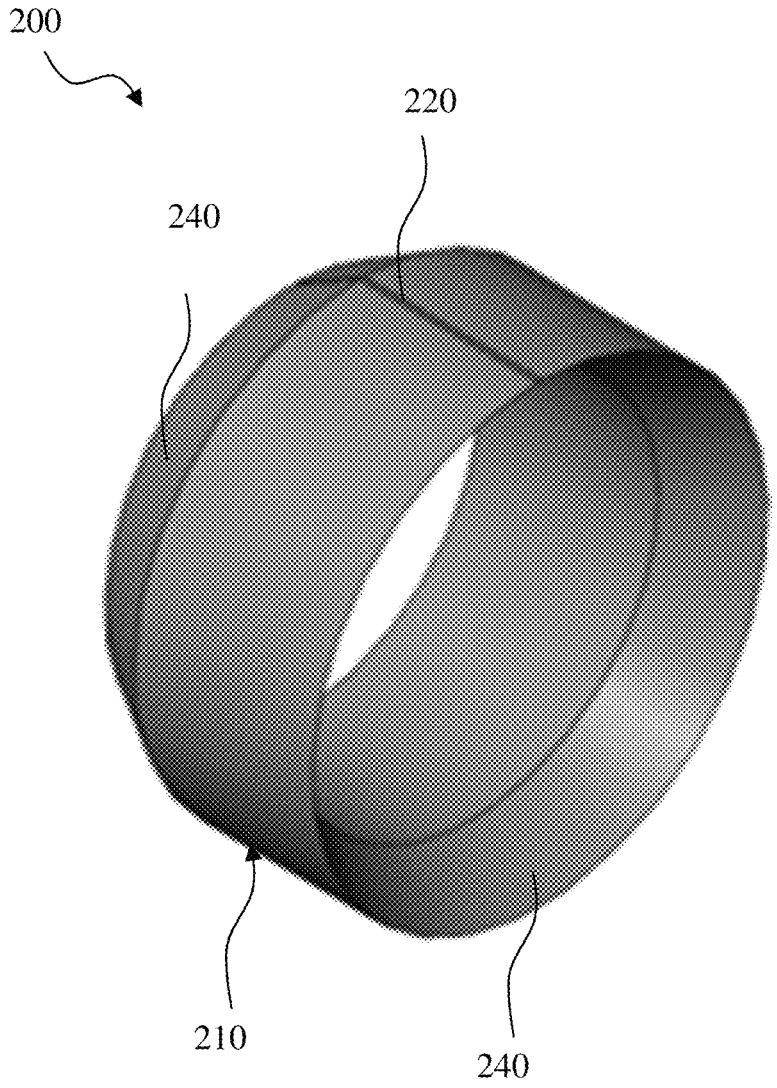
FIGS. 2A through 2C illustrate one embodiment of a sealing/anchoring element designed, manufactured and operated according to one embodiment of the disclosure.
Figure 2B:
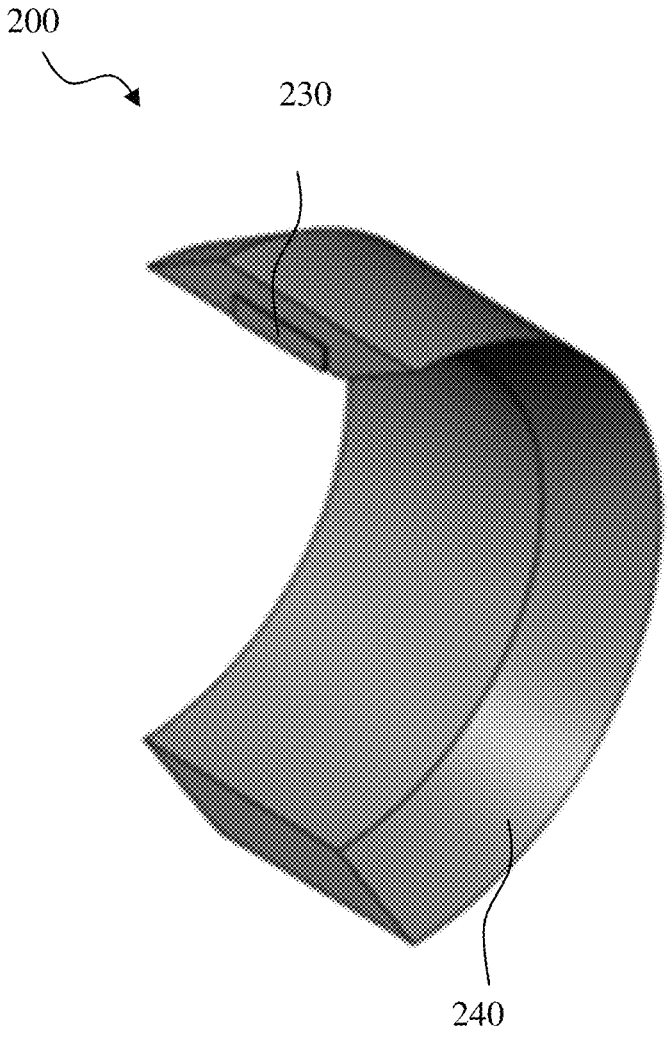
Figure 2C:
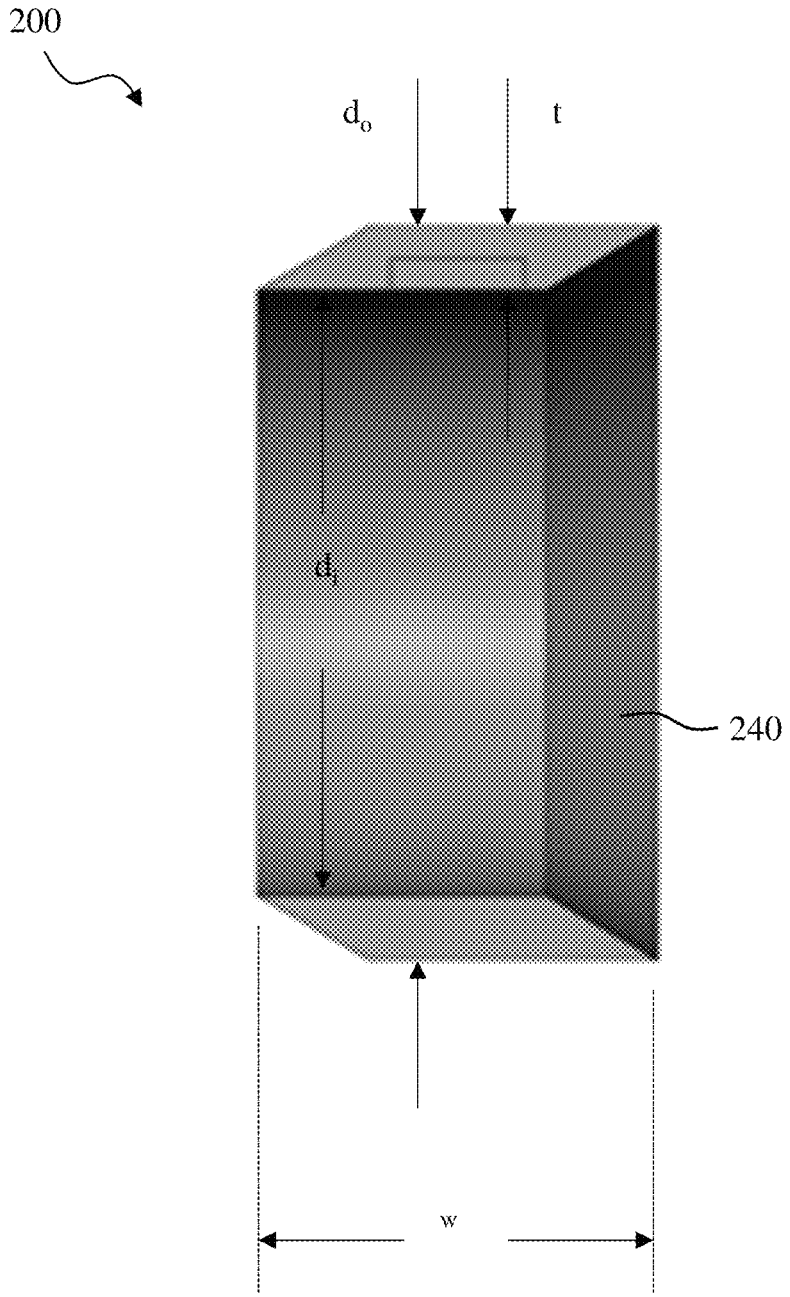

Turning to FIGS. 2A through 2C, illustrated are various different views of one embodiment of a sealing/anchoring element 200 designed, manufactured and operated according to one embodiment of the disclosure. The sealing/anchoring element 200, in the illustrated embodiment, includes a circlet 210 having an inside surface with an inside diameter ($d_i$), an outside surface with an outside diameter ($d_o$), a width (w), and a wall thickness (t). The circlet 210, in the illustrated embodiment, additionally includes one or more geometric features 220 that allow it to mechanically deform when moved from a radially reduced state to a radially enlarged state. Further to the embodiment of FIGS. 2A through 2C, the circlet 210 comprises an expandable metal configured to expand in response to hydrolysis, such as discussed in the paragraphs above, and thereby chemically deform from a radially reduced chemical state to a radially expanded chemical state.

In the illustrated embodiment, the one or more geometric features 220 are a slot or partial slot in the wall thickness (t) of the circlet 210. For example, a full slot could be used, thereby turning the circlet 210 into a C-ring of sorts. Alternatively, a partial slot could be used, such as shown in FIGS. 2A through 2C, such that the circlet is a full ring when in the radially reduced state, but snaps any remaining material 230 of the partial slot when the circlet 210 is moved to the radially enlarged state. In at least one embodiment, wherein multiple circlets are used, the one or more geometric features (e.g., slots) may be radially staggered around the mandrel.

In at least the embodiment of FIGS. 2A through 2C, the circlet 210 includes one or more angled surfaces 240 positioned along its inside diameter ($d_i$) and/or outside diameter ($d_o$). In at least the embodiment of FIGS. 2A through 2C, the angled surfaces 240 are configured to engage one or more associated wedges of a sealing/anchoring tool or one or more angled surfaces of another proximate circlet, for example to move the circlet 210 between the radially reduced state (e.g., as shown) and the radially enlarged state.

In at least one embodiment, the width (w) is no greater than 2.75 meters (e.g., about 9 feet). In at least one other embodiment, the width (w) is no greater than 1.83 meters (e.g., about 6 feet), if not no greater than 2.54 cm (e.g., 1 inch) or even 1 cm (e.g., 0.39 inches). In yet at least another embodiment, the width (w) ranges from 0.3 meters (e.g., about 1 foot) to 1.2 meters (e.g., about 4 feet). In at least one embodiment, the thickness (t) is no greater than 15 centimeters (e.g., about 5.9 inches). In at least one other embodiment, the thickness (t) is no greater than 9 centimeters (e.g., about 3.5 inches), if not no greater than 2.54 cm (e.g., 1 inch) or even 1 cm (e.g., 0.39 inches), or even 0.5 cm (e.g., 0.20 inches). In yet at least another embodiment, the thickness (t) ranges from 15 centimeters (e.g., about 5.9 inches) to 6 centimeters (e.g., about 2.4 inches).

Figure 3A:
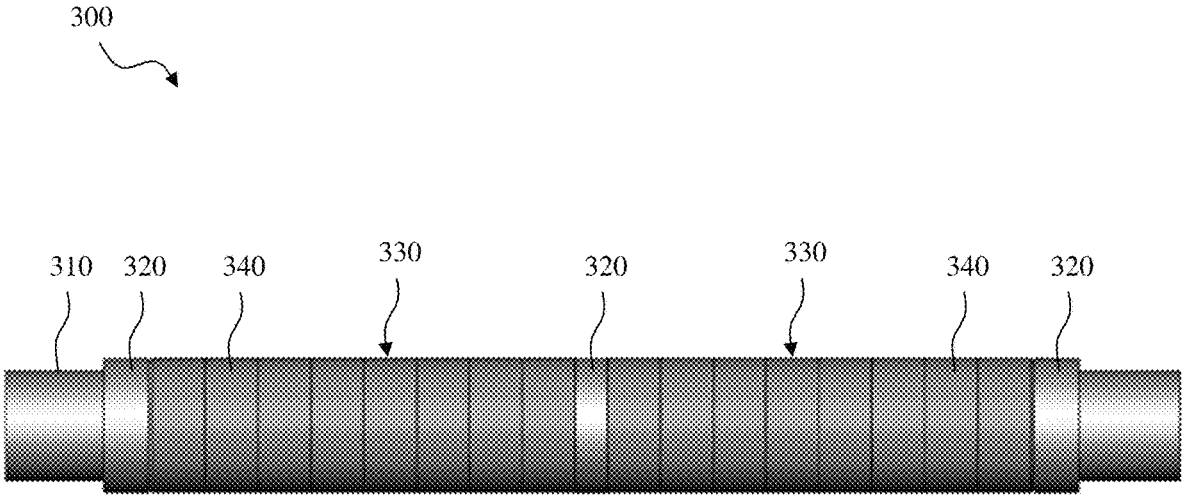
FIGS. 3A and 3B depict various different deployment states for a sealing/anchoring tool designed, manufactured and operated according to one embodiment of the disclosure.
Figure 3B:
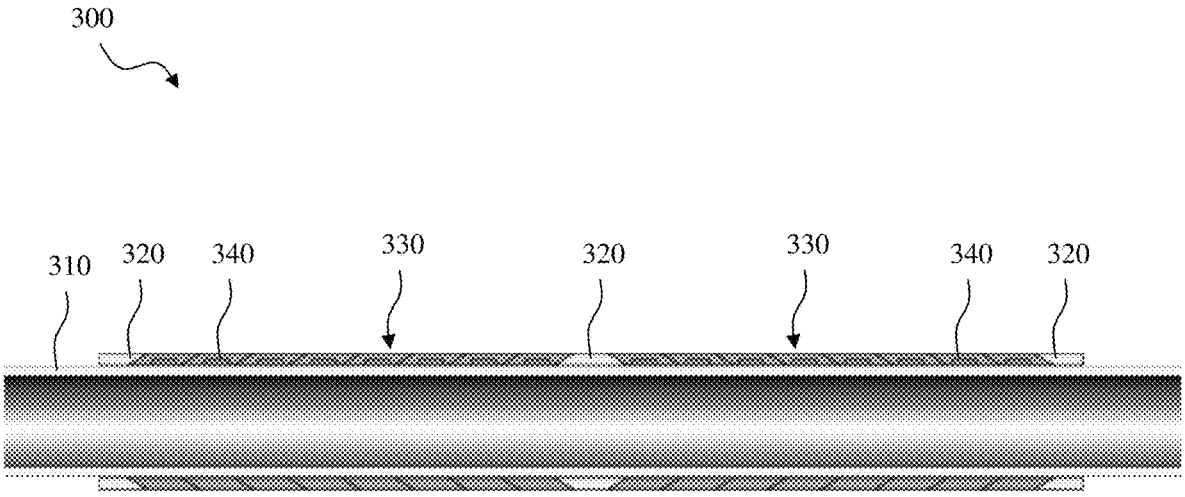

Turning to FIGS. 3A and 3B, illustrated are a perspective view and a cross-sectional view of one embodiment of a sealing/anchoring tool 300 designed, manufactured and operated according to an alternative embodiment of the disclosure. The sealing/anchoring tool 300, in the illustrated embodiment, includes a mandrel 310. Any mandrel 310 according to the disclosure may be used. The sealing/anchoring tool 300 additionally includes one or more wedges 320 (e.g., which may also comprise a metal configured to expand in response to hydrolysis) positioned about the mandrel 310, as well as one or more sealing/anchoring elements 330 positioned about the mandrel 310 and proximate the one or more wedges 320. The one or more sealing/anchoring elements 330, may be similar to the sealing/anchoring element 200 disclosed above, or similar to any other design of a sealing/anchoring element according to one or more embodiments of the disclosure.

In the illustrated embodiment, the sealing/anchoring tool 300 includes a plurality of sealing/anchoring elements 330, each comprising one or more circlets 340, positioned between two or more wedges 320. Accordingly, the wedges 320 may be moved relative to one another (e.g., one of the wedges 320 may be fixed with the other of the wedges 320 moves, both of the wedges 320 may move, etc.) to move the circlets 340 from the radially reduced mechanical state as shown in FIG. 3B, to the radially enlarged mechanical state (not shown). Furthermore, as the circlets 340 comprise a metal configured to expand in response to hydrolysis, they may also chemically deform to move from a radially reduced chemical state to a radially enlarged chemical state. In certain embodiments, the mechanical expansion occurs prior to any chemical expansion, thus the circlets 340 would initially move from the radially reduced mechanical state to the radially enlarged mechanical state, and then at some point thereafter, the circlets 340 would move from the radially reduced chemical state (e.g., also the radially enlarged mechanical state) to the radially enlarged chemical state. In yet other embodiments, the mechanical expansion and the chemical expansion work at least partially in unison.

However, it is unlikely (but not impossible) that the chemical expansion would start and complete prior to the mechanical expansion.

Figure 4A:
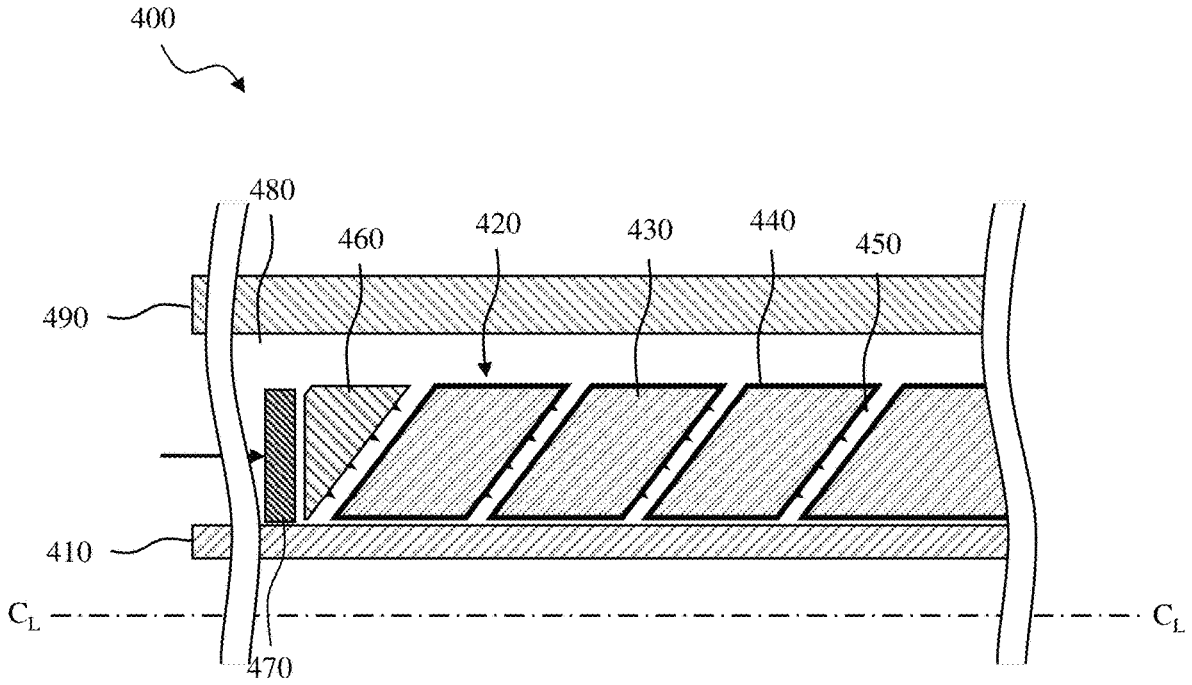
FIGS. 4A through 4D depict various different deployment states for a sealing/anchoring tool designed, manufactured and operated according to an alternative embodiment of the disclosure.
Figure 4B:
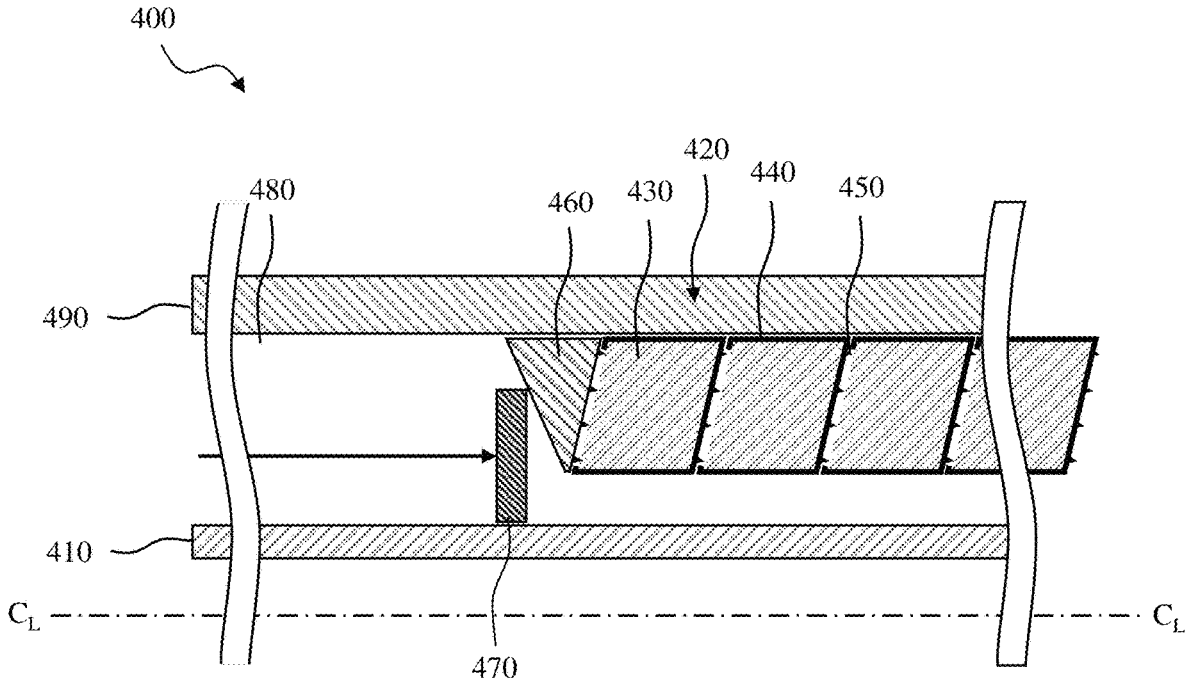
Figure 4C:
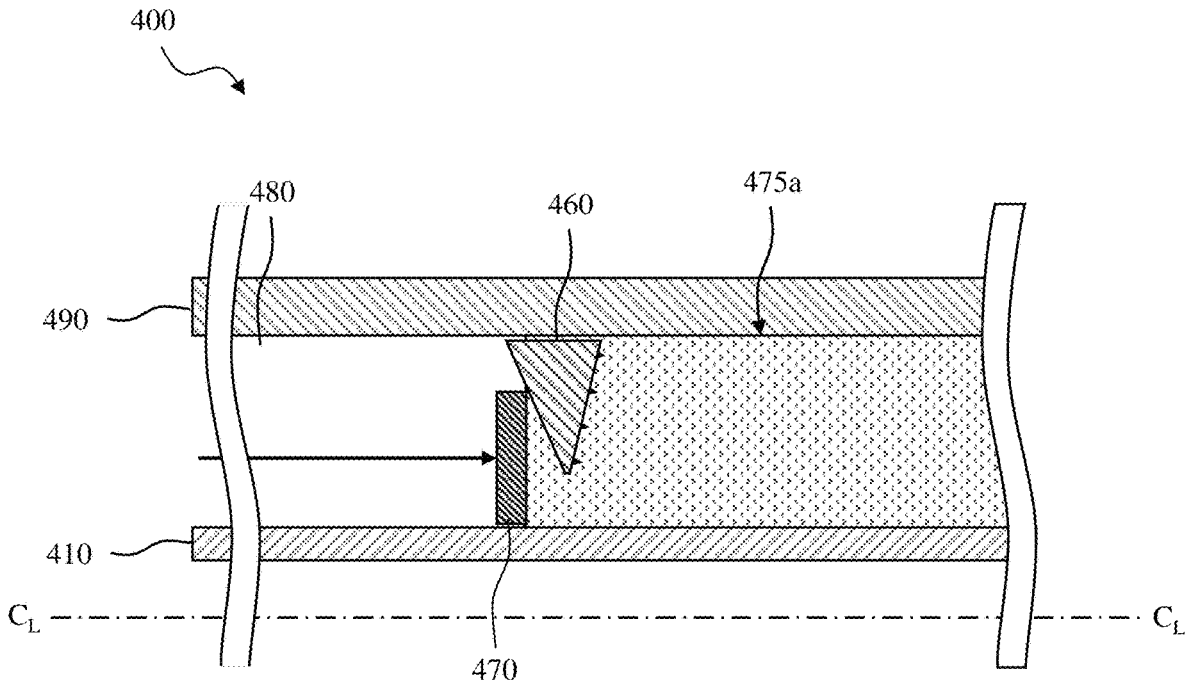
Figure 4D:
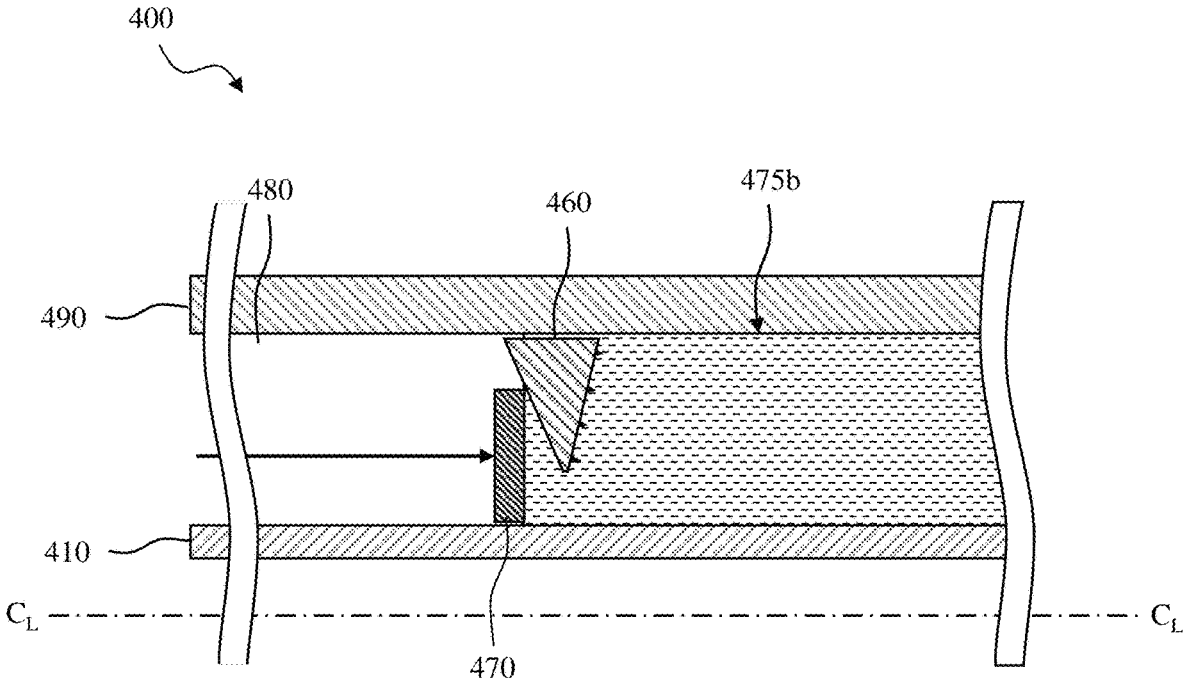

Turning now to FIGS. 4A through 4D, illustrated are various different deployment states for a sealing/anchoring tool 400 designed, manufactured and operated according to one aspect of the disclosure. FIG. 4A illustrates the sealing/anchoring tool 400 in a run-in-hole state, and thus its sealing/anchoring element is in the radially reduced mechanical state, and furthermore the expandable metal has not been subjected to reactive fluid to begin hydrolysis. In contrast, FIG. 4B illustrates the sealing/anchoring tool 400 with its sealing/anchoring element in the radially enlarged mechanical state, but again the expandable metal has not been subjected to reactive fluid to begin hydrolysis (e.g., and thus is in its radially reduced chemical state). In contrast, FIG. 4C illustrates the sealing/anchoring tool 400 with its radially enlarged sealing/anchoring element having been subjected to reactive fluid, and thus starting the hydrolysis reaction, thereby forming an expanded metal sealing/anchoring element (e.g., the sealing/anchoring element post-expansion, or in a radially enlarged chemical state). As disclosed above, the expandable metal may be subjected to a suitable reactive fluid within the wellbore, thereby forming the expanded metal sealing/anchoring element. In contrast, FIG. 4D illustrates the sealing/anchoring tool 400 with its radially enlarged sealing/anchoring element having been subjected to reactive fluid, and thus starting the hydrolysis reaction, thereby forming an expanded metal sealing/anchoring element (e.g., the sealing/anchoring element post-expansion, or in a radially enlarged chemical state), but also having residual unreacted expandable metal therein.

The sealing/anchoring tool 400, in the illustrated embodiment of FIGS. 4A through 4D, includes a mandrel 410. The mandrel 410, in the illustrated embodiment, is centered about a centerline (CO. The sealing/anchoring tool 400, in at least the embodiment of FIGS. 4A through 4D, is located in a bore 490 positioned around the mandrel 410. The bore 490, in at least one embodiment, is a tubular positioned within a wellbore, such as a casing, production tubing, etc. The bore 490, in at least one other embodiment, is exposed wellbore. In accordance with one aspect of the disclosure, the mandrel 410 and the bore 490 form an annulus 480. In one or more embodiments of the disclosure, the sealing/anchoring tool 400 is a frac plug or production packer, among other tools, and thus may provide sealing or anchoring, or both sealing and anchoring.

In accordance with one embodiment of the disclosure, the sealing/anchoring tool 400 includes one or more sealing/anchoring elements 420 positioned about the mandrel 410. In at least one embodiment, the sealing/anchoring elements 420 include one or more circlets 430. The circlets 430, as discussed above, may include an inside surface having an inside diameter ($d_i$), an outside surface having an outside diameter ($d_o$), a width (w), and a wall thickness (t). Furthermore, at least a portion of the circlets 430 may comprise a metal configured to expand in response to hydrolysis.

The circlets 430 may additionally include one or more geometric features that allow them to mechanically deform when moved from a radially reduced mechanical state to a radially enlarged mechanical state. In at least one embodiment, the one or more geometric features are one or more cuts (not shown) (e.g., axial cuts extending entirely through the wall thickness (t) along the width (w)). Nevertheless, other geometric features are within the scope of the disclosure.

In the illustrated embodiment, each of the circlets 430 includes a delay coating or protective layer 440. The delay coating or protective layer 440 may be similar to any of those disclosed herein. Further to the embodiment of FIG. 4A, each of the circlets 430 may have a roughened surface 450. The roughened surface 450 may be employed to remove portions of the delay coating or protective layer 440 as the circlets 430 slide relative to one another, and thus help expose the circlets 430 to the reactive fluid. In at least one embodiment, the roughened surface is a series of spikes, ridges, and/or threads. Nevertheless, any type of roughened surface is within the scope of the disclosure. For example, the roughened surface 450 may have an average surface roughness ($R_a$) of at least about 0.8 μm. In yet another embodiment, the roughened surface 450 may have an average surface roughness ($R_a$) of at least about 6.3 μm, or in yet an even different embodiment may have an average surface roughness ($R_a$) of at least about 12.5 μm, if not at least 1 mm.

The sealing/anchoring tool 400, in the illustrated embodiment, additionally includes the one or more associated wedges 460 (e.g., a first wedge and a second wedge located on opposing sides of the sealing/anchoring element 420). The one or more associated wedges 460, in one or more embodiments, are configured to axially slide along the mandrel 410 relative to the circlets 430 to move the circlets 430 from the radially reduced mechanical state to the radially enlarged mechanical state (e.g., the first and second wedges configured to axial slide along the mandrel relative to one another to move the circlet from the radially reduced mechanical state to the radially enlarged mechanical state, as if it were a frac plug). The one or more associated wedges 460, in the illustrated embodiment, include one or more associated angled surfaces. As is evident in the embodiment of FIGS. 4A through 4D, the one or more associated angled surfaces are operable to engage with the opposing angled surfaces of the circlets 430, and thus move the circlets 430 between the radially reduced mechanical state (e.g., as shown in FIG. 4A) and a radially enlarged mechanical state (e.g., as shown in FIG. 4B).

The sealing/anchoring tool 400, in the illustrated embodiment, may additionally include one or more end rings 470 located on opposing sides of the one or more associated wedges 460. In the illustrated embodiment, one of the end rings 470 may be axially fixed relative to the mandrel 410 or the bore 490, and the other of the end rings 470 is allowed to axially move relative to the mandrel 410 or the bore 490, and thus move the circlet 430 between the radially reduced mechanical state (e.g., as shown in FIG. 4A) and a radially enlarged mechanical state (e.g., as shown in FIG. 4B). In yet another embodiments, both of the end rings 470 are allowed to axially move.

The sealing/anchoring tool 400, in one or more embodiments, may additionally include a piston structure (not shown) for axially moving one or more of the free end rings 470. Accordingly, the piston structure may be used to move the circlet 430 between the radially reduced mechanical state (e.g., as shown in FIG. 4A) and a radially enlarged mechanical state (e.g., as shown in FIG. 4B). The piston structure may take on many different designs while remaining within the scope of the present disclosure.

With reference to FIG. 4A, the circlet(s) 430 may comprise any of the expandable metals discussed above. The circlet(s) 430 may have a variety of different shapes, sizes, etc. and remain within the scope of the disclosure.

With reference to FIG. 4B, illustrated is the sealing/anchoring tool 400 of FIG. 4A after mechanically setting the sealing/anchoring element 420. In the illustrated embodiment of FIG. 4B, the sealing/anchoring element 420 is set by axially moving (e.g., by way of the piston) the end rings 470 relative to one another and thereby engaging the one or more associated angled surfaces of the one or more wedges 460 with the opposing angled surfaces of the circlet 430. Accordingly, the sealing/anchoring element 420 is moved between the radially reduced mechanical state (e.g., as shown in FIG. 4A) and the radially enlarged mechanical state shown in FIG. 4B. In at least one embodiment, the mechanical deformation increases the outside diameter by at least 5 percent. In yet another embodiment, the mechanical deformation increases the outside diameter by at least 20 percent, and in yet one other embodiment the mechanical deformation increases the outside diameter by a range of 5 percent to 50 percent.

In the illustrated embodiment of FIG. 4B, the sealing/anchoring element 420 engages with the bore 490, thereby spanning the annulus 480. Further to the embodiment of FIG. 4B, the circlet 430 has been mechanically deformed. Thus, in certain instances the circlet 430 has been elastically deformed, in certain other instances the circlet 430 has been plastically deformed, and in yet other embodiments the circlet 430 has been elastically and plastically deformed.

With reference to FIG. 4C, illustrated is the sealing/anchoring tool 400 of FIG. 4B after subjecting the sealing/anchoring element 420 to reactive fluid to form an expanded metal sealing/anchoring element 475*a*, as discussed above. The reactive fluid may be any of the reactive fluid discussed above. In the illustrated embodiment of FIG. 4C, the expanded metal sealing/anchoring element 475*a* at least partially fills the annulus 480, and thereby acts as a seal/anchor. For example, the expanded metal sealing/anchoring element 475*a* might act as a seal, with very little anchoring ability. In yet other embodiments, the expanded metal sealing/anchoring element 475*a* might act as an anchor, with very little sealing ability. In even yet other embodiments, the expanded metal sealing/anchoring element 475*a* might act as a highly suitable seal and anchor. It should be noted, that as the expanded metal sealing/anchoring element 475*a* remains in the radially enlarged state regardless of the force from the piston structure, certain embodiments may remove the force from the piston structure after the expanded metal sealing/anchoring element 475*a* has been formed. Furthermore, the structure would not require any body lock rings, as might be required in the prior art structures.

In certain embodiments, the time period for the hydration of the circlet 430 is different from the time period for setting the sealing/anchoring element 420. For example, the setting of the sealing/anchoring element 420 might create a quick, but weaker, seal/anchor for the sealing/anchoring tool 400, whereas the circlet 430 could take multiple hours to several days for the hydrolysis process to fully expand, but provide a strong seal/anchor for the sealing/anchoring tool 400.

While not shown, the sealing/anchoring tool 400, and more particularly the sealing/anchoring element 420 of the sealing/anchoring tool 400, may additionally include one or more additional sealing elements. For example, the one or more additional sealing elements could be located uphole or downhole of the sealing/anchoring element 420, and thus be used to fluidly seal the annulus 480. In many situations, the one or more additional sealing elements comprise elastomeric sealing elements that are located downhole of the sealing/anchoring element 420.

A sealing/anchoring tool, and related sealing/anchoring element, according to the present disclosure may provide higher technical ratings and/or may provide a lower cost alternative to existing sealing/anchoring elements contained of today's packers and frac plugs. A sealing/anchoring tool, and related sealing/anchoring element, employs a game changing material that gets away from the issues found in conventional elastomeric devices, such as: extreme temperature limits, low temperature sealing limits, swabbing while running, extrusion over time, conforming to irregular shapes, etc.

With reference to FIG. 4D, illustrated is the sealing/anchoring tool 400 of FIG. 4C after subjecting the sealing/anchoring element 420 to reactive fluid to form an expanded metal, the sealing/anchoring element having residual unreacted expandable metal therein 475*b*, as discussed above.

Figure 5A:
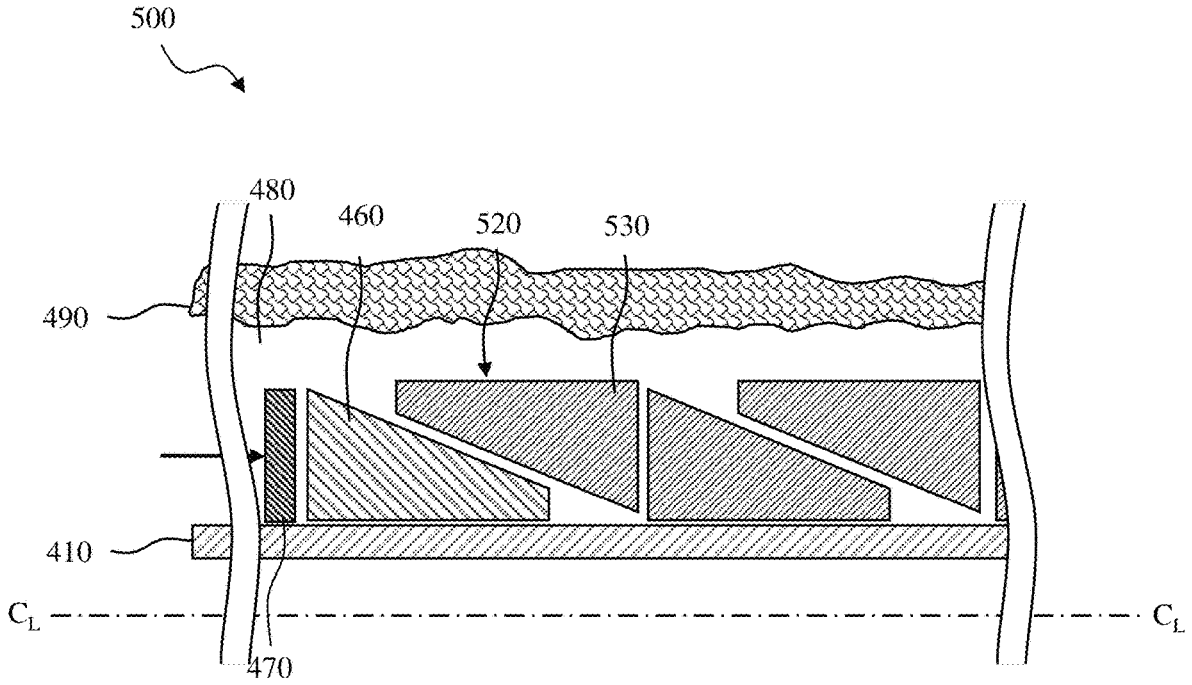
FIGS. 5A through 5D depict various different deployment states for a sealing/anchoring tool designed, manufactured and operated according to an alternative embodiment of the disclosure.
Figure 5B:
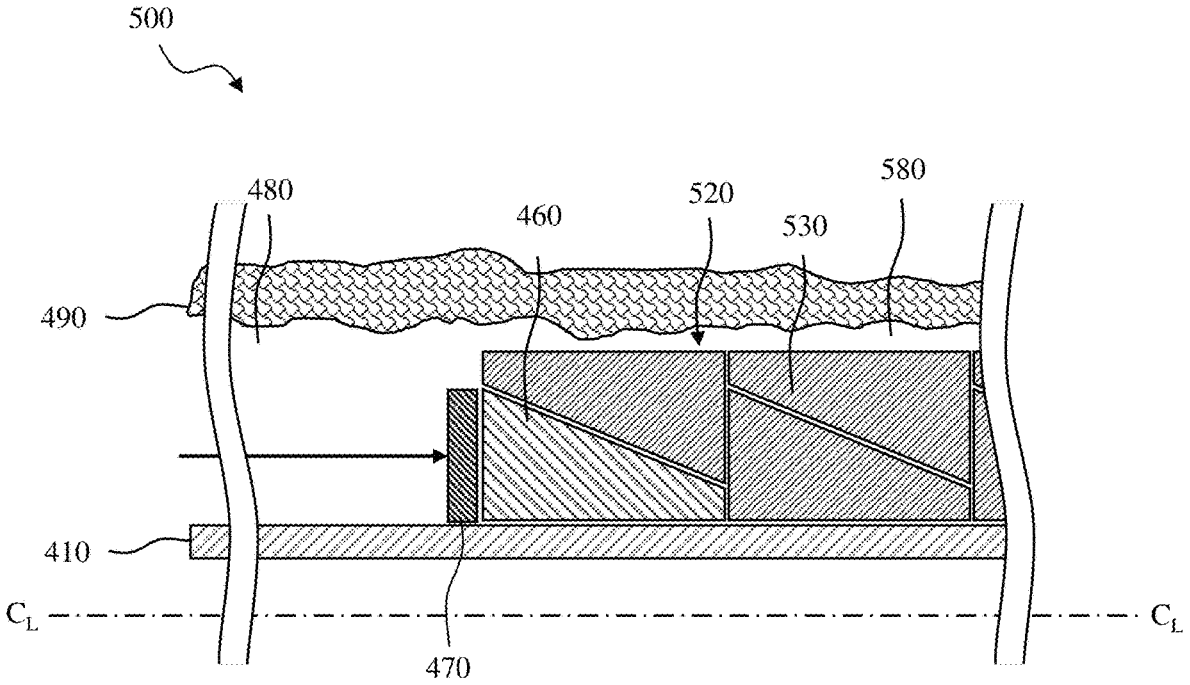
Figure 5C:
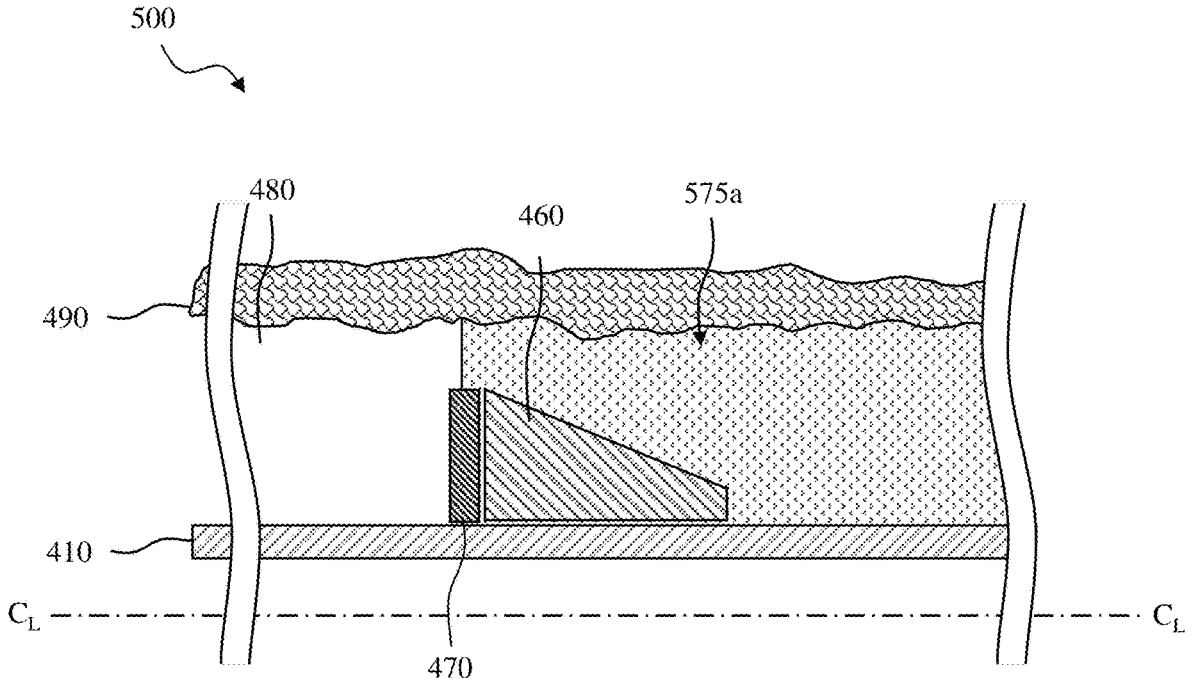
Figure 5D:
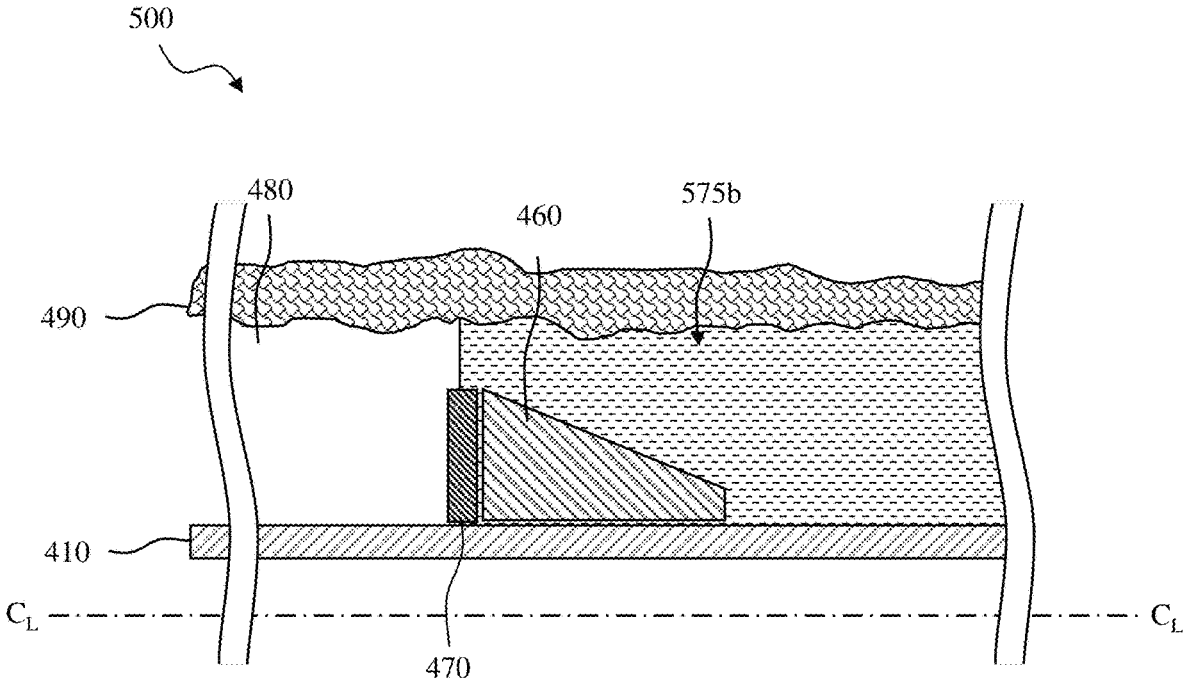

Turning to FIGS. 5A through 5D, depicted are various different deployment states for a sealing/anchoring tool 500 designed, manufactured and operated according to an alternative embodiment of the disclosure. FIG. 5A illustrates the sealing/anchoring tool 500 in a run-in-hole state, and thus its sealing/anchoring element is in the radially reduced mechanical state, and furthermore the expandable metal has not been subjected to reactive fluid to begin hydrolysis. In contrast, FIG. 5B illustrates the sealing/anchoring tool 500 with its sealing/anchoring element in the radially enlarged mechanical state, but again the expandable metal has not been subjected to reactive fluid to begin hydrolysis. In contrast, FIG. 5C illustrates the sealing/anchoring tool 500 with its radially enlarged sealing/anchoring element having been subjected to reactive fluid, and thus starting the hydrolysis reaction, thereby forming an expanded metal sealing/anchoring element (e.g., the sealing/anchoring element post-expansion). In contrast, FIG. 5D illustrates the sealing/anchoring tool 500 with its radially enlarged sealing/anchoring element having been subjected to reactive fluid, and thus starting the hydrolysis reaction, thereby forming an expanded metal sealing/anchoring element having residual unreacted expandable metal therein (e.g., the sealing/anchoring element post-expansion). As disclosed above, the expandable metal may be subjected to a suitable reactive fluid within the wellbore, thereby forming the expanded metal sealing/anchoring element.

The sealing/anchoring tool 500 is similar in certain respects to the sealing/anchoring tool 400. Accordingly, like reference numbers have been used to indicate similar, if not identical, features. The sealing/anchoring tool 500 differs, for the most part, from the sealing/anchoring tool 400, in that the sealing/anchoring tool 500 employs a sealing/anchoring element 520 with different shaped circlets 530. The different shaped circlets 530 of FIGS. 5A through 5D, in at least one embodiment, substantially prevent the circlets 530 from contacting the bore 490 when they move from the radially reduced mechanical state to the radially enlarged mechanical state (e.g., act as a mechanical expansion limiter). For example, in at least one embodiment, a move from the radially reduced mechanical state to the radially expanded mechanical state leaves a gap 580 of at least 5% of the annulus 480, and thus the remaining 5% must be closed with chemical expansion. In yet another embodiment, a move from the radially reduced mechanical state to the radially expanded mechanical state leaves a gap 580 of at least 10% of the annulus 480, and thus the remaining 10% must be closed with chemical expansion. In yet another embodiment, a move from the radially reduced mechanical state to the radially expanded mechanical state leaves a gap 580 of at least 20% of the annulus 480, and thus the remaining 20% must be closed with chemical expansion. In yet another embodiment, a move from the radially reduced mechanical state to the radially expanded mechanical state leaves a gap 580 of at least 30% of the annulus 480, and thus the remaining 30% must be closed with chemical expansion. In yet another embodiment, a move from the radially reduced mechanical state to the radially expanded mechanical state leaves a gap 580 ranging from 15% to 25% of the annulus 480, and thus the remaining 15% to 25% must be closed with chemical expansion.

Through experimentation, it has been determined that the gap 580 has certain previously unknown benefits, including the ability for reactive fluid to readily access the circlets 530. What may result in one or more embodiments, after hydrolysis, is the expanded metal sealing/anchoring element 575*a*, as shown in FIG. 5C, or the expanded metal sealing/anchoring element having residual unreacted expandable metal therein 575*b*, as shown in FIG. 5D.

Figure 6A:
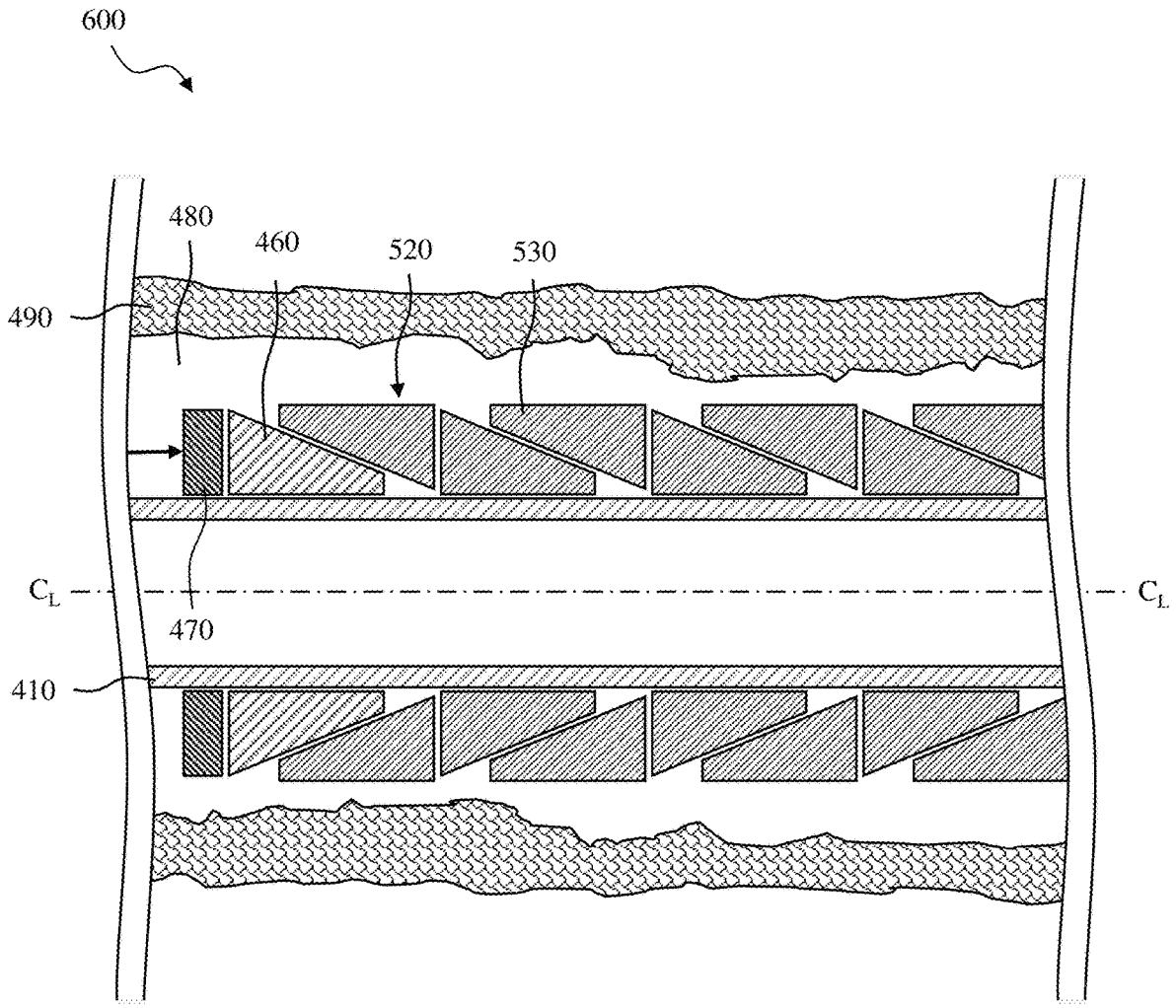
FIGS. 6A through 6D depict various different deployment states for a sealing/anchoring tool designed, manufactured and operated according to an alternative embodiment of the disclosure.
Figure 6B:
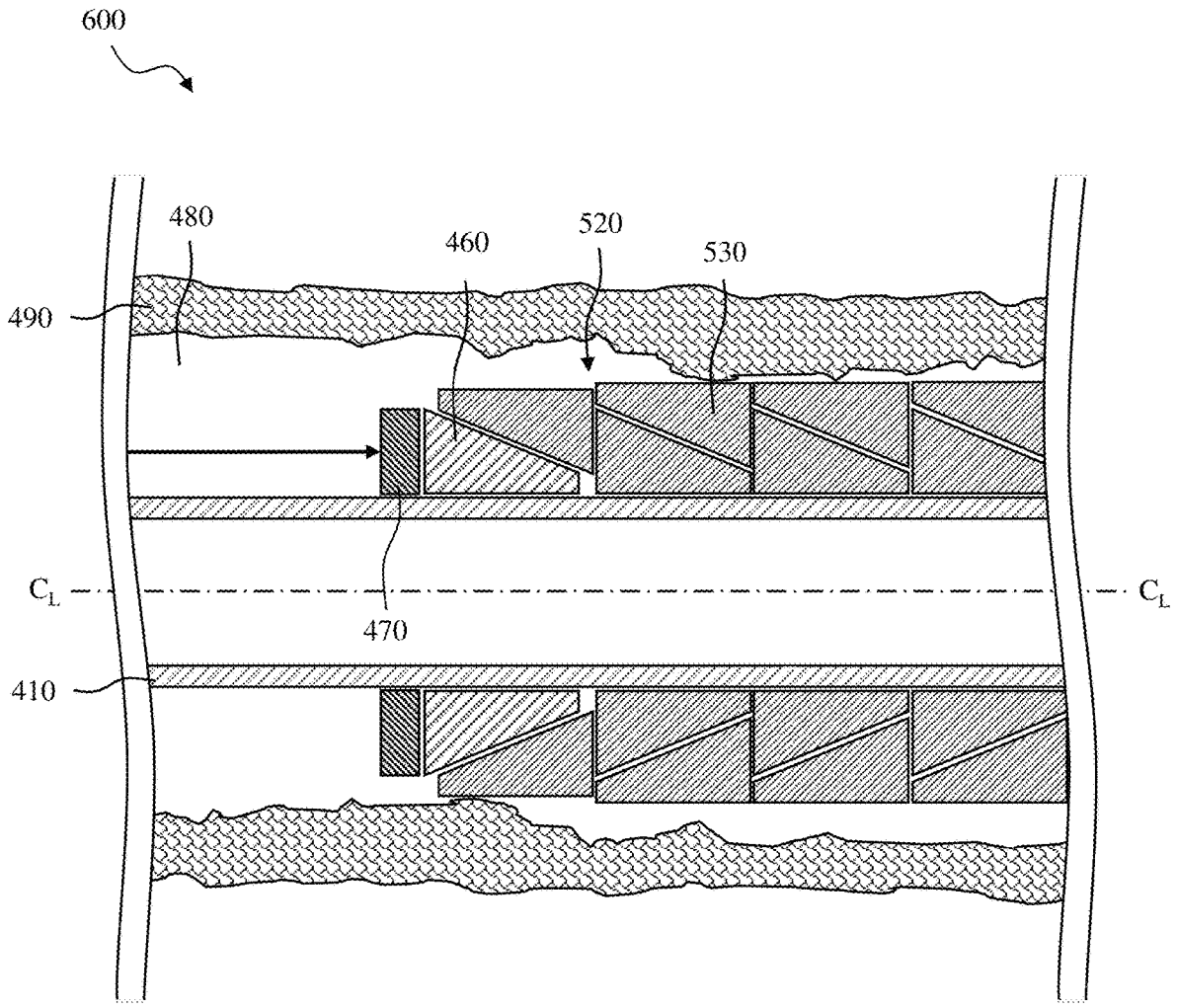
Figure 6C:
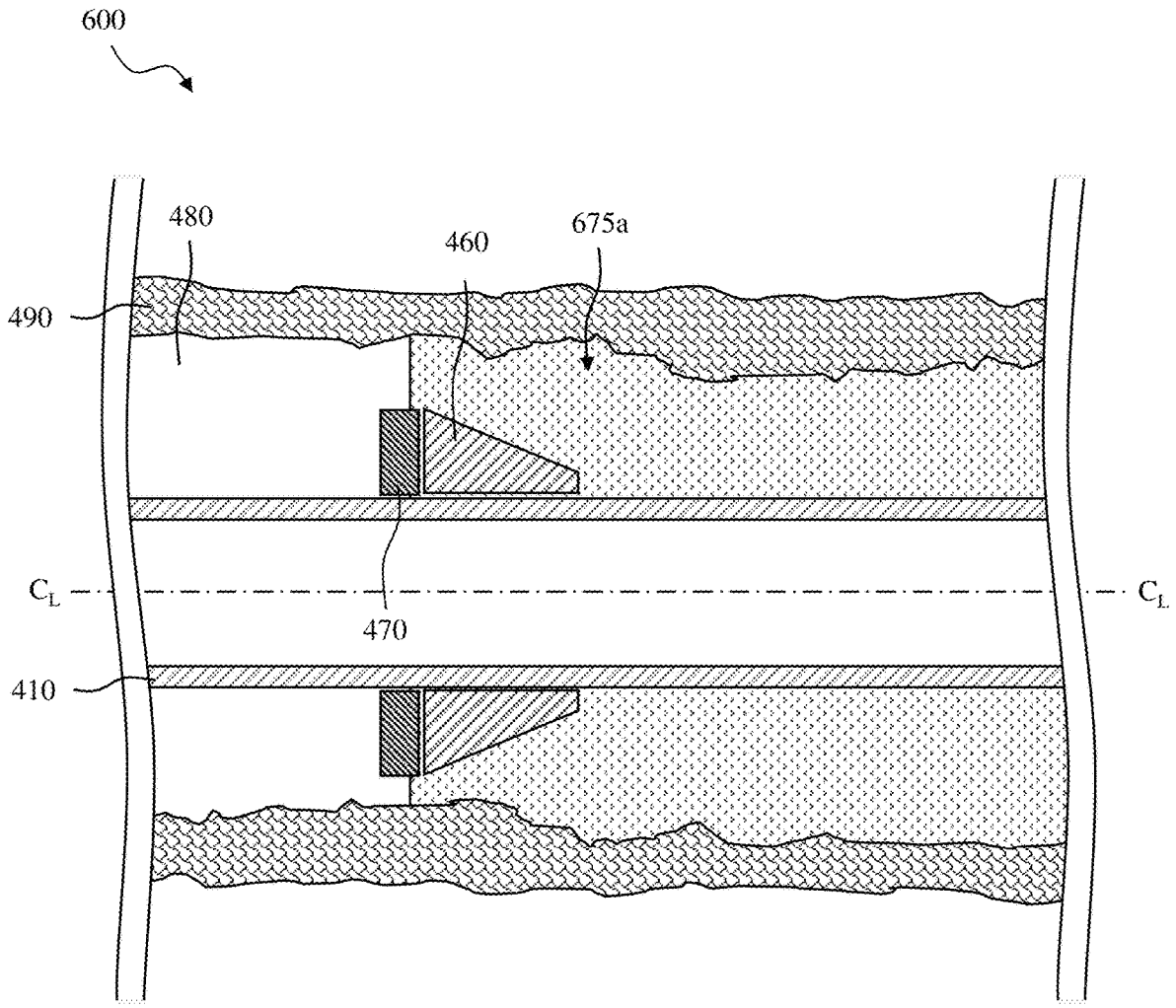
Figure 6D:
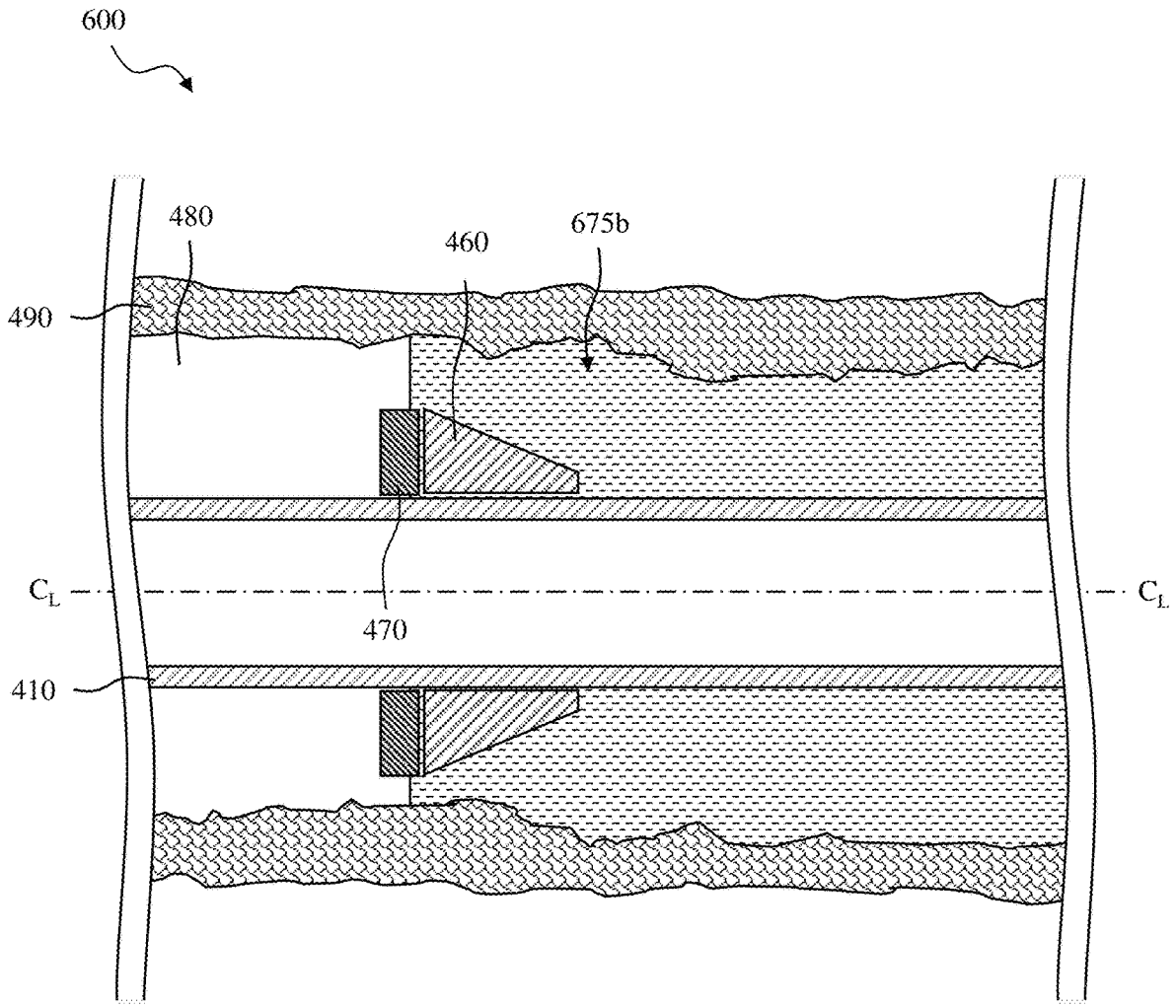

Turning to FIGS. 6A through 6D, depicted are various different deployment states for a sealing/anchoring tool 600 designed, manufactured and operated according to an alternative embodiment of the disclosure. FIG. 6A illustrates the sealing/anchoring tool 600 in a run-in-hole state, and thus its sealing/anchoring element is in the radially reduced mechanical state, and furthermore the expandable metal has not been subjected to reactive fluid to begin hydrolysis. In contrast, FIG. 6B illustrates the sealing/anchoring tool 600 with its sealing/anchoring element in the radially enlarged mechanical state, but again the expandable metal has not been subjected to reactive fluid to begin hydrolysis. In contrast, FIG. 6C illustrates the sealing/anchoring tool 600 with its radially enlarged sealing/anchoring element having been subjected to reactive fluid, and thus starting the hydrolysis reaction, thereby forming an expanded metal sealing/anchoring element (e.g., the sealing/anchoring element post-expansion). In contrast, FIG. 6D illustrates the sealing/anchoring tool 600 with its radially enlarged sealing/anchoring element having been subjected to reactive fluid, and thus starting the hydrolysis reaction, thereby forming an expanded metal sealing/anchoring element having residual unreacted expandable metal therein (e.g., the sealing/anchoring element post-expansion). As disclosed above, the expandable metal may be subjected to a suitable reactive fluid within the wellbore, thereby forming the expanded metal sealing/anchoring element.

The sealing/anchoring tool 600 is similar in certain respects to the sealing/anchoring tool 500. Accordingly, like reference numbers have been used to indicate similar, if not identical, features. The sealing/anchoring tool 600 differs, for the most part, from the sealing/anchoring tool 500, in that the sealing/anchoring tool 600 is capable of sealing a bore 690 with large changes in diameter in all directions (e.g., an irregular bore 490 size that may occur as a result of washout). What may result in one or more embodiments, after hydrolysis, is the expanded metal sealing/anchoring element 675*a*, as shown in FIG. 6C, or the expanded metal sealing/anchoring element having residual unreacted expandable metal therein 675*b*, as shown in FIG. 6D.

Figure 7A:
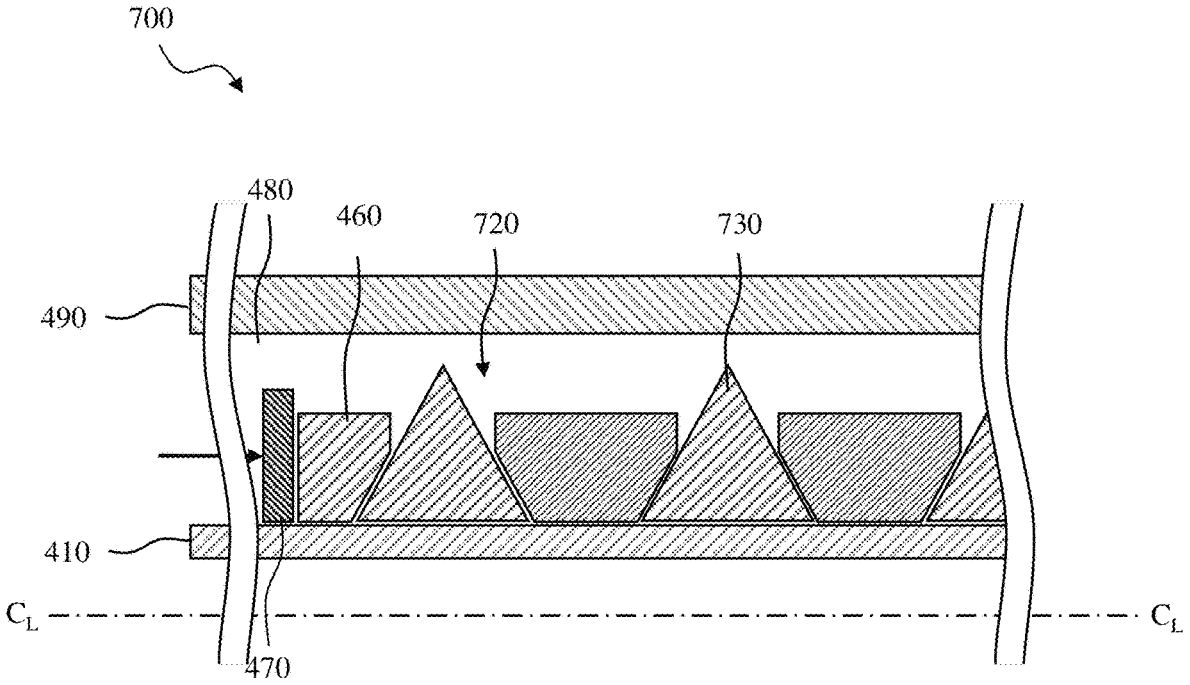
FIGS. 7A through 7D depict various different deployment states for a sealing/anchoring tool designed, manufactured and operated according to an alternative embodiment of the disclosure.
Figure 7B:
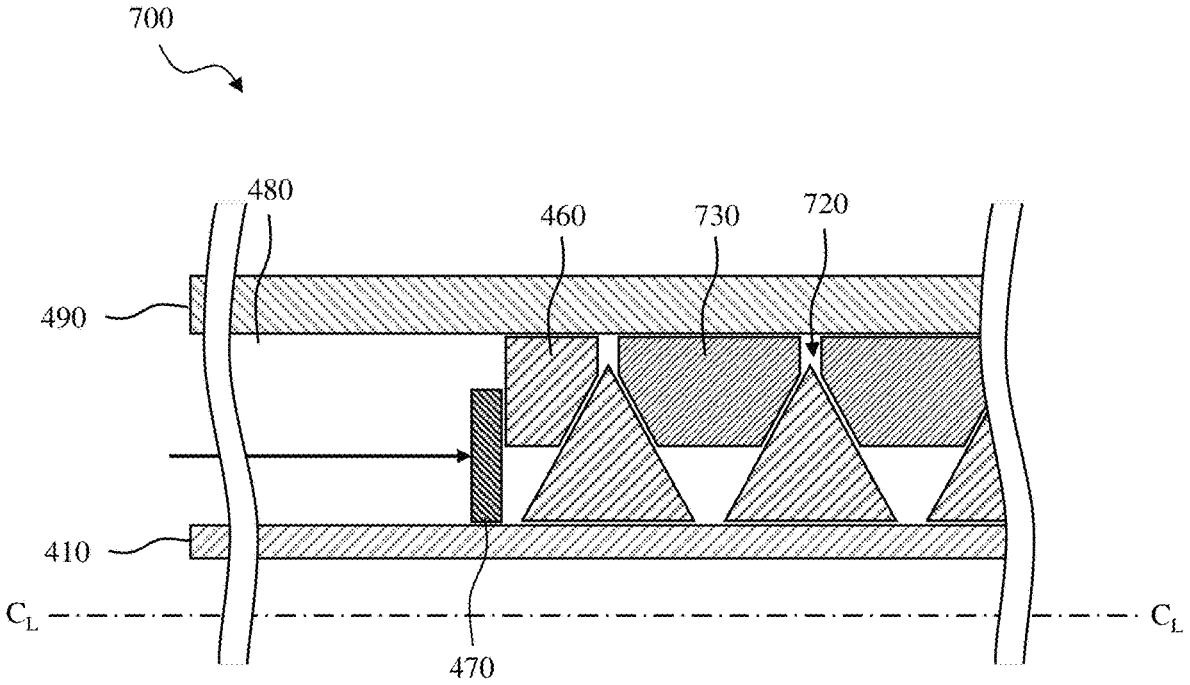
Figure 7C:
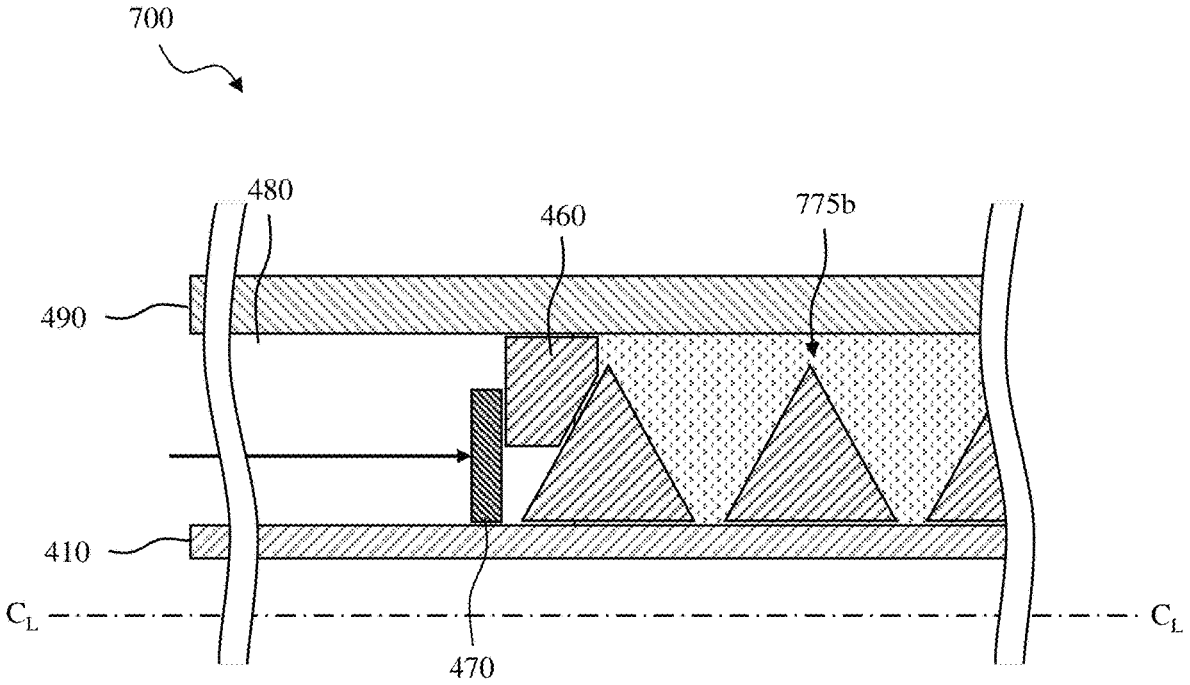
Figure 7D:
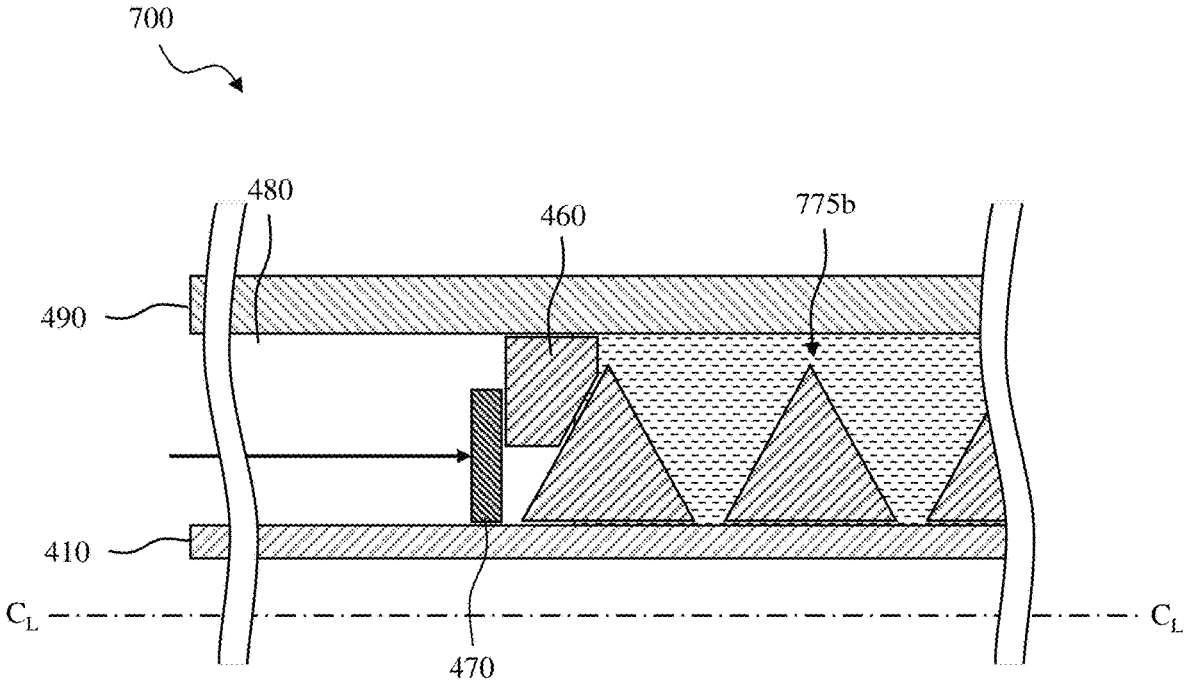

Turning to FIGS. 7A through 7D, depicted are various different deployment states for a sealing/anchoring tool 700 designed, manufactured and operated according to an alternative embodiment of the disclosure. FIG. 7A illustrates the sealing/anchoring tool 700 in a run-in-hole state, and thus its sealing/anchoring element is in the radially reduced mechanical state, and furthermore the expandable metal has not been subjected to reactive fluid to begin hydrolysis. In contrast, FIG. 7B illustrates the sealing/anchoring tool 700 with its sealing/anchoring element in the radially enlarged mechanical state, but again the expandable metal has not been subjected to reactive fluid to begin hydrolysis. In contrast, FIG. 7C illustrates the sealing/anchoring tool 700 with its radially enlarged sealing/anchoring element having been subjected to reactive fluid, and thus starting the hydrolysis reaction, thereby forming an expanded metal sealing/anchoring element (e.g., the sealing/anchoring element post-expansion). In contrast, FIG. 7D illustrates the sealing/anchoring tool 700 with its radially enlarged sealing/anchoring element having been subjected to reactive fluid, and thus starting the hydrolysis reaction, thereby forming an expanded metal sealing/anchoring element having residual unreacted expandable metal therein (e.g., the sealing/anchoring element post-expansion). As disclosed above, the expandable metal may be subjected to a suitable reactive fluid within the wellbore, thereby forming the expanded metal sealing/anchoring element.

The sealing/anchoring tool 700 is similar in certain respects to the sealing/anchoring tool 500. Accordingly, like reference numbers have been used to indicate similar, if not identical, features. The sealing/anchoring tool 700 differs, for the most part, from the sealing/anchoring tool 500, in that the sealing/anchoring tool 700 employs a sealing/anchoring element 720 with different shaped circlets 730, and furthermore includes alternating members that expand in response to hydrolysis and $d_o$ not expand in response to hydrolysis. What may result in one or more embodiments, after hydrolysis, is the expanded metal sealing/anchoring element 775*a*, as shown in FIG. 7C, or the expanded metal sealing/anchoring element having residual unreacted expandable metal therein 775*b*, as shown in FIG. 7D.

Figure 8A:
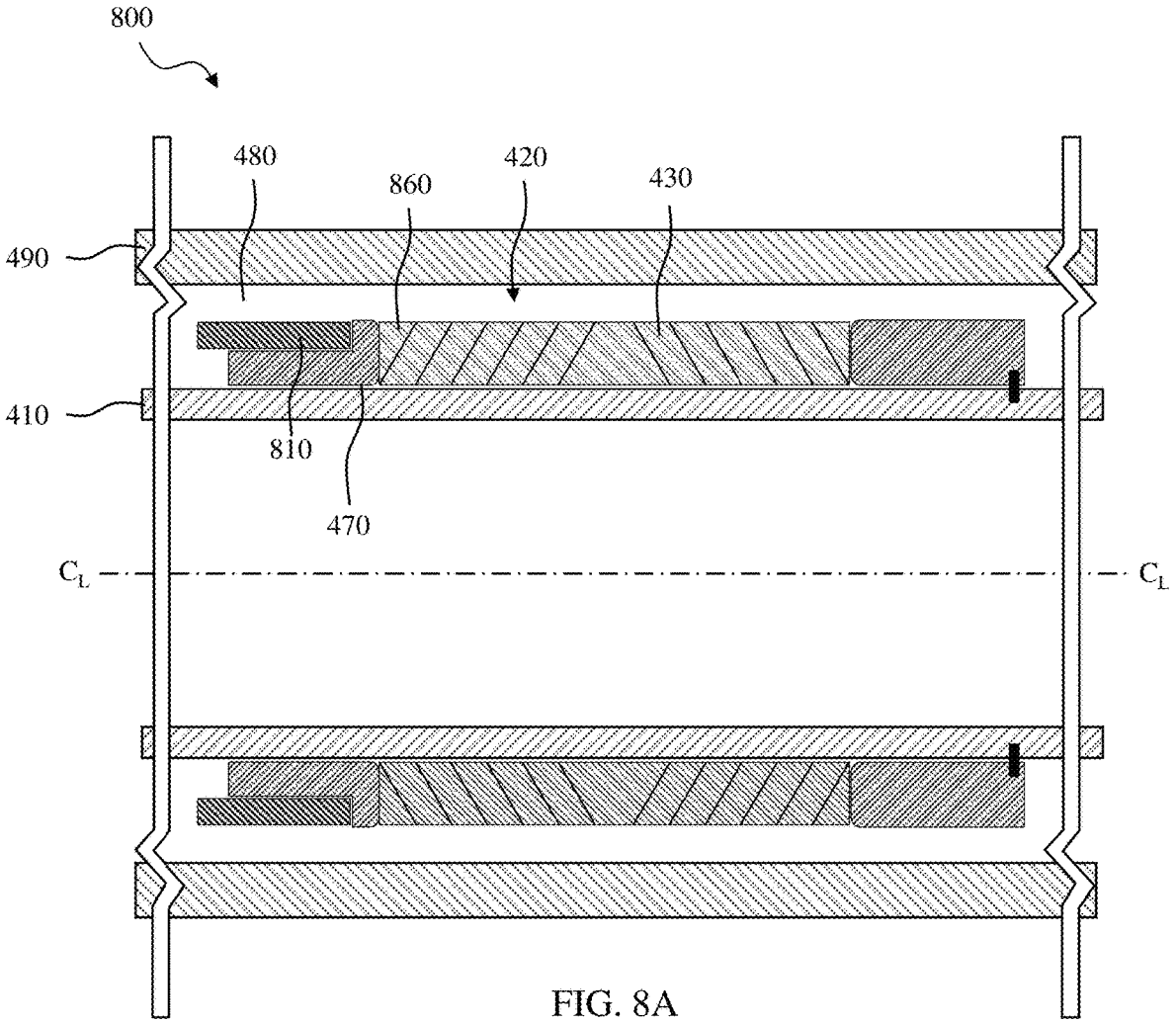
FIGS. 8A through 8D depict various different deployment states for a sealing/anchoring tool designed, manufactured and operated according to an alternative embodiment of the disclosure.
Figure 8B:
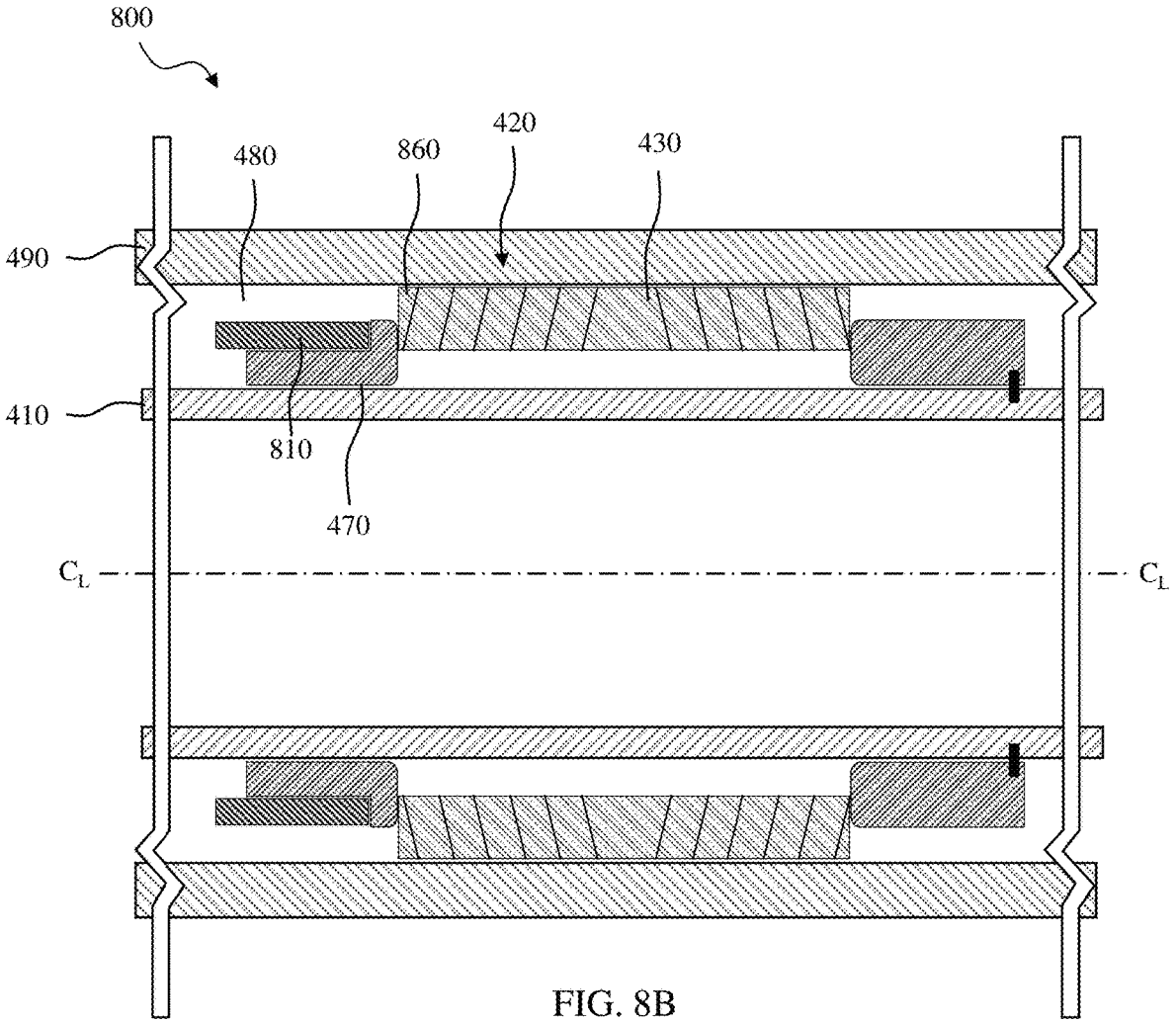
Figure 8C:
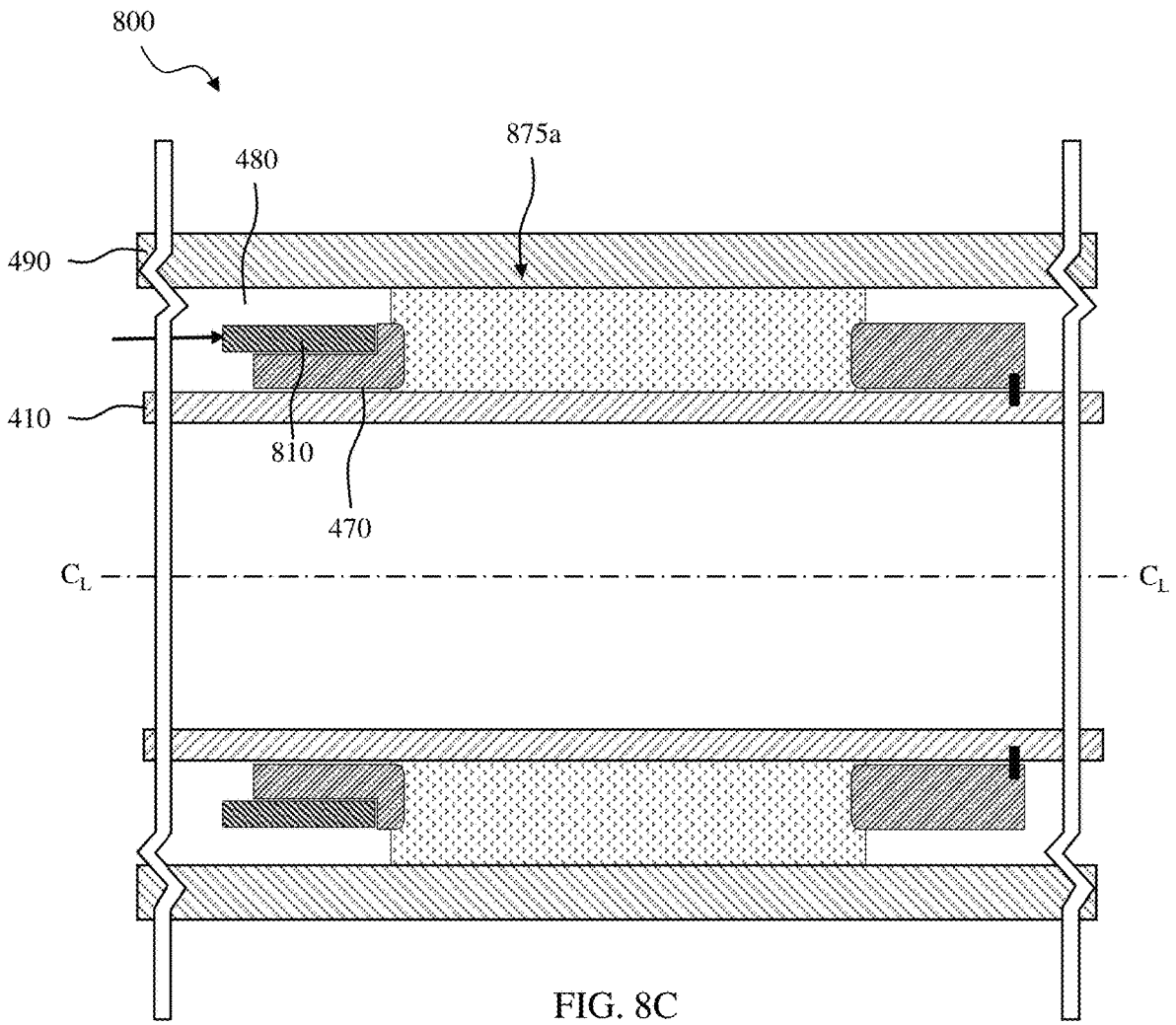
Figure 8D:
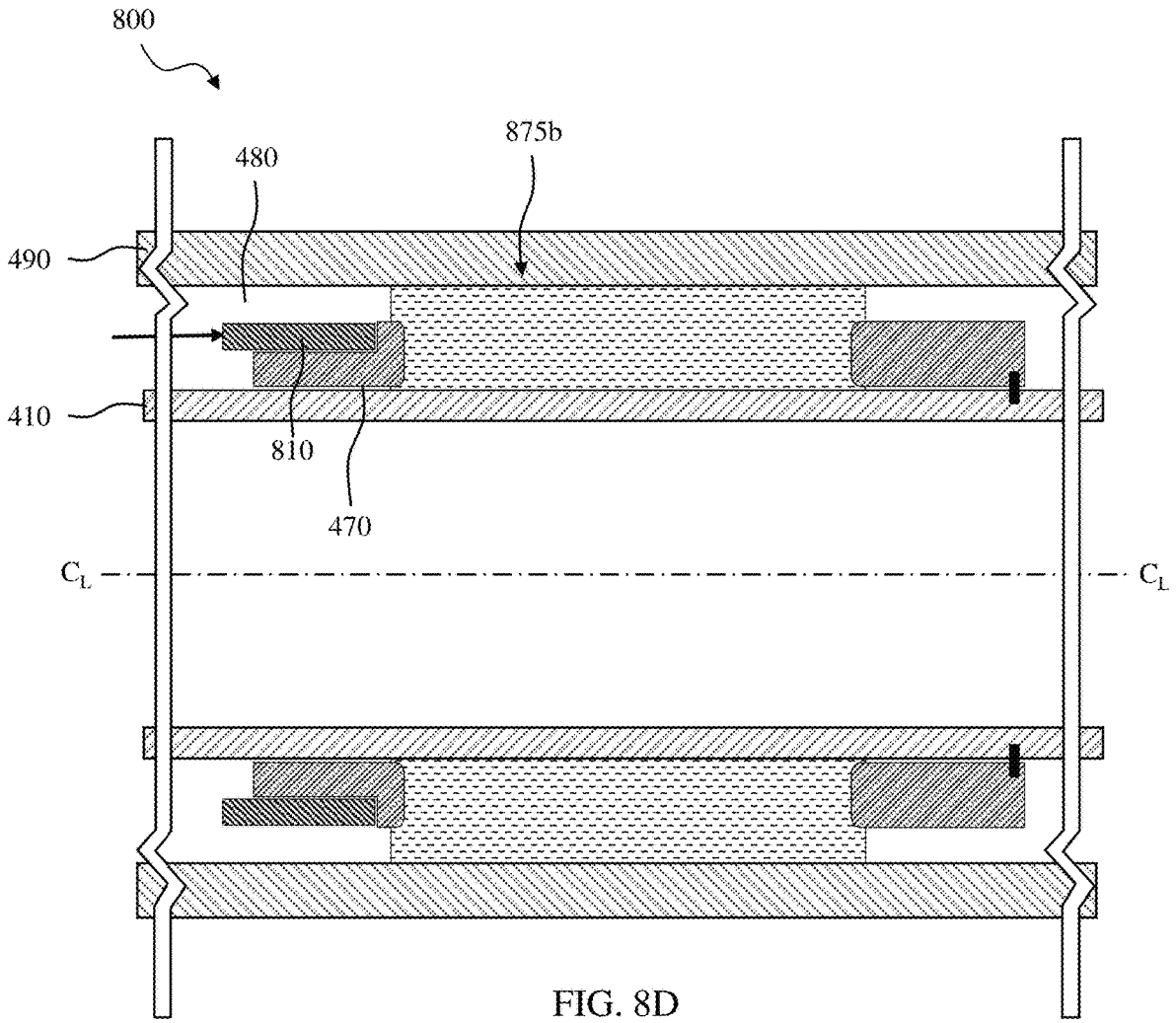

Turning to FIGS. 8A through 8D, depicted are various different deployment states for a sealing/anchoring tool 800 designed, manufactured and operated according to an alternative embodiment of the disclosure. FIG. 8A illustrates the sealing/anchoring tool 800 in a run-in-hole state, and thus its sealing/anchoring element is in the radially reduced mechanical state, and furthermore the expandable metal has not been subjected to reactive fluid to begin hydrolysis. In contrast, FIG. 8B illustrates the sealing/anchoring tool 800 with its sealing/anchoring element in the radially enlarged mechanical state, but again the expandable metal has not been subjected to reactive fluid to begin hydrolysis. In contrast, FIG. 8C illustrates the sealing/anchoring tool 800 with its radially enlarged sealing/anchoring element having been subjected to reactive fluid, and thus starting the hydrolysis reaction, thereby forming an expanded metal sealing/anchoring element (e.g., the sealing/anchoring element post-expansion). In contrast, FIG. 8D illustrates the sealing/anchoring tool 800 with its radially enlarged sealing/anchoring element having been subjected to reactive fluid, and thus starting the hydrolysis reaction, thereby forming an expanded metal sealing/anchoring element having residual unreacted expandable metal therein (e.g., the sealing/anchoring element post-expansion). As disclosed above, the expandable metal may be subjected to a suitable reactive fluid within the wellbore, thereby forming the expanded metal sealing/anchoring element.

The sealing/anchoring tool 800 is similar in certain respects to the sealing/anchoring tool 400. Accordingly, like reference numbers have been used to indicate similar, if not identical, features. The sealing/anchoring tool 800 differs, for the most part, from the sealing/anchoring tool 400, in that the sealing/anchoring tool 800 employs a wedge 860 comprising the metal configured to expand in response to hydrolysis, as well as employs a piston 810. What may result in one or more embodiments, after hydrolysis, is the expanded metal sealing/anchoring element 875*a*, as shown in FIG. 8C, or the expanded metal sealing/anchoring element having residual unreacted expandable metal therein 875*b*, as shown in FIG. 8D.

Figure 9A:
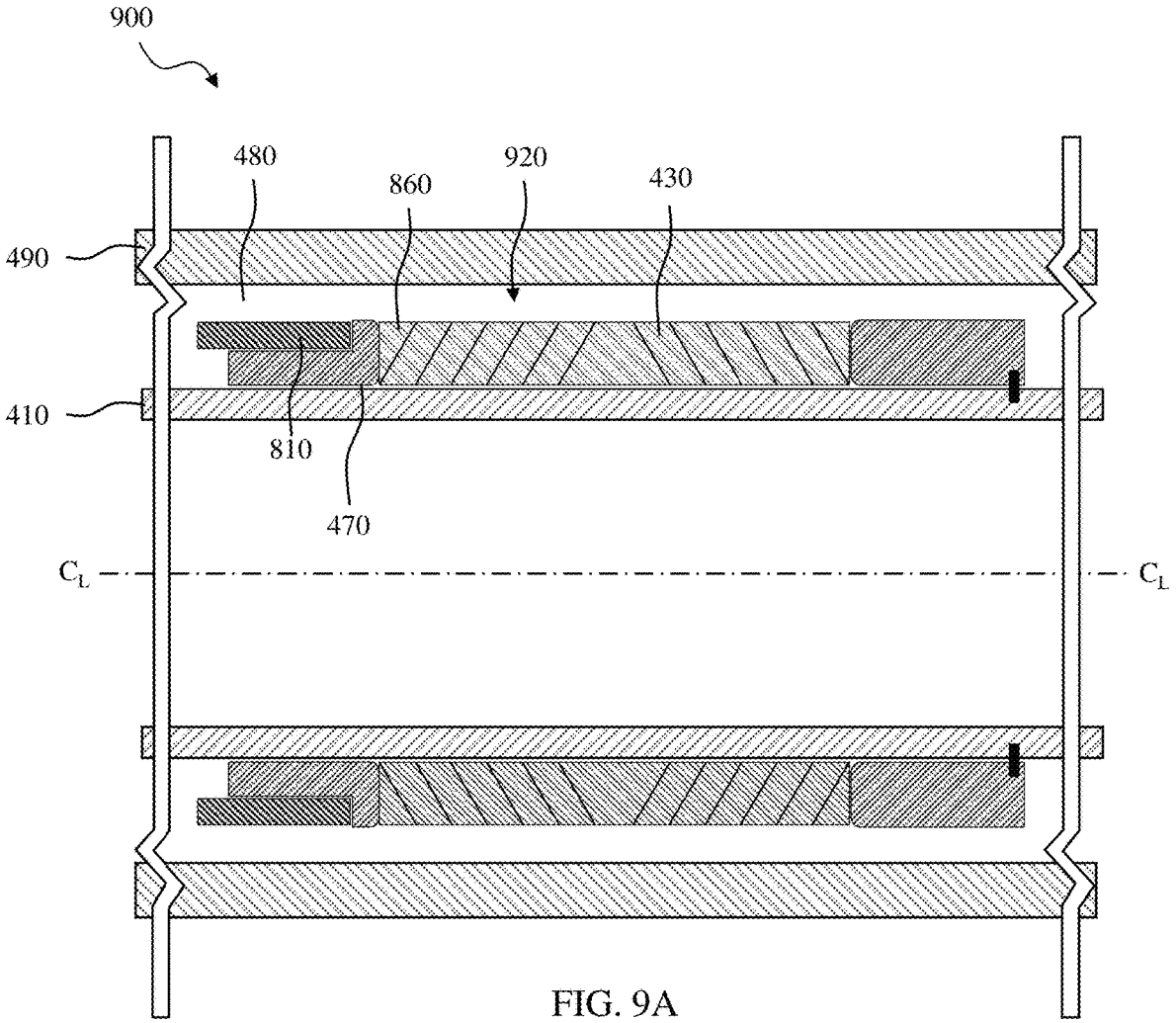
FIGS. 9A through 9D depict various different deployment states for a sealing/anchoring tool designed, manufactured and operated according to an alternative embodiment of the disclosure.
Figure 9B:
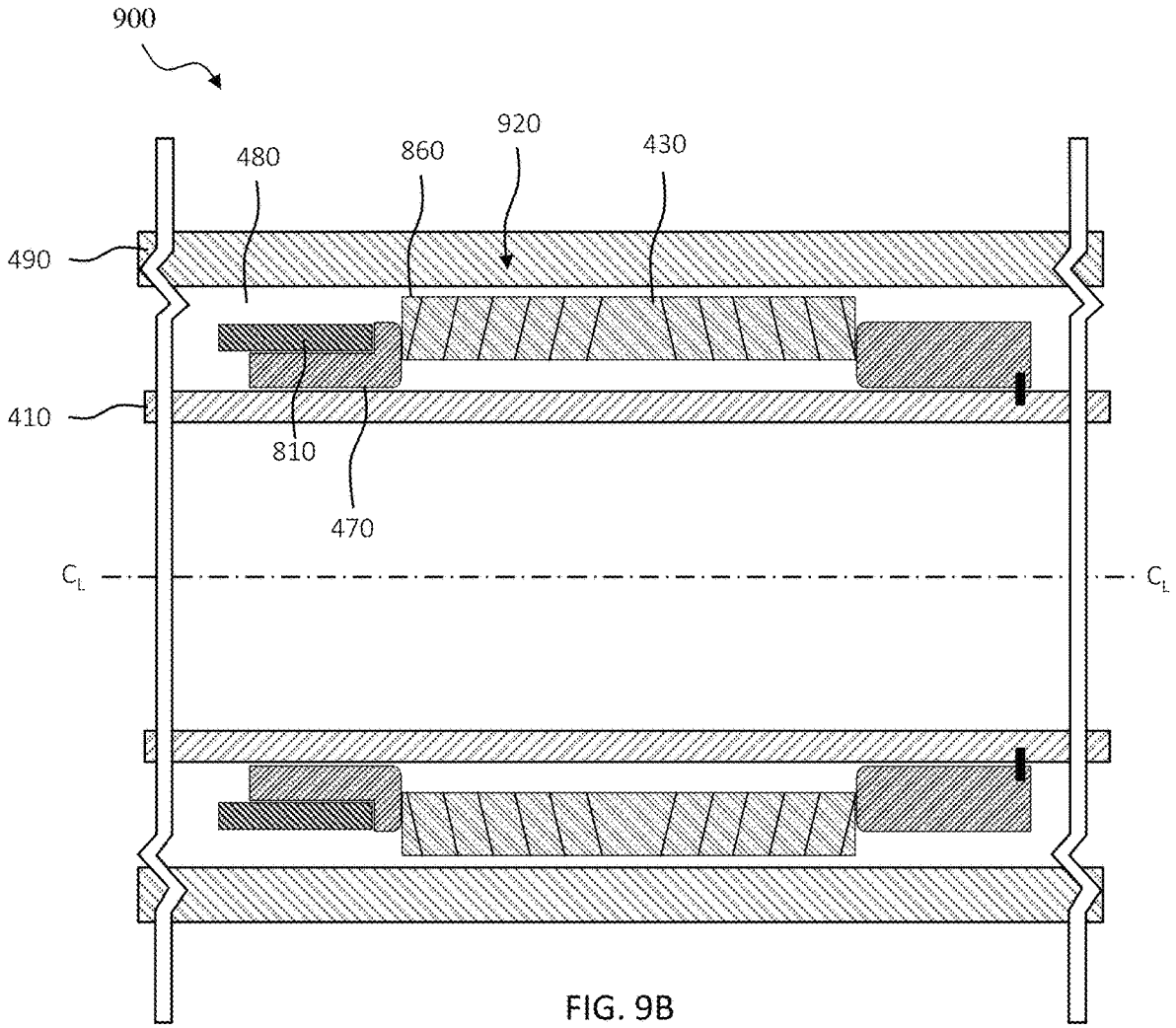
Figure 9C:
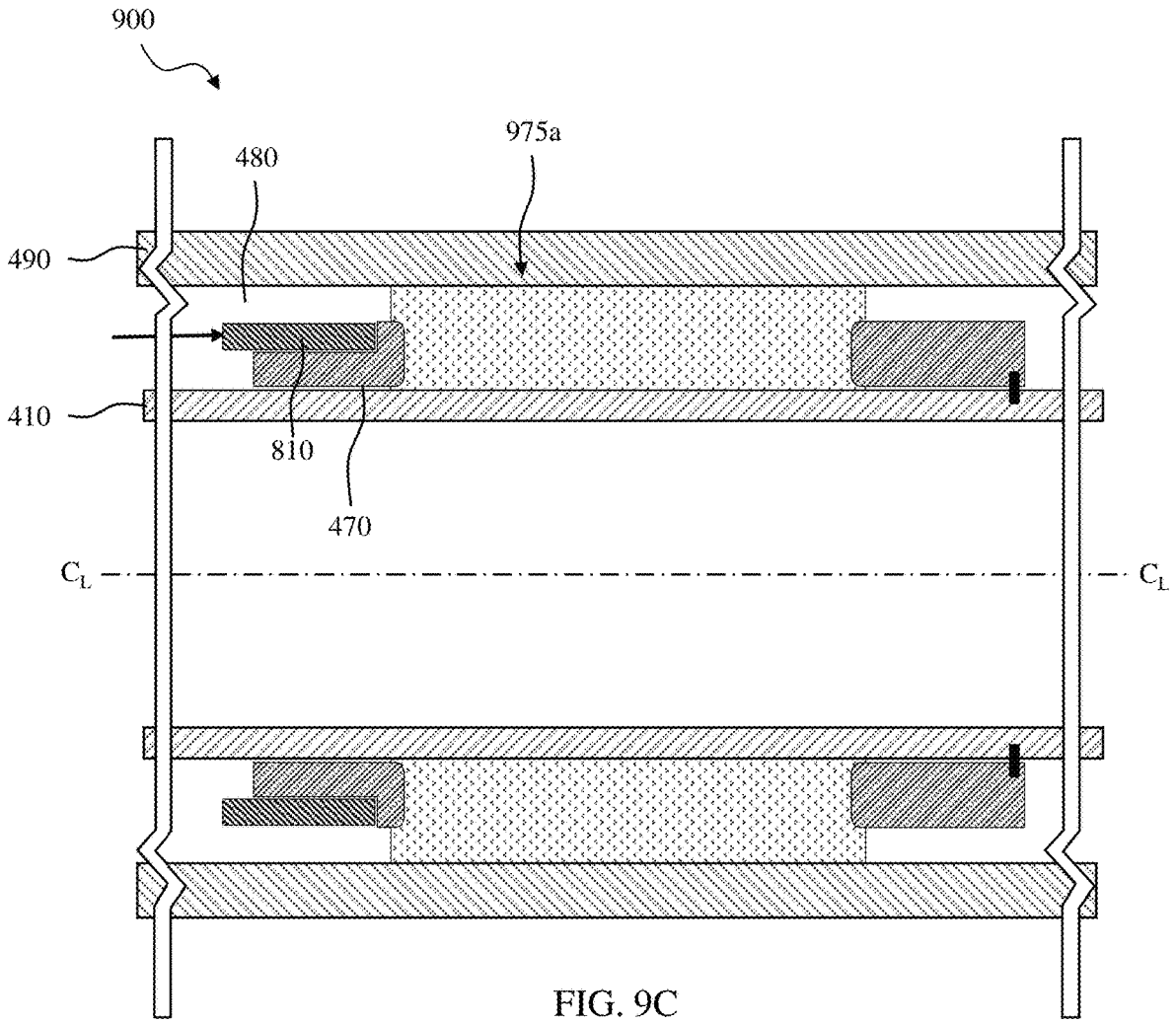
Figure 9D:
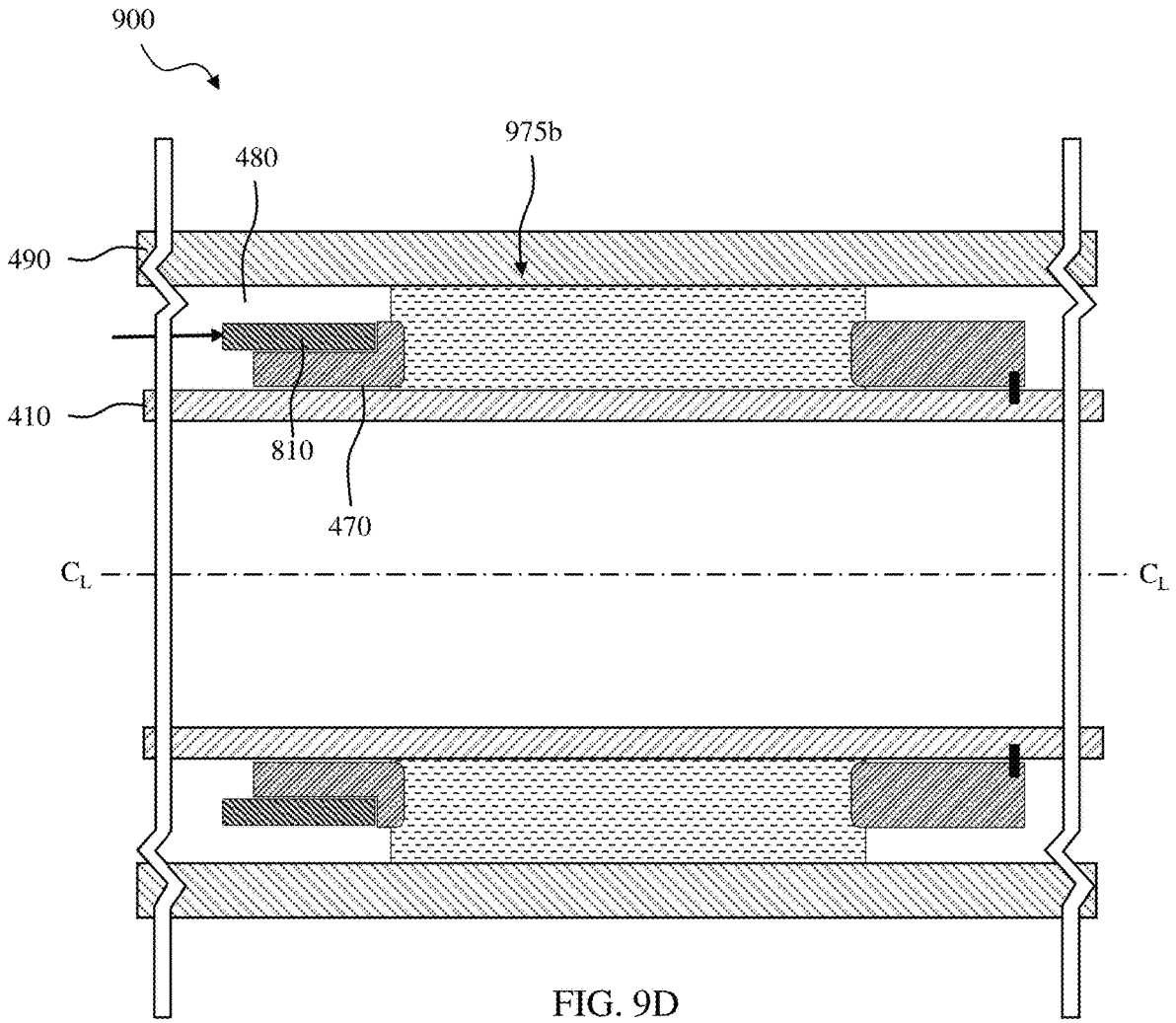

Turning to FIGS. 9A through 9D, depicted are various different deployment states for a sealing/anchoring tool 900 designed, manufactured and operated according to an alternative embodiment of the disclosure. FIG. 9A illustrates the sealing/anchoring tool 900 in a run-in-hole state, and thus its sealing/anchoring element is in the radially reduced mechanical state, and furthermore the expandable metal has not been subjected to reactive fluid to begin hydrolysis. In contrast, FIG. 9B illustrates the sealing/anchoring tool 900 with its sealing/anchoring element in the radially enlarged mechanical state, but again the expandable metal has not been subjected to reactive fluid to begin hydrolysis. In contrast, FIG. 9C illustrates the sealing/anchoring tool 900 with its radially enlarged sealing/anchoring element having been subjected to reactive fluid, and thus starting the hydrolysis reaction, thereby forming an expanded metal sealing/anchoring element (e.g., the sealing/anchoring element post-expansion). In contrast, FIG. 9D illustrates the sealing/anchoring tool 900 with its radially enlarged sealing/anchoring element having been subjected to reactive fluid, and thus starting the hydrolysis reaction, thereby forming an expanded metal sealing/anchoring element having residual unreacted expandable metal therein (e.g., the sealing/anchoring element post-expansion). As disclosed above, the expandable metal may be subjected to a suitable reactive fluid within the wellbore, thereby forming the expanded metal sealing/anchoring element.

The sealing/anchoring tool 900 is similar in certain respects to the sealing/anchoring tool 800. Accordingly, like reference numbers have been used to indicate similar, if not identical, features. The sealing/anchoring tool 900 differs, for the most part, from the sealing/anchoring tool 800, in that the sealing/anchoring tool 900 employs a sealing/anchoring element 920 with different shaped circlets 930 that substantially prevent the circlets 930 from contacting the bore 490 when they move from the radially reduced mechanical state to the radially enlarged mechanical state. What may result in one or more embodiments, after hydrolysis, is the expanded metal sealing/anchoring element 975*a*, as shown in FIG. 9C, or the expanded metal sealing/anchoring element having residual unreacted expandable metal therein 975*b*, as shown in FIG. 9D.

Figure 10A:
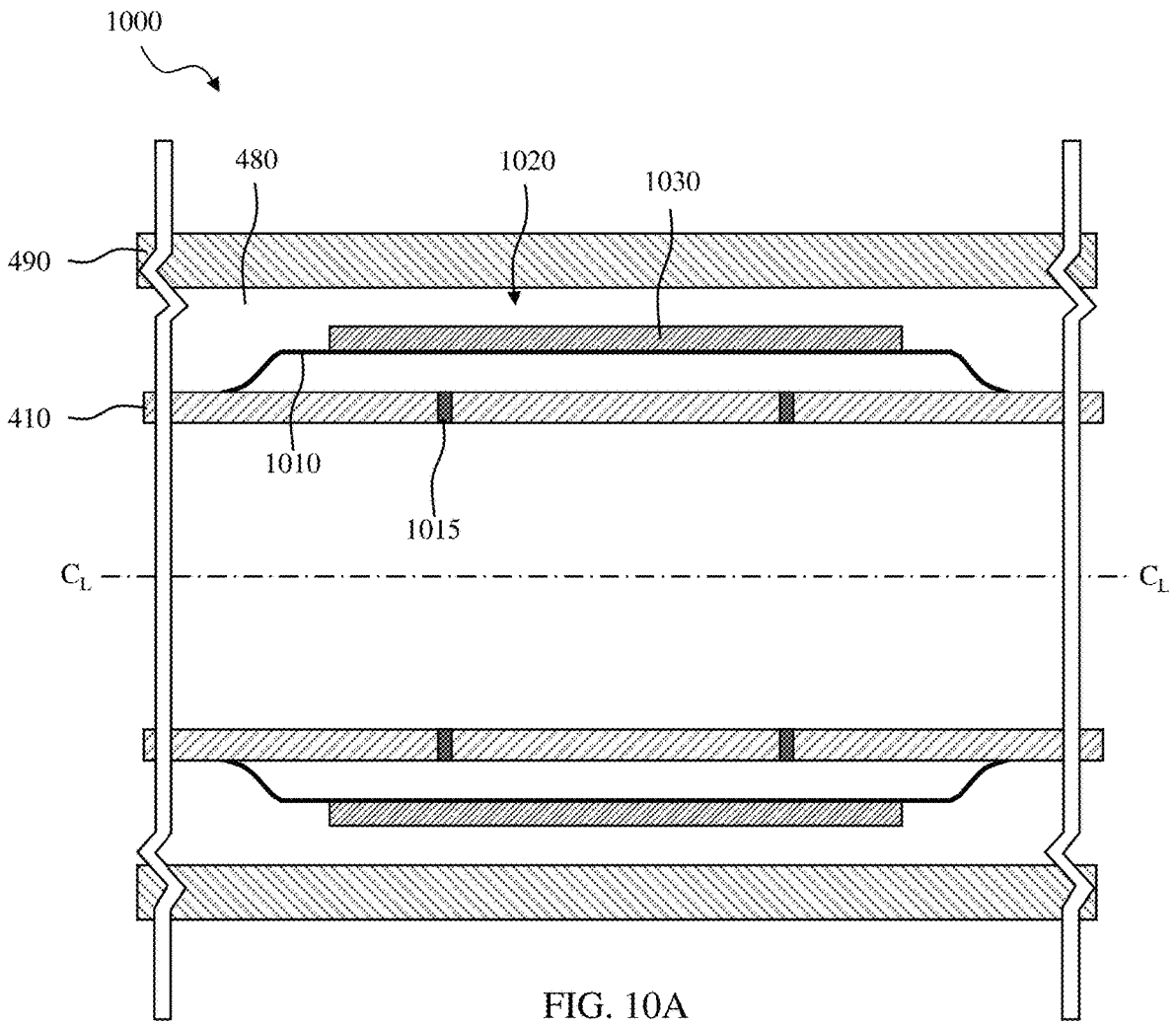
FIGS. 10A through 10D depict various different deployment states for a sealing/anchoring tool designed, manufactured and operated according to an alternative embodiment of the disclosure.
Figure 10B:
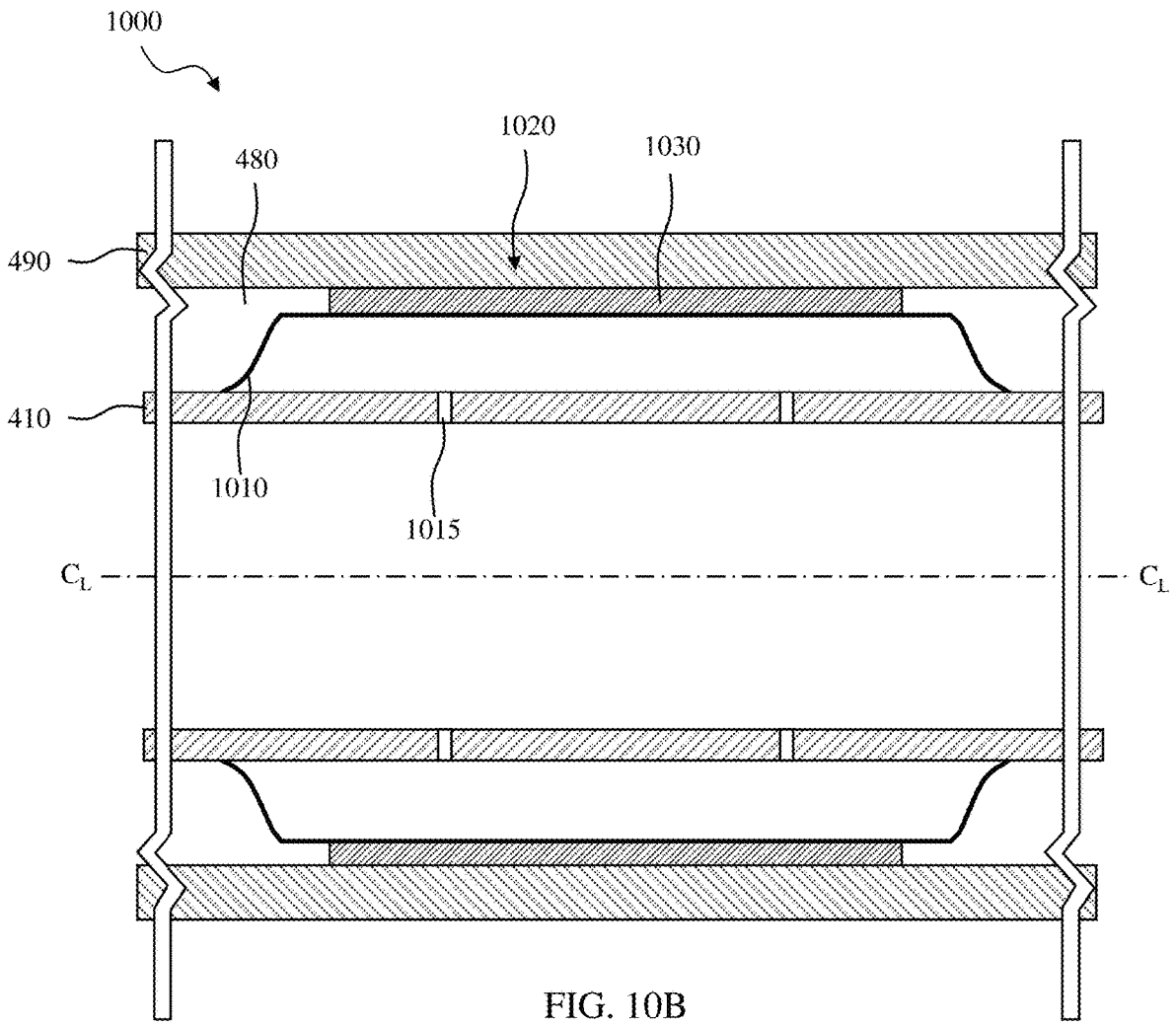
Figure 10C:
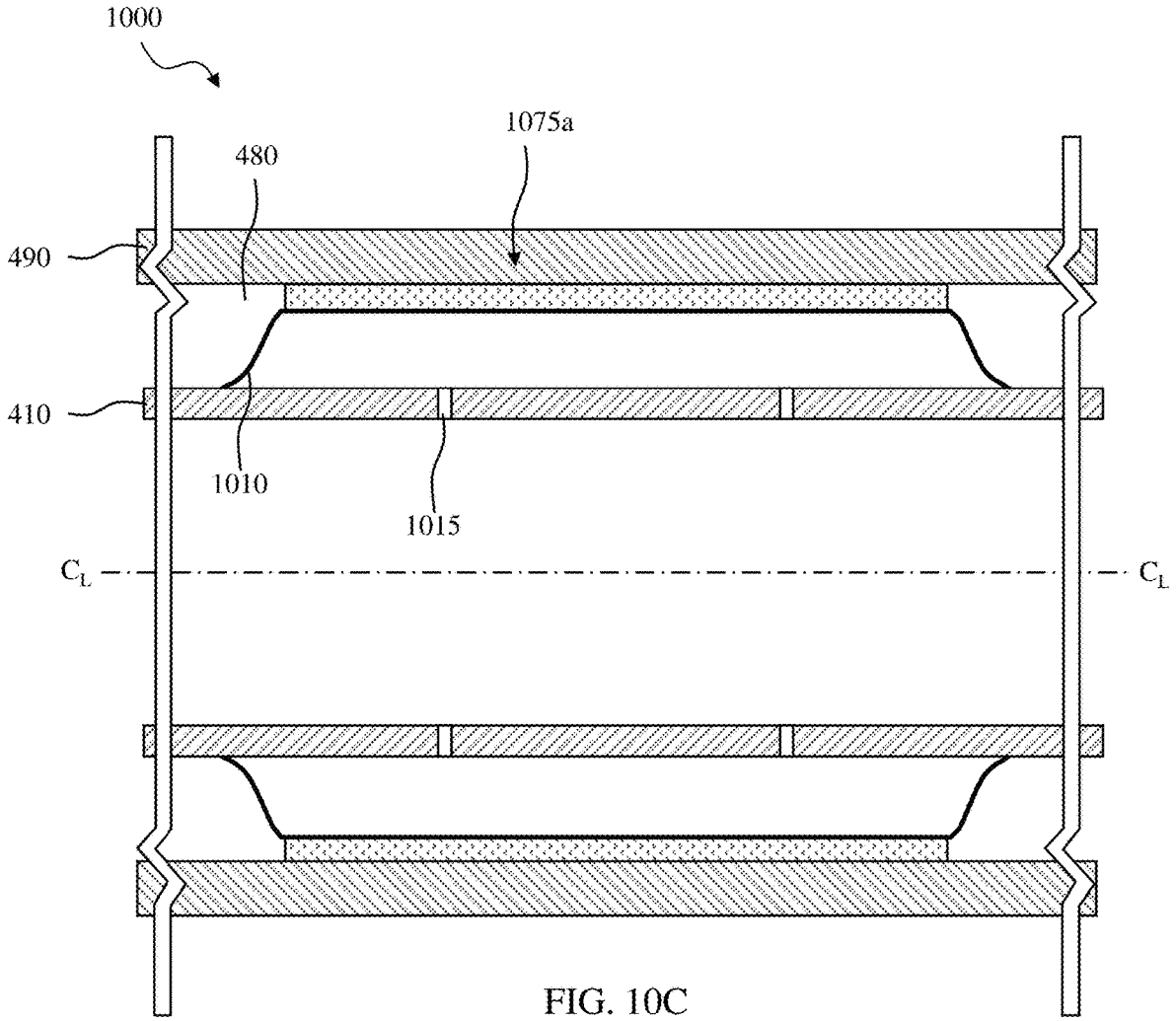
Figure 10D:
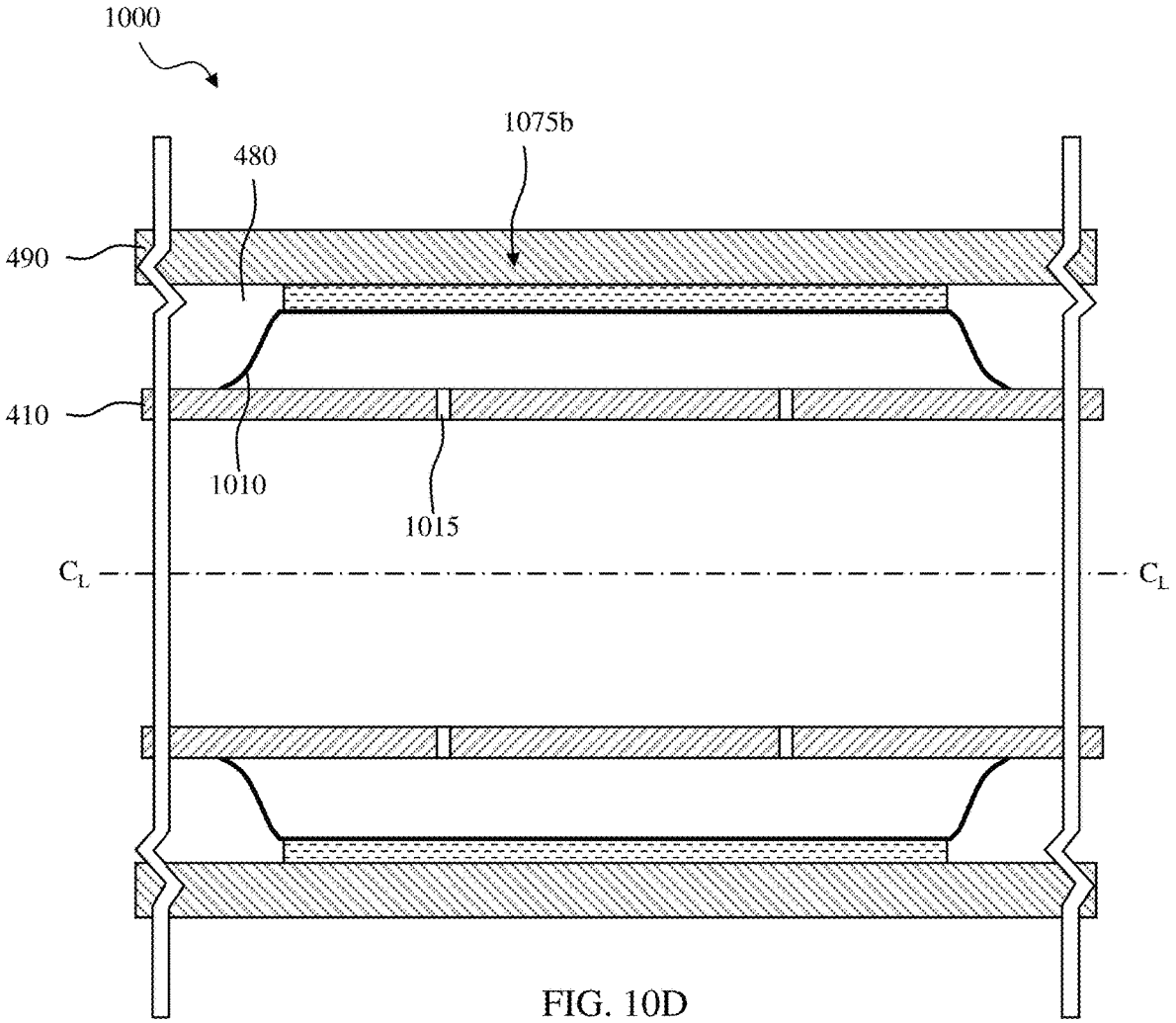

Turning to FIGS. 10A through 10D, depicted are various different deployment states for a sealing/anchoring tool 1000 designed, manufactured and operated according to an alternative embodiment of the disclosure. FIG. 10A illustrates the sealing/anchoring tool 1000 in a run-in-hole state, and thus its sealing/anchoring element is in the radially reduced mechanical state, and furthermore the expandable metal has not been subjected to reactive fluid to begin hydrolysis. In contrast, FIG. 10B illustrates the sealing/anchoring tool 1000 with its sealing/anchoring element in the radially enlarged mechanical state, but again the expandable metal has not been subjected to reactive fluid to begin hydrolysis. In contrast, FIG. 10C illustrates the sealing/anchoring tool 1000 with its radially enlarged sealing/anchoring element having been subjected to reactive fluid, and thus starting the hydrolysis reaction, thereby forming an expanded metal sealing/anchoring element (e.g., the sealing/anchoring element post-expansion). In contrast, FIG. 10D illustrates the sealing/anchoring tool 1000 with its radially enlarged sealing/anchoring element having been subjected to reactive fluid, and thus starting the hydrolysis reaction, thereby forming an expanded metal sealing/anchoring element having residual unreacted expandable metal therein (e.g., the sealing/anchoring element post-expansion). As disclosed above, the expandable metal may be subjected to a suitable reactive fluid within the wellbore, thereby forming the expanded metal sealing/anchoring element.

The sealing/anchoring tool 1000 is similar in certain respects to the sealing/anchoring tool 800. Accordingly, like reference numbers have been used to indicate similar, if not identical, features. The sealing/anchoring tool 1000 differs, for the most part, from the sealing/anchoring tool 800, in that the sealing/anchoring tool 1000 does not employ a wedge 860, but employs a hydraulically deformable member 1010 to radially deploy its sealing/anchoring element 1020 with its one or more circlets 1030 (e.g., comprising a metal configured to expand in response to hydrolysis). In the illustrated embodiment, the hydraulically deformable member 1010 is a bladder. Nevertheless, other hydraulically deformable member may be used and remain within the scope of the disclosure. Furthermore, in one or more embodiments the mandrel 410 includes one or more plugs and/or openings 1015 for supplying fluid to deploy the hydraulically deformable member 1010 from its radially reduced mechanical state (FIG. 10A) to its radially expanded mechanical state (FIG. 10B). What may result in one or more embodiments, after hydrolysis, is the expanded metal sealing/anchoring element 1075*a*, as shown in FIG. 10C, or the expanded metal sealing/anchoring element having residual unreacted expandable metal therein 1075*b*, as shown in FIG. 10D.

Figure 11A:
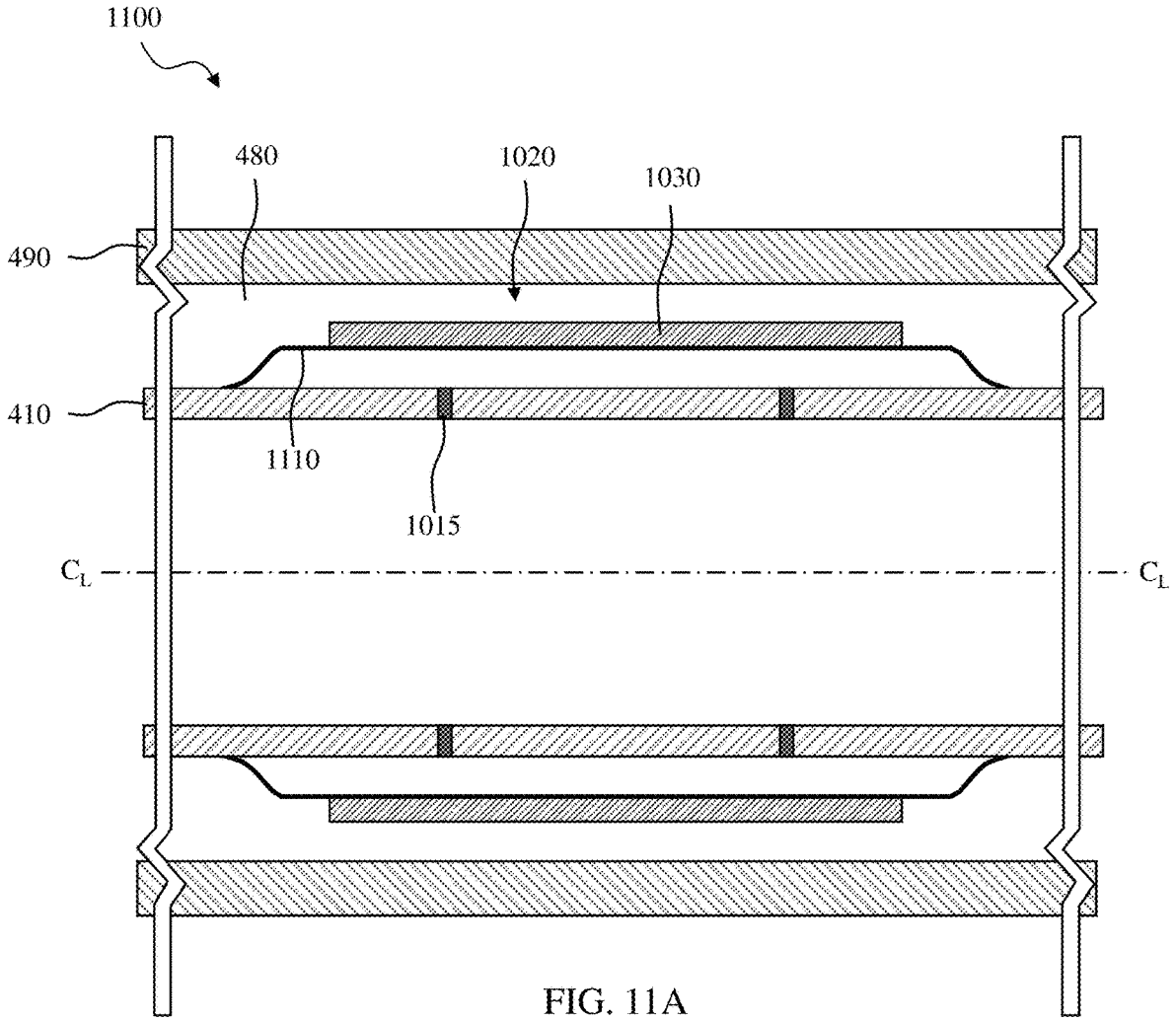
FIGS. 11A through 11D depict various different deployment states for a sealing/anchoring tool designed, manufactured and operated according to an alternative embodiment of the disclosure.
Figure 11B:
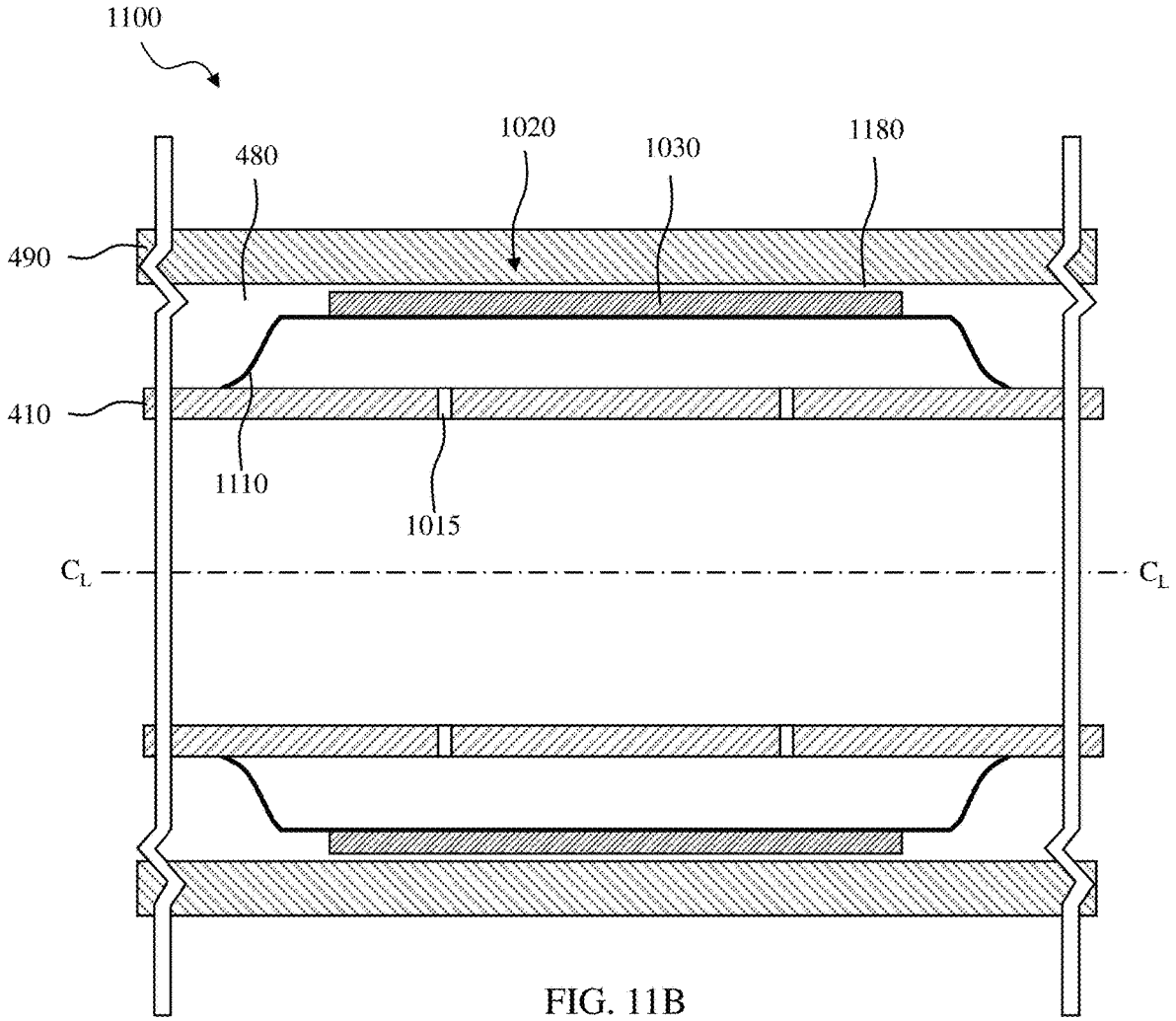
Figure 11C:
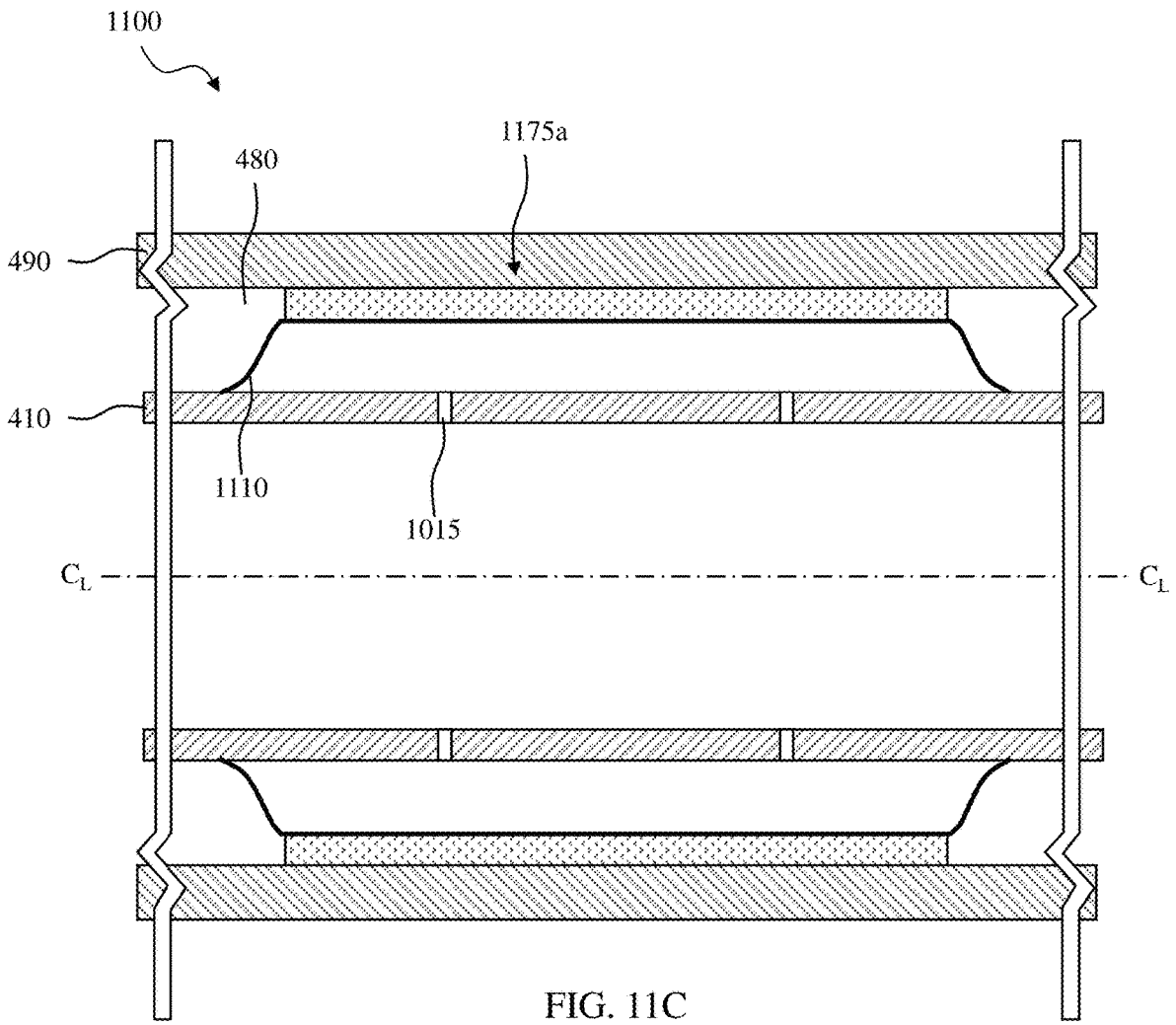
Figure 11D:
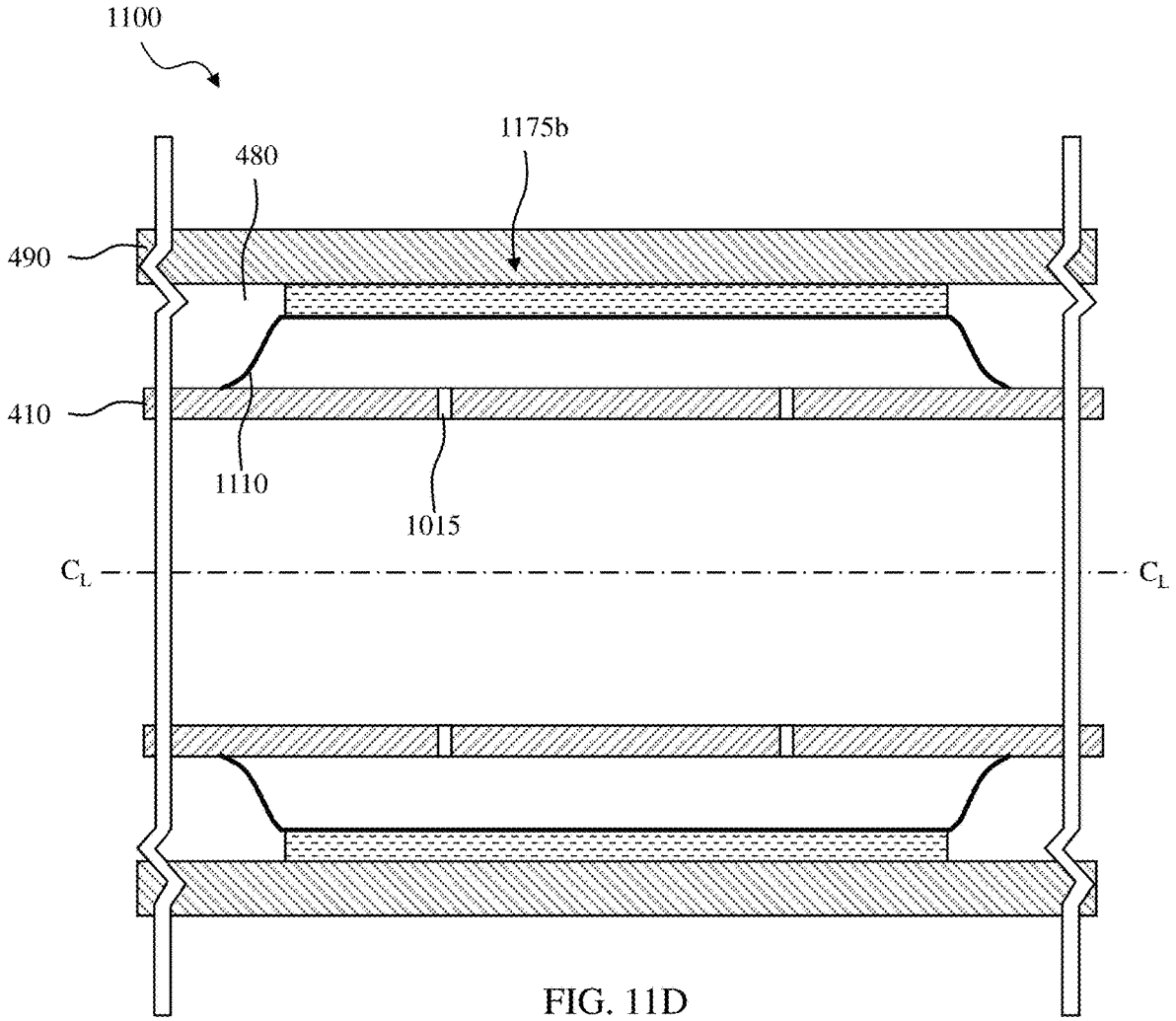

Turning to FIGS. 11A through 11D, depicted are various different deployment states for a sealing/anchoring tool 1100 designed, manufactured and operated according to an alternative embodiment of the disclosure. FIG. 11A illustrates the sealing/anchoring tool 1100 in a run-in-hole state, and thus its sealing/anchoring element is in the radially reduced mechanical state, and furthermore the expandable metal has not been subjected to reactive fluid to begin hydrolysis. In contrast, FIG. 11B illustrates the sealing/anchoring tool 1100 with its sealing/anchoring element in the radially enlarged mechanical state, but again the expandable metal has not been subjected to reactive fluid to begin hydrolysis. In contrast, FIG. 11C illustrates the sealing/anchoring tool 1100 with its radially enlarged sealing/anchoring element having been subjected to reactive fluid, and thus starting the hydrolysis reaction, thereby forming an expanded metal sealing/anchoring element (e.g., the sealing/anchoring element post-expansion). In contrast, FIG. 11D illustrates the sealing/anchoring tool 1100 with its radially enlarged sealing/anchoring element having been subjected to reactive fluid, and thus starting the hydrolysis reaction, thereby forming an expanded metal sealing/anchoring element having residual unreacted expandable metal therein (e.g., the sealing/anchoring element post-expansion). As disclosed above, the expandable metal may be subjected to a suitable reactive fluid within the wellbore, thereby forming the expanded metal sealing/anchoring element.

The sealing/anchoring tool 1100 is similar in certain respects to the sealing/anchoring tool 1000. Accordingly, like reference numbers have been used to indicate similar, if not identical, features. The sealing/anchoring tool 1100 differs, for the most part, from the sealing/anchoring tool 1000, in that the sealing/anchoring tool 1100 employs a hydraulically deformable member 1110 with limited expansion. The limited expansion hydraulically deformable member 1110 of FIGS. 11A through 11D, in at least one embodiment, substantially prevent the circlet 1030 from contacting the bore 490 when the hydraulically deformable member 1110 moves from the radially reduced mechanical state to the radially enlarged mechanical state. For example, in at least one embodiment, a move from the radially reduced mechanical state to the radially expanded mechanical state leaves a gap 1180 of at least 5% of the annulus 480, and thus the remaining 5% must be closed with chemical expansion. In yet another embodiment, a move from the radially reduced mechanical state to the radially expanded mechanical state leaves a gap 1180 of at least 10% of the annulus 480, and thus the remaining 10% must be closed with chemical expansion. In yet another embodiment, a move from the radially reduced mechanical state to the radially expanded mechanical state leaves a gap 1180 of at least 20% of the annulus 480, and thus the remaining 20% must be closed with chemical expansion. In yet another embodiment, a move from the radially reduced mechanical state to the radially expanded mechanical state leaves a gap 1180 of at least 30% of the annulus 480, and thus the remaining 30% must be closed with chemical expansion. In yet another embodiment, a move from the radially reduced mechanical state to the radially expanded mechanical state leaves a gap 1180 ranging from 15% to 25% of the annulus 480, and thus the remaining 15% to 25% must be closed with chemical expansion. What may result in one or more embodiments, after hydrolysis, is the expanded metal sealing/anchoring element 1175*a*, as shown in FIG. 11C, or the expanded metal sealing/anchoring element having residual unreacted expandable metal therein 1175*b*, as shown in FIG. 11D.

Figure 12A:
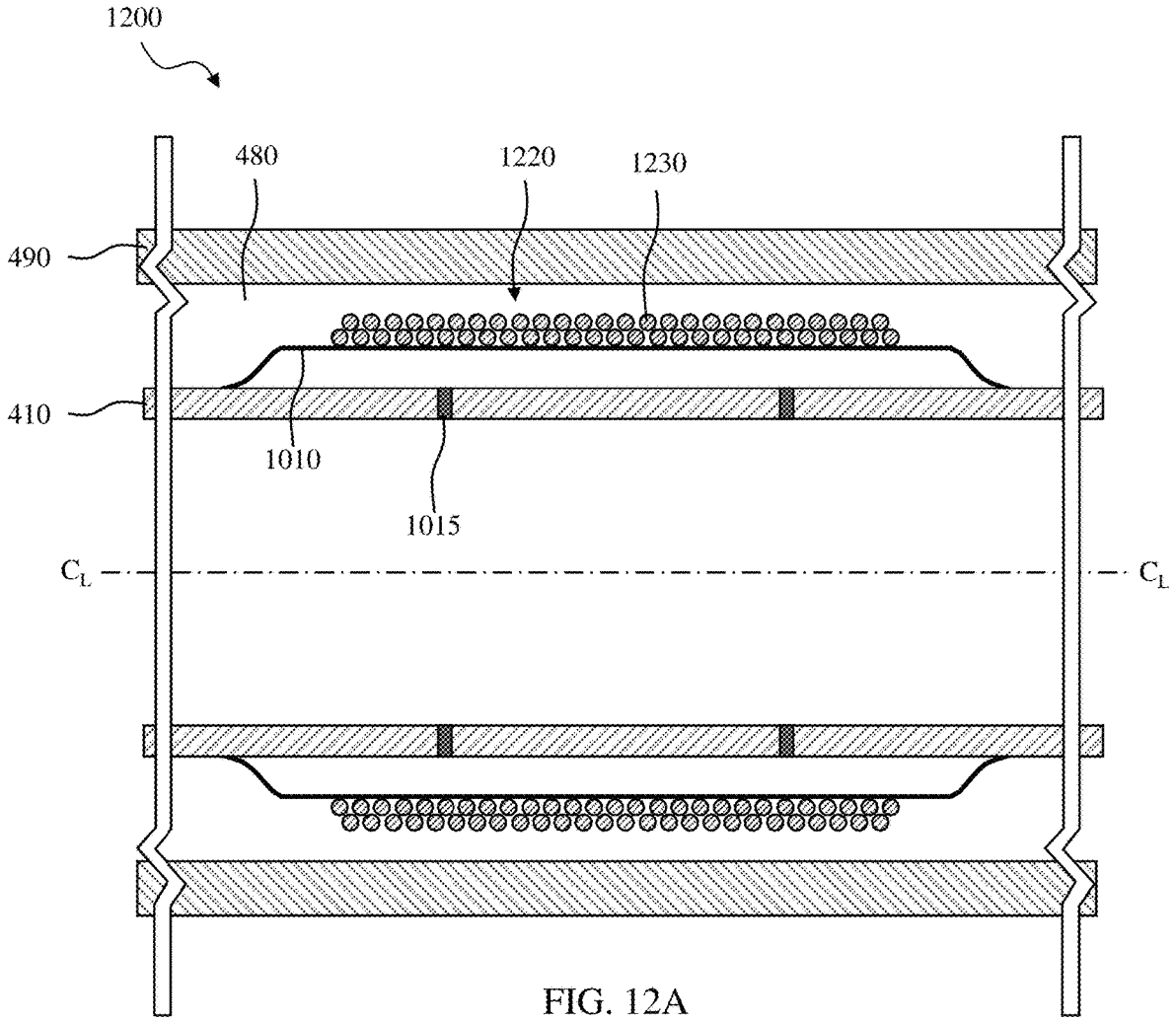
FIGS. 12A through 12D depict various different deployment states for a sealing/anchoring tool designed, manufactured and operated according to an alternative embodiment of the disclosure.
Figure 12B:
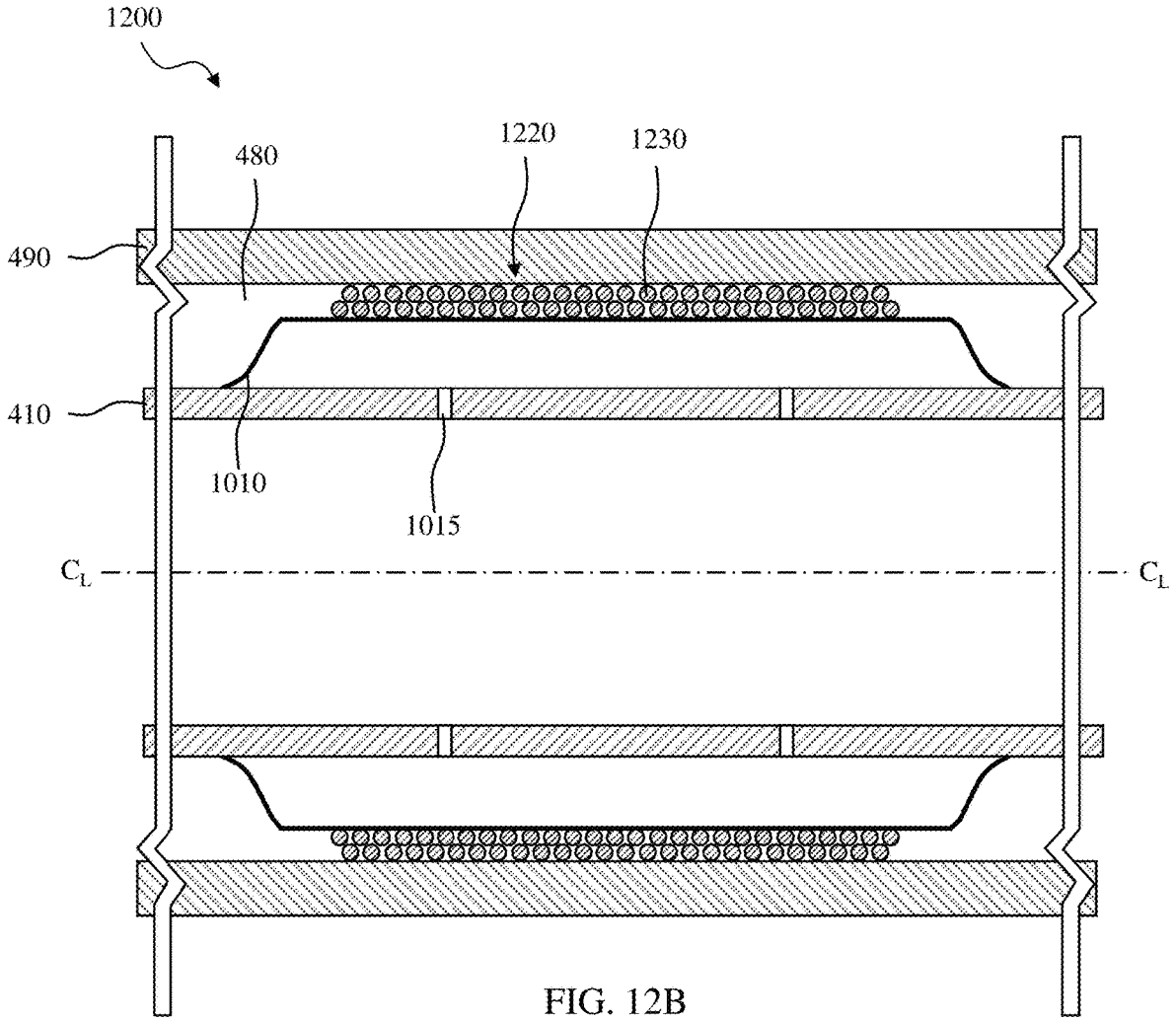
Figure 12C:
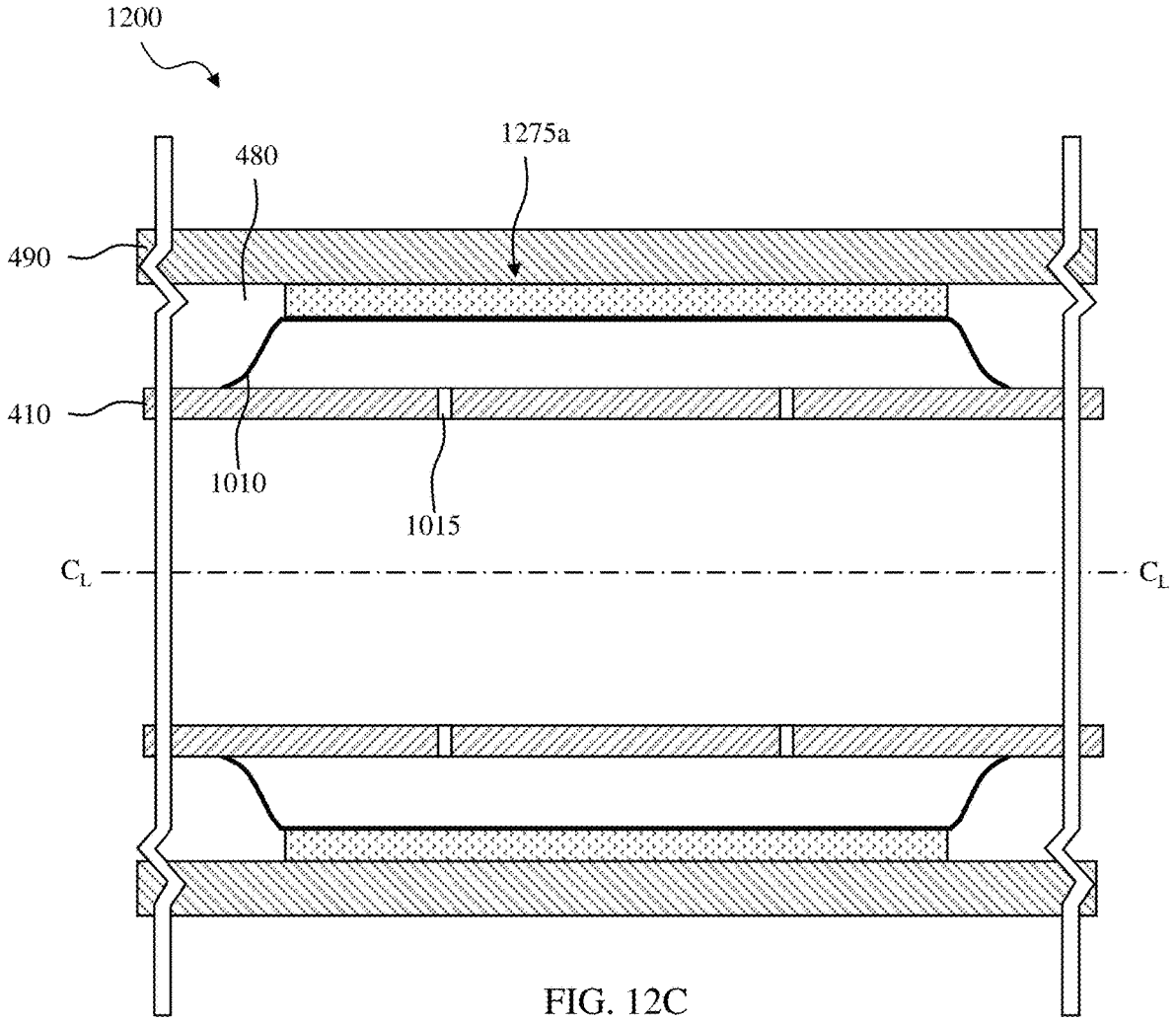
Figure 12D:
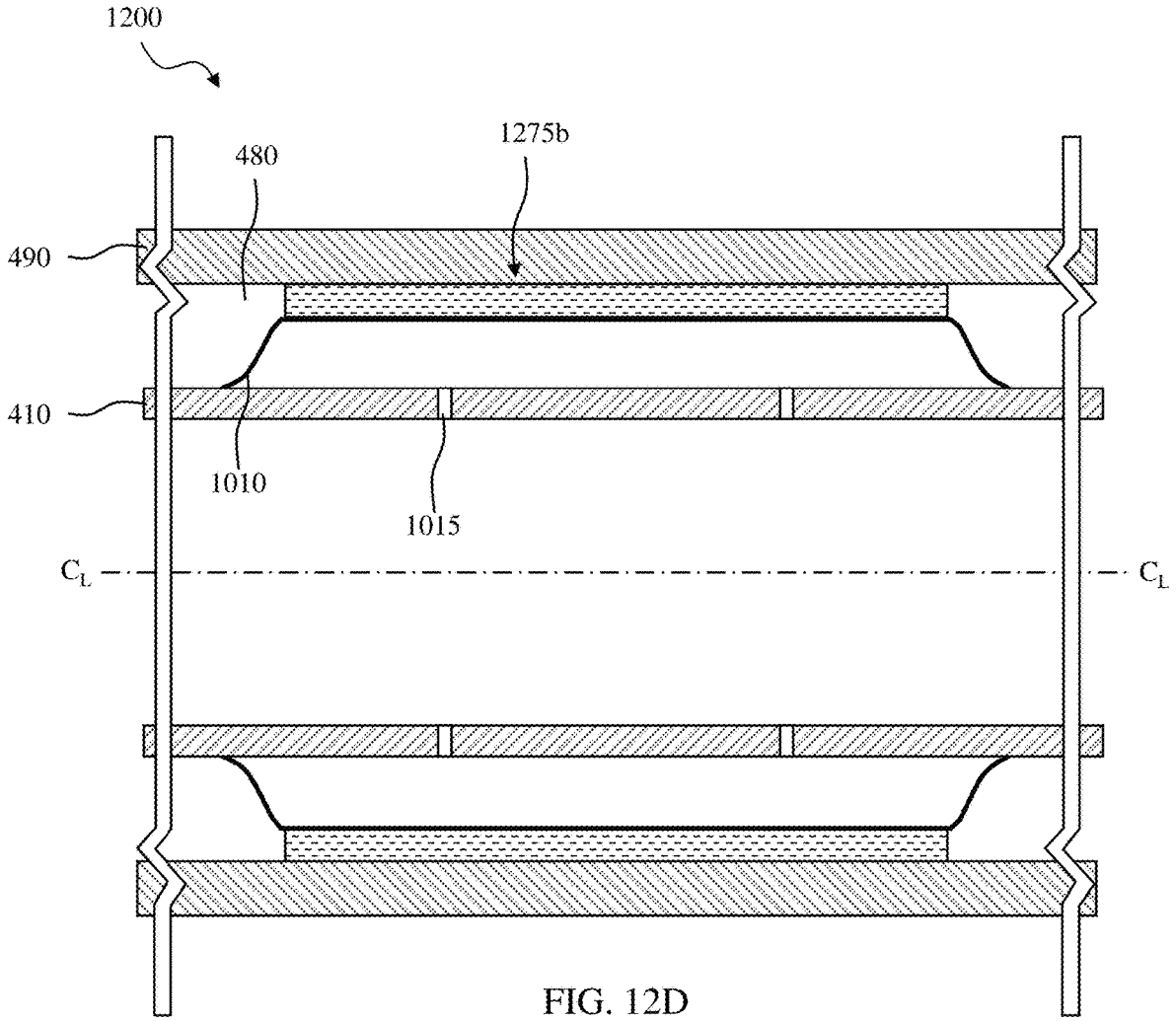

Turning to FIGS. 12A through 12D, depicted are various different deployment states for a sealing/anchoring tool 1200 designed, manufactured and operated according to an alternative embodiment of the disclosure. FIG. 12A illustrates the sealing/anchoring tool 1200 in a run-in-hole state, and thus its sealing/anchoring element is in the radially reduced mechanical state, and furthermore the expandable metal has not been subjected to reactive fluid to begin hydrolysis. In contrast, FIG. 12B illustrates the sealing/anchoring tool 1200 with its sealing/anchoring element in the radially enlarged mechanical state, but again the expandable metal has not been subjected to reactive fluid to begin hydrolysis. In contrast, FIG. 12C illustrates the sealing/anchoring tool 1200 with its radially enlarged sealing/anchoring element having been subjected to reactive fluid, and thus starting the hydrolysis reaction, thereby forming an expanded metal sealing/anchoring element (e.g., the sealing/anchoring element post-expansion). In contrast, FIG. 12D illustrates the sealing/anchoring tool 1200 with its radially enlarged sealing/anchoring element having been subjected to reactive fluid, and thus starting the hydrolysis reaction, thereby forming an expanded metal sealing/anchoring element having residual unreacted expandable metal therein (e.g., the sealing/anchoring element post-expansion). As disclosed above, the expandable metal may be subjected to a suitable reactive fluid within the wellbore, thereby forming the expanded metal sealing/anchoring element.

The sealing/anchoring tool 1200 is similar in certain respects to the sealing/anchoring tool 1000. Accordingly, like reference numbers have been used to indicate similar, if not identical, features. The sealing/anchoring tool 1200 differs, for the most part, from the sealing/anchoring tool 1000, in that the sealing/anchoring tool 1200 employs a sealing/anchoring element 1220 including a circlet 1230 that comprises a wire of expandable metal, for example as discussed above. In the illustrated embodiment, the wire of expandable metal wraps around the hydraulically deformable member 1010, and provides the geometric features necessary to allow it to mechanically deform when the hydraulically deformable member is moved from a radially reduced mechanical state to a radially enlarged mechanical state. While a single wire of expandable metal may be used, in certain other embodiments a plurality of different wires of expandable metal may be used. In certain embodiments, the wire of expandable metal has a higher surface-area-to-volume ratio (SA:V) than many of the embodiments discussed above, and thus might react faster to the reactive fluid than certain of the other embodiments. What may result in one or more embodiments, after hydrolysis, is the expanded metal sealing/anchoring element 1275*a*, as shown in FIG. 12C, or the expanded metal sealing/anchoring element having residual unreacted expandable metal therein 1275*b*, as shown in FIG. 12D.

Figure 13A:
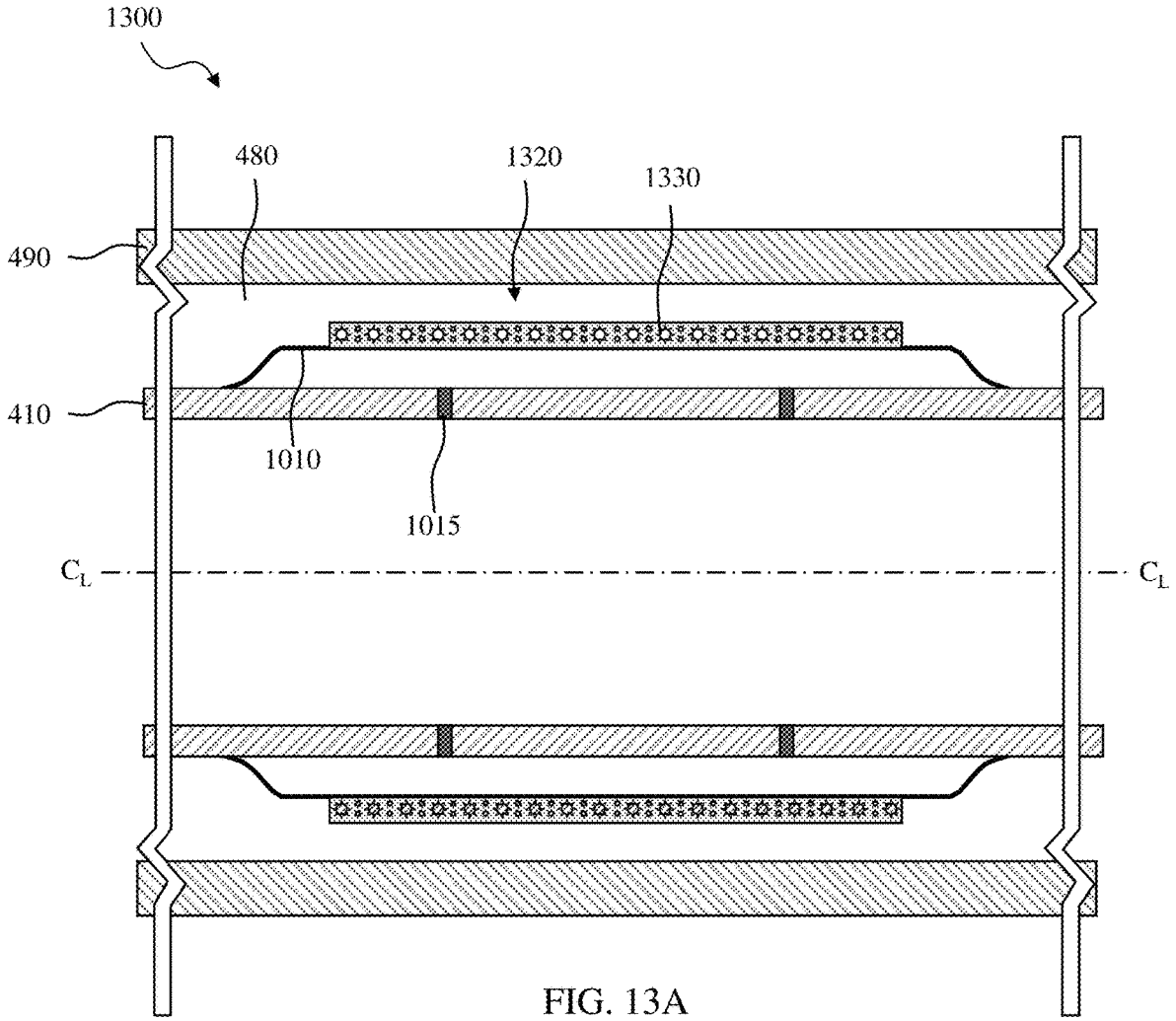
FIGS. 13A through 13D depict various different deployment states for a sealing/anchoring tool designed, manufactured and operated according to an alternative embodiment of the disclosure.
Figure 13B:
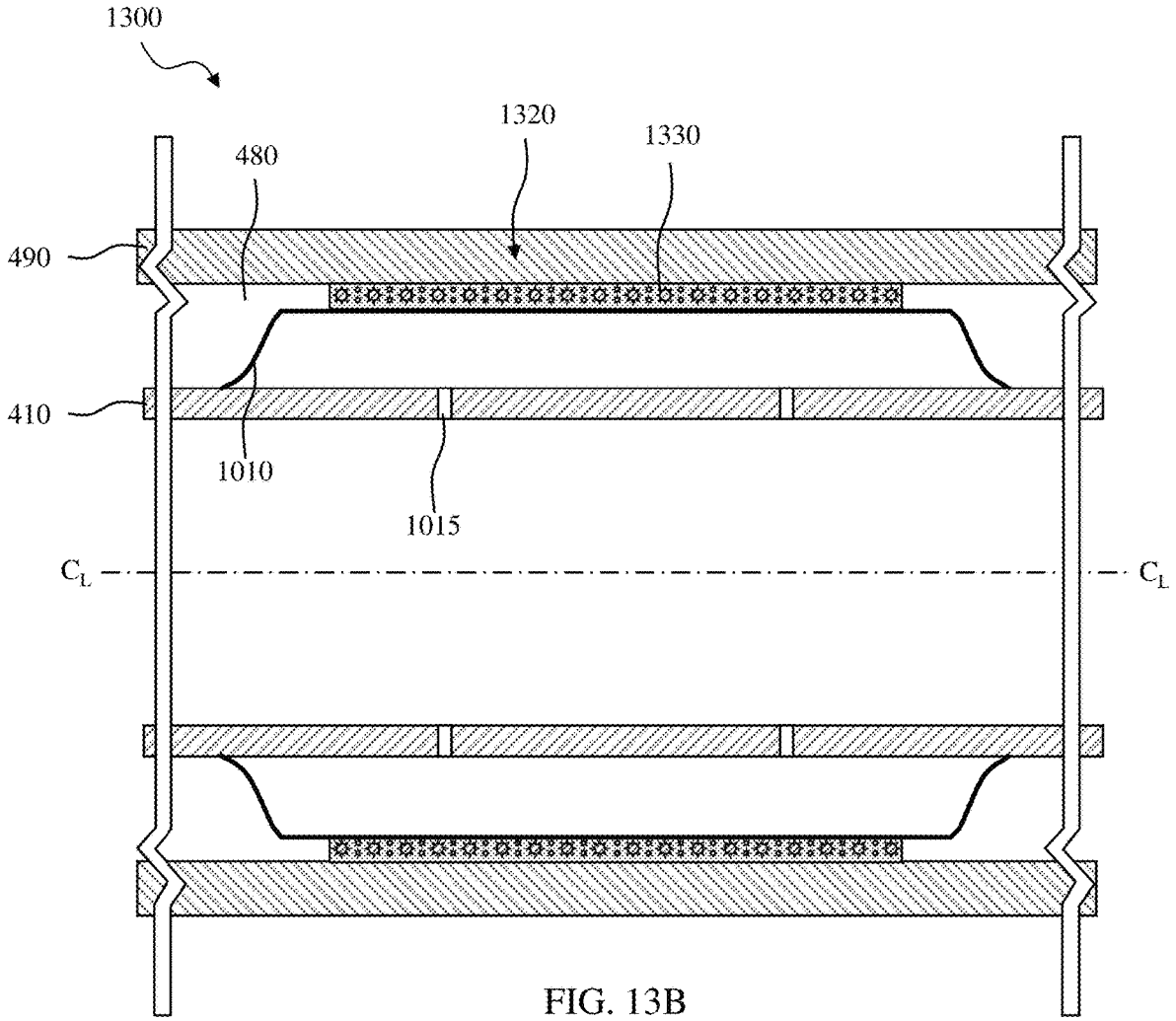
Figure 13C:
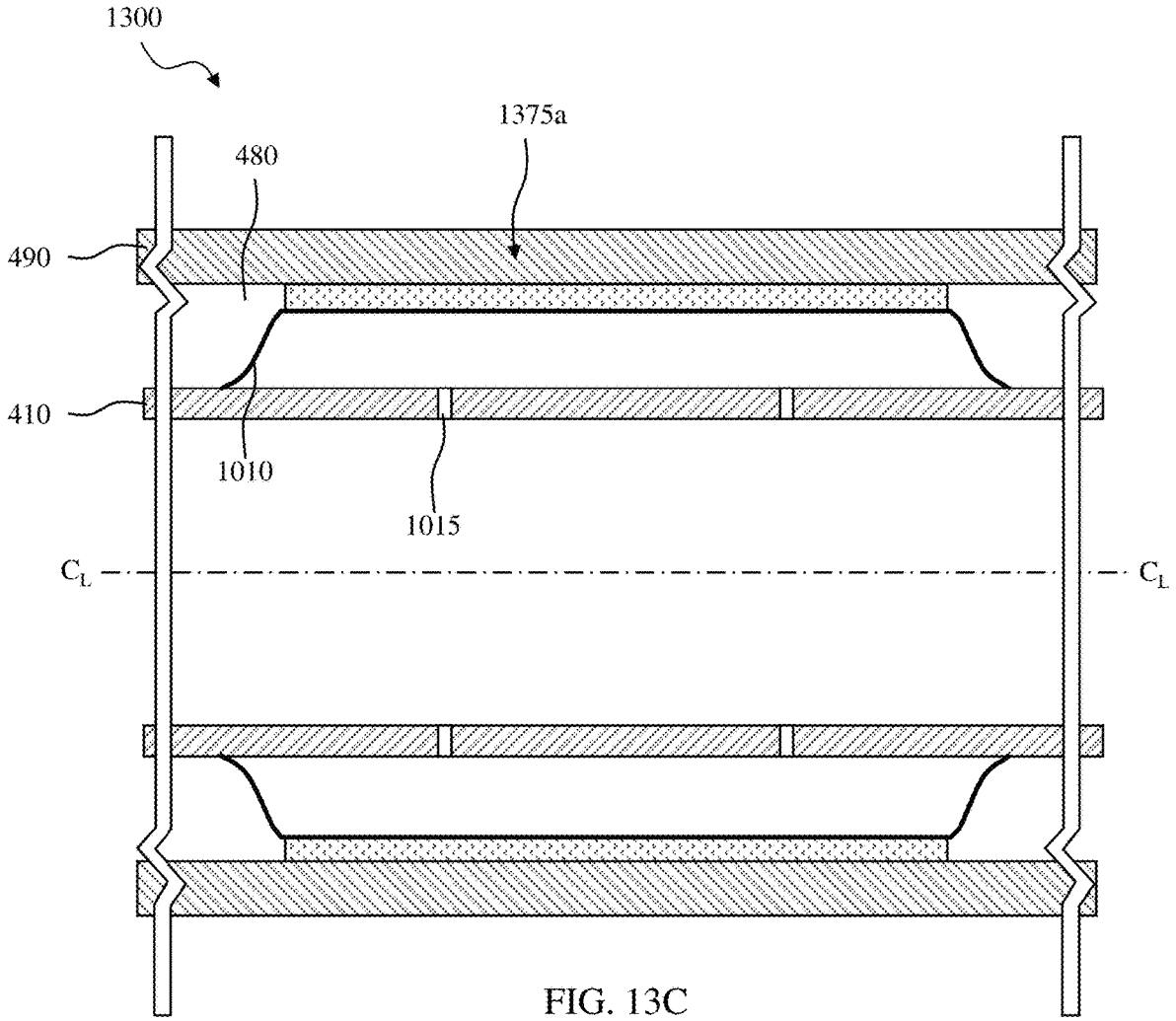
Figure 13D:
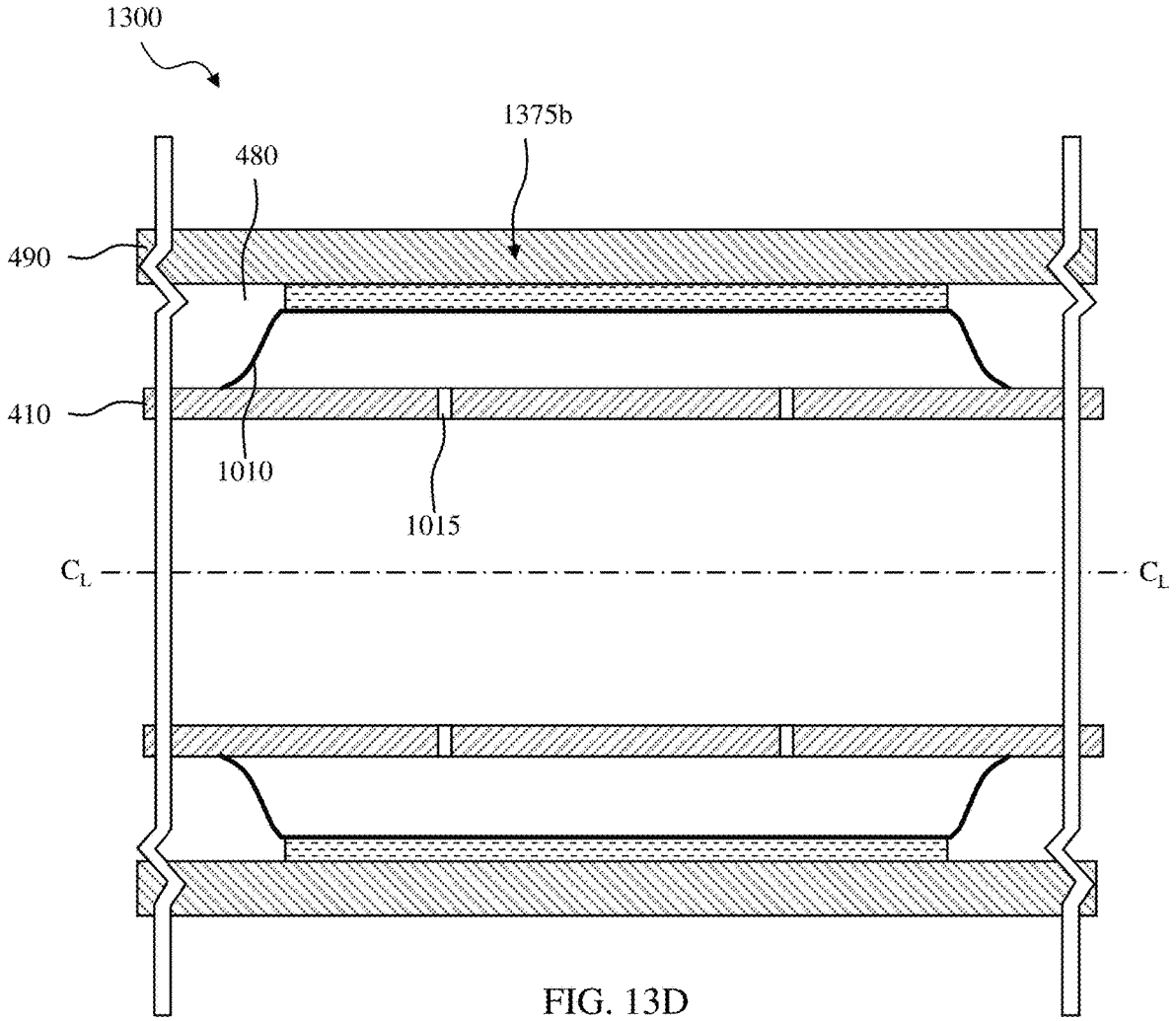

Turning to FIGS. 13A through 13D, depicted are various different deployment states for a sealing/anchoring tool 1300 designed, manufactured and operated according to an alternative embodiment of the disclosure. FIG. 13A illustrates the sealing/anchoring tool 1300 in a run-in-hole state, and thus its sealing/anchoring element is in the radially reduced mechanical state, and furthermore the expandable metal has not been subjected to reactive fluid to begin hydrolysis. In contrast, FIG. 13B illustrates the sealing/anchoring tool 1300 with its sealing/anchoring element in the radially enlarged mechanical state, but again the expandable metal has not been subjected to reactive fluid to begin hydrolysis. In contrast, FIG. 13C illustrates the sealing/anchoring tool 1300 with its radially enlarged sealing/anchoring element having been subjected to reactive fluid, and thus starting the hydrolysis reaction, thereby forming an expanded metal sealing/anchoring element (e.g., the sealing/anchoring element post-expansion). In contrast, FIG. 13D illustrates the sealing/anchoring tool 1300 with its radially enlarged sealing/anchoring element having been subjected to reactive fluid, and thus starting the hydrolysis reaction, thereby forming an expanded metal sealing/anchoring element having residual unreacted expandable metal therein (e.g., the sealing/anchoring element post-expansion). As disclosed above, the expandable metal may be subjected to a suitable reactive fluid within the wellbore, thereby forming the expanded metal sealing/anchoring element.

The sealing/anchoring tool 1300 is similar in certain respects to the sealing/anchoring tool 1000. Accordingly, like reference numbers have been used to indicate similar, if not identical, features. The sealing/anchoring tool 1300 differs, for the most part, from the sealing/anchoring tool 1000, in that the sealing/anchoring tool 1300 employs a sealing/anchoring element 1320 including a circlet 1330 that comprises a collection of individual separate chunks of the expandable metal held together with a binding agent. What may result in one or more embodiments, after hydrolysis, is the expanded metal sealing/anchoring element 1375*a*, as shown in FIG. 13C, or the expanded metal sealing/anchoring element having residual unreacted expandable metal therein 1375*b*, as shown in FIG. 13D.

Figure 14A:
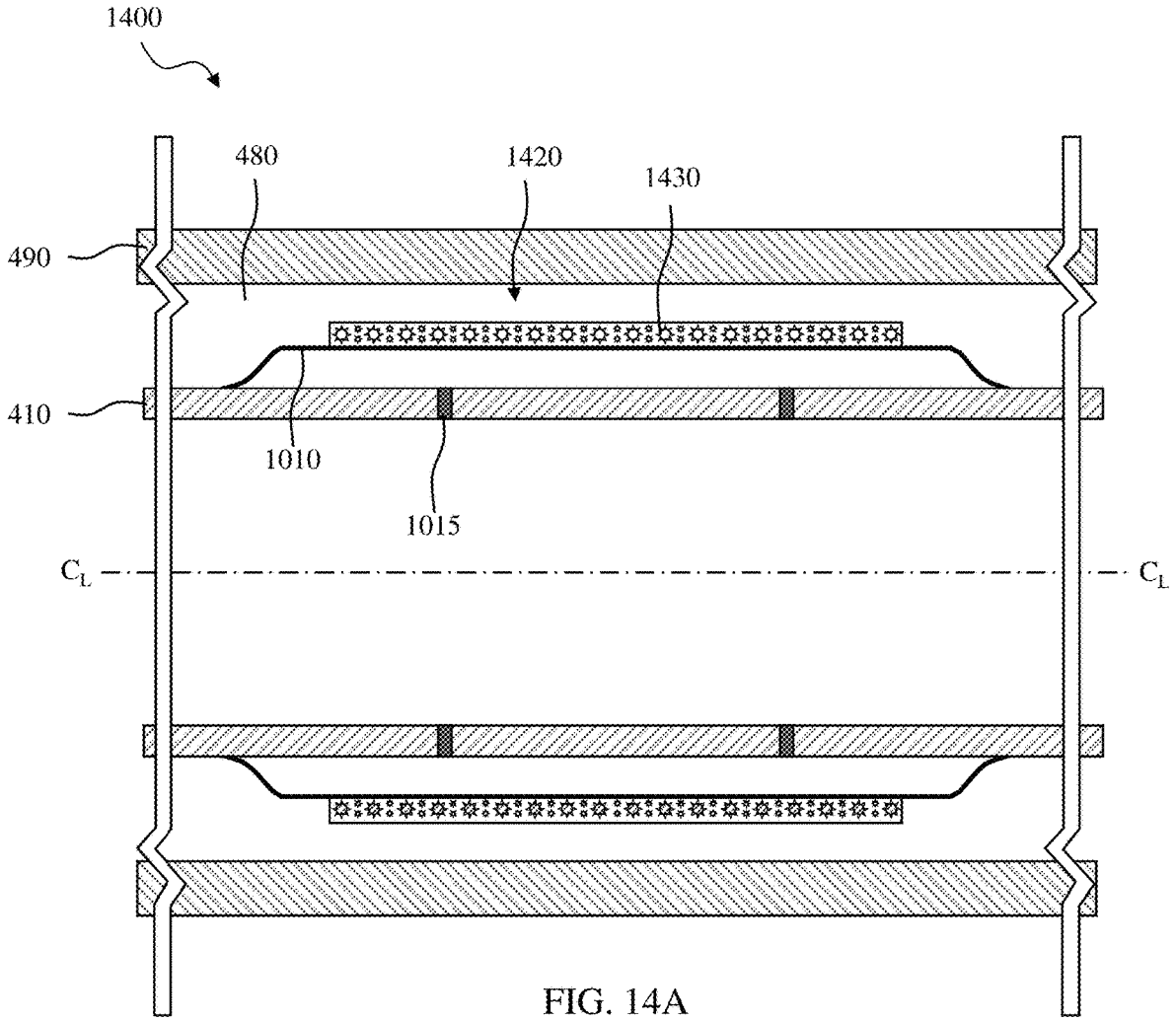
FIGS. 14A through 14D depict various different deployment states for a sealing/anchoring tool designed, manufactured and operated according to an alternative embodiment of the disclosure.
Figure 14B:
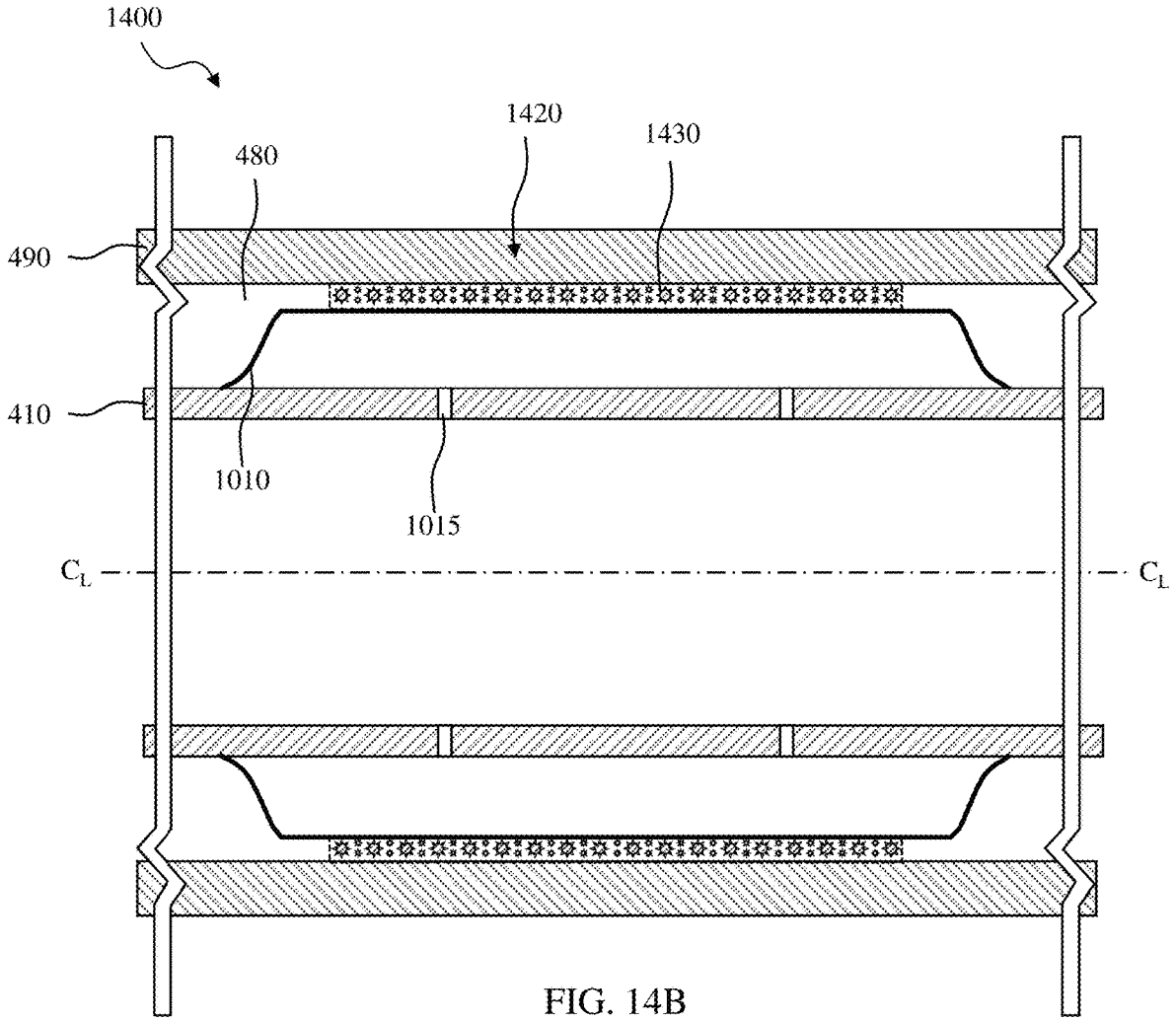

Turning to FIGS. 14A through 14D, depicted are various different deployment states for a sealing/anchoring tool 1400 designed, manufactured and operated according to an alternative embodiment of the disclosure. FIG. 14A illustrates the sealing/anchoring tool 1400 in a run-in-hole state, and thus its sealing/anchoring element is in the radially reduced mechanical state, and furthermore the expandable metal has not been subjected to reactive fluid to begin hydrolysis. In contrast, FIG. 14B illustrates the sealing/anchoring tool 1400 with its sealing/anchoring element in the radially enlarged mechanical state, but again the expandable metal has not been subjected to reactive fluid to begin hydrolysis.

Figure 14C:
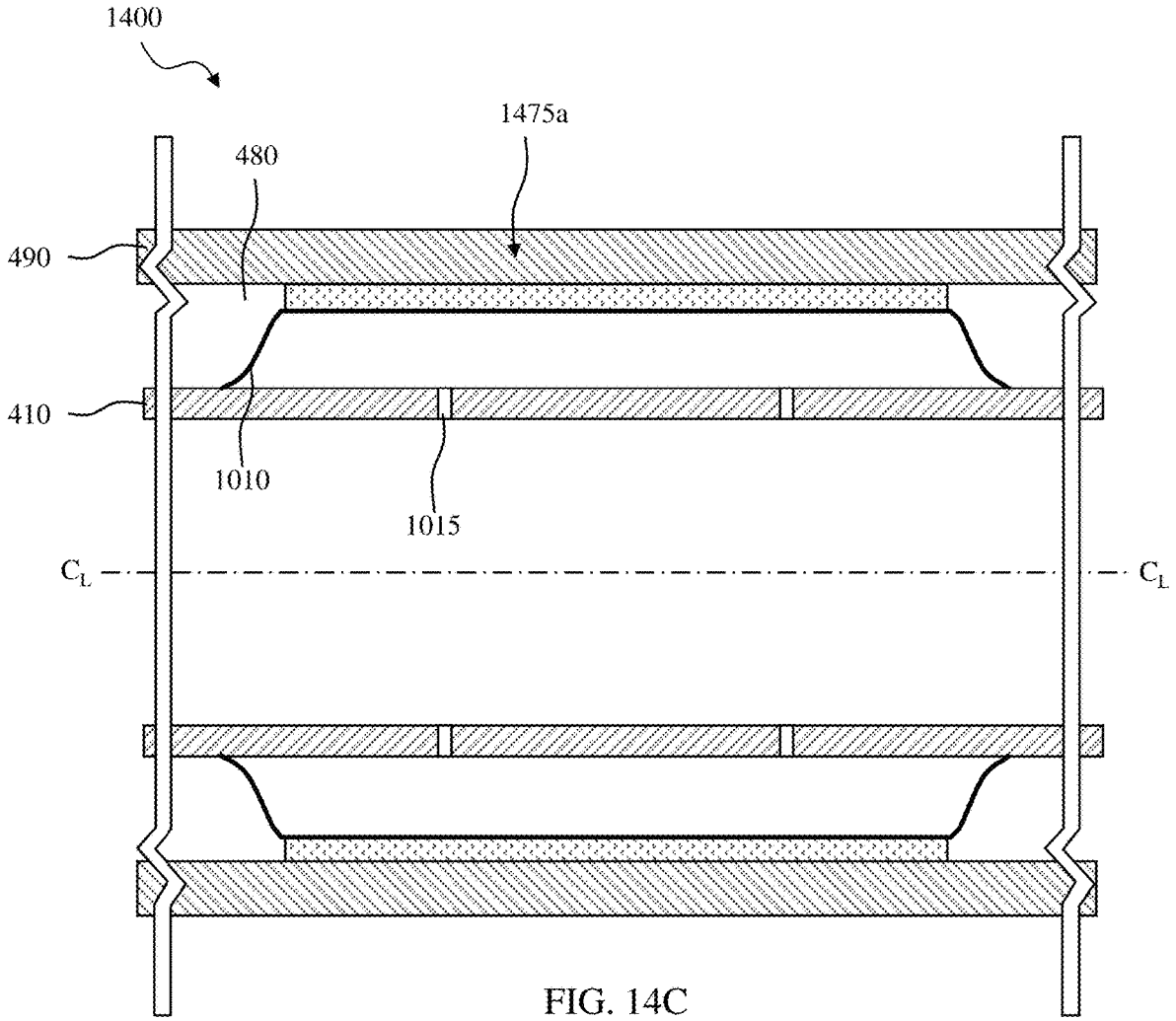
Figure 14D:
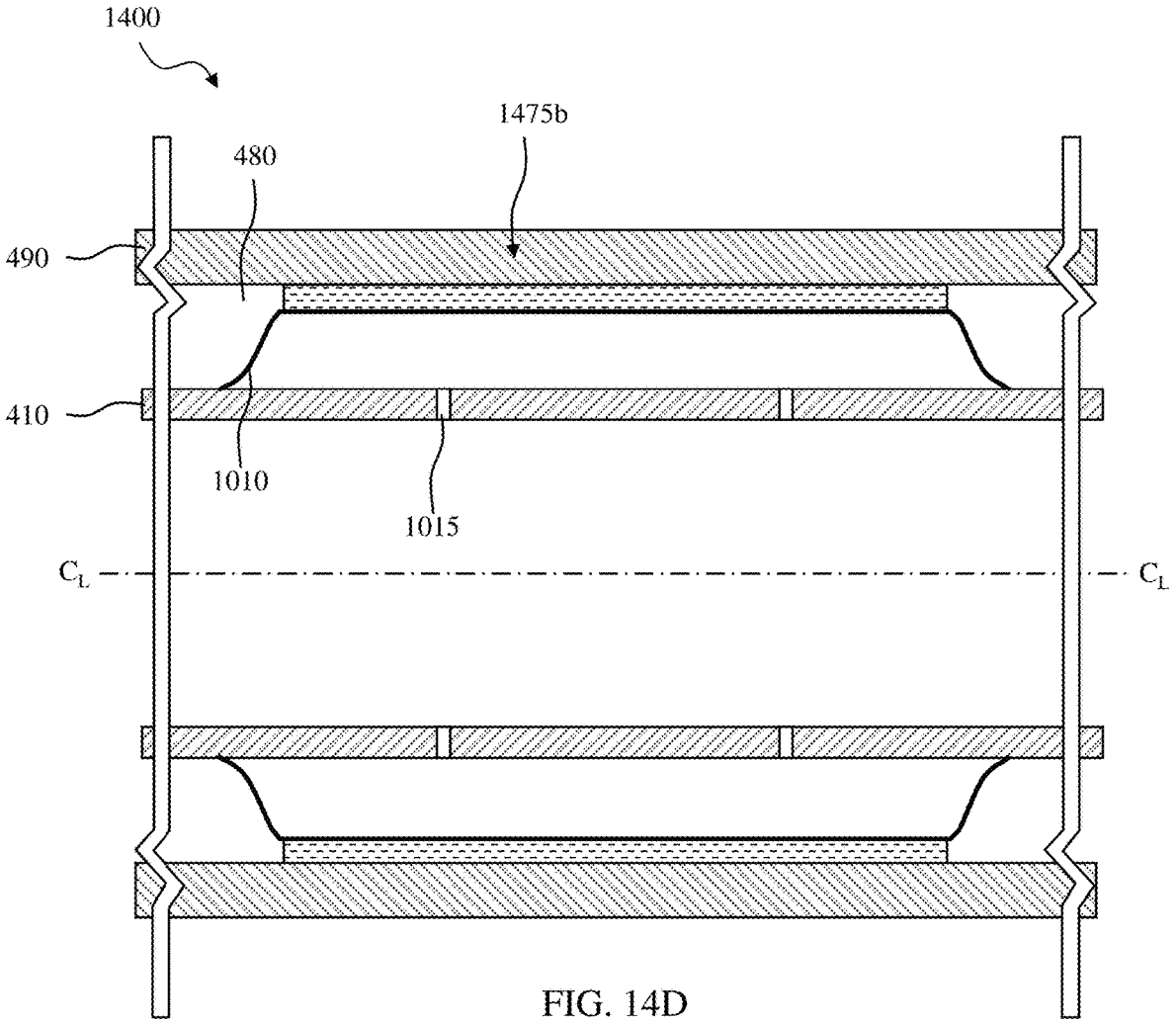

In contrast, FIG. 14C illustrates the sealing/anchoring tool 1400 with its radially enlarged sealing/anchoring element having been subjected to reactive fluid, and thus starting the hydrolysis reaction, thereby forming an expanded metal sealing/anchoring element (e.g., the sealing/anchoring element post-expansion). In contrast, FIG. 14D illustrates the sealing/anchoring tool 1400 with its radially enlarged sealing/anchoring element having been subjected to reactive fluid, and thus starting the hydrolysis reaction, thereby forming an expanded metal sealing/anchoring element having residual unreacted expandable metal therein (e.g., the sealing/anchoring element post-expansion). As disclosed above, the expandable metal may be subjected to a suitable reactive fluid within the wellbore, thereby forming the expanded metal sealing/anchoring element.

The sealing/anchoring tool 1400 is similar in certain respects to the sealing/anchoring tool 1000. Accordingly, like reference numbers have been used to indicate similar, if not identical, features. The sealing/anchoring tool 1400 differs, for the most part, from the sealing/anchoring tool 1000, in that the sealing/anchoring tool 1400 employs a sealing/anchoring element 1420 including a circlet 1430 that comprises a collection of individual separate chunks of the expandable metal held together within a fluid tight enclosure. The fluid tight enclosure, in at least one embodiment, may be punctured when the hydraulically deformable member 1010 moves from the radially reduced mechanical state to the radially expanded mechanical state, thereby exposing the collection of individual separate chunks of the expandable metal to the reactive fluid. What may result in one or more embodiments, after hydrolysis, is the expanded metal sealing/anchoring element 1475*a*, as shown in FIG. 14C, or the expanded metal sealing/anchoring element having residual unreacted expandable metal therein 1475*b*, as shown in FIG. 14D.

Figure 15A:
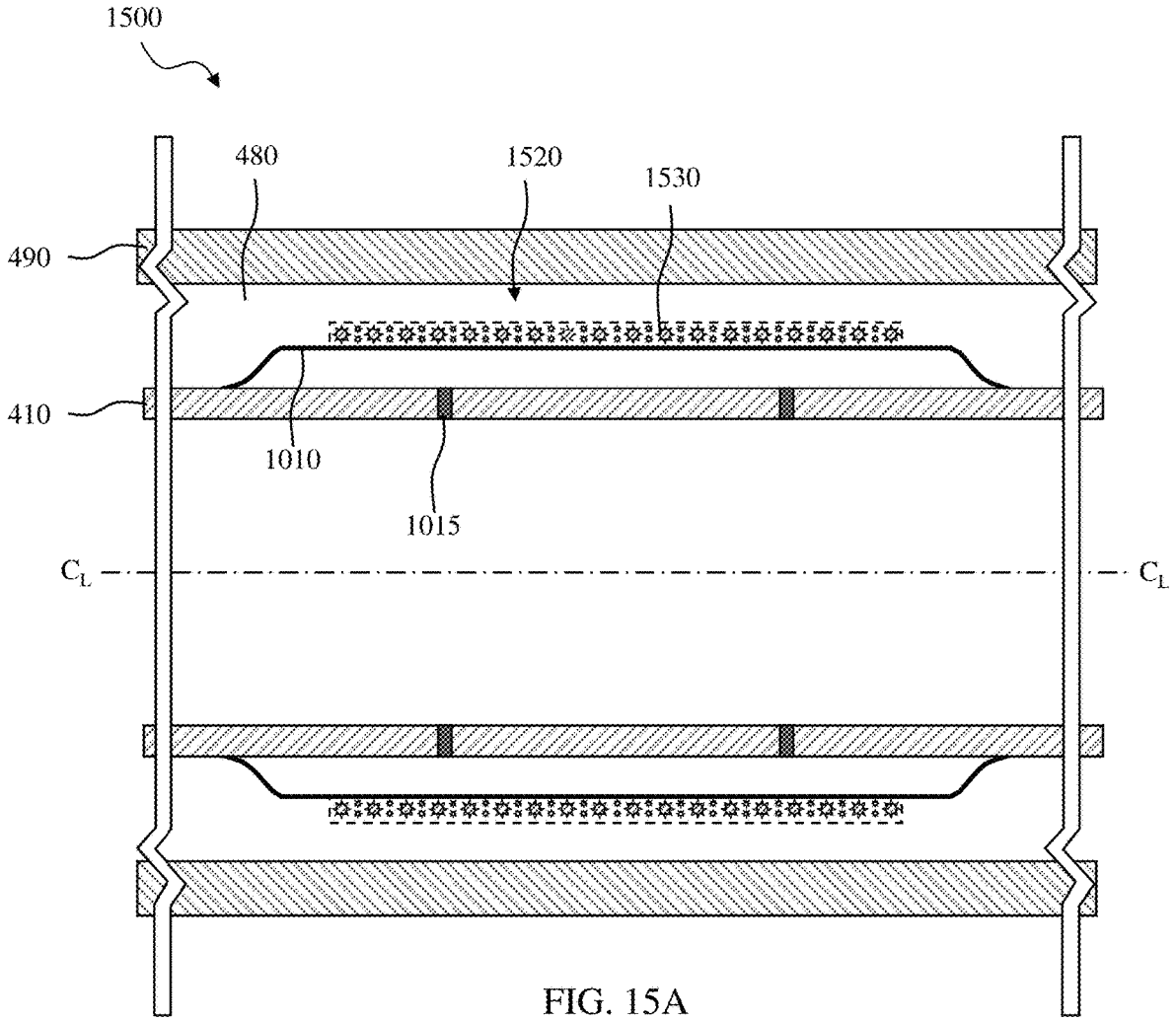
FIGS. 15A through 15D depict various different deployment states for a sealing/anchoring tool designed, manufactured and operated according to an alternative embodiment of the disclosure.
Figure 15B:
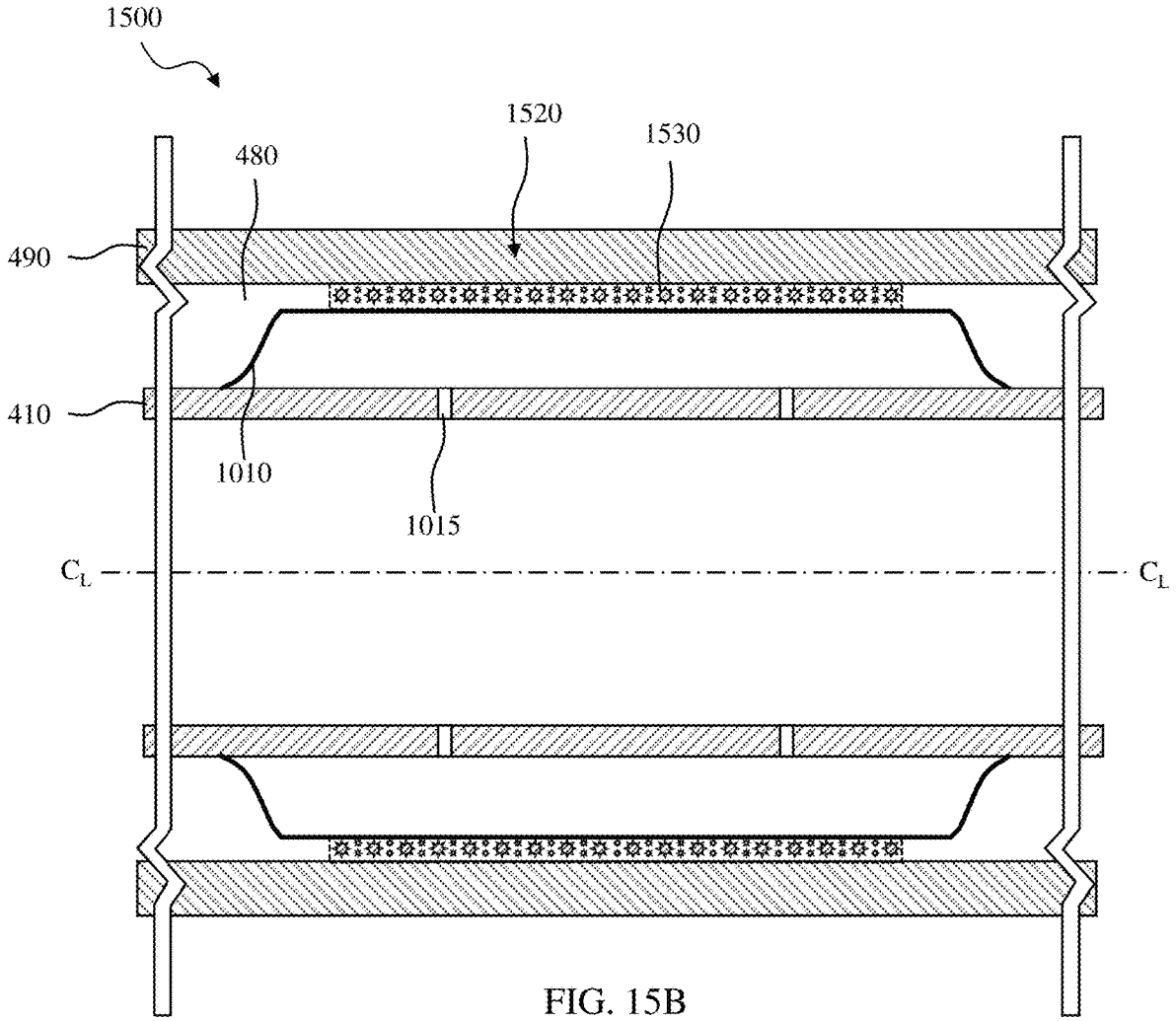
Figure 15C:
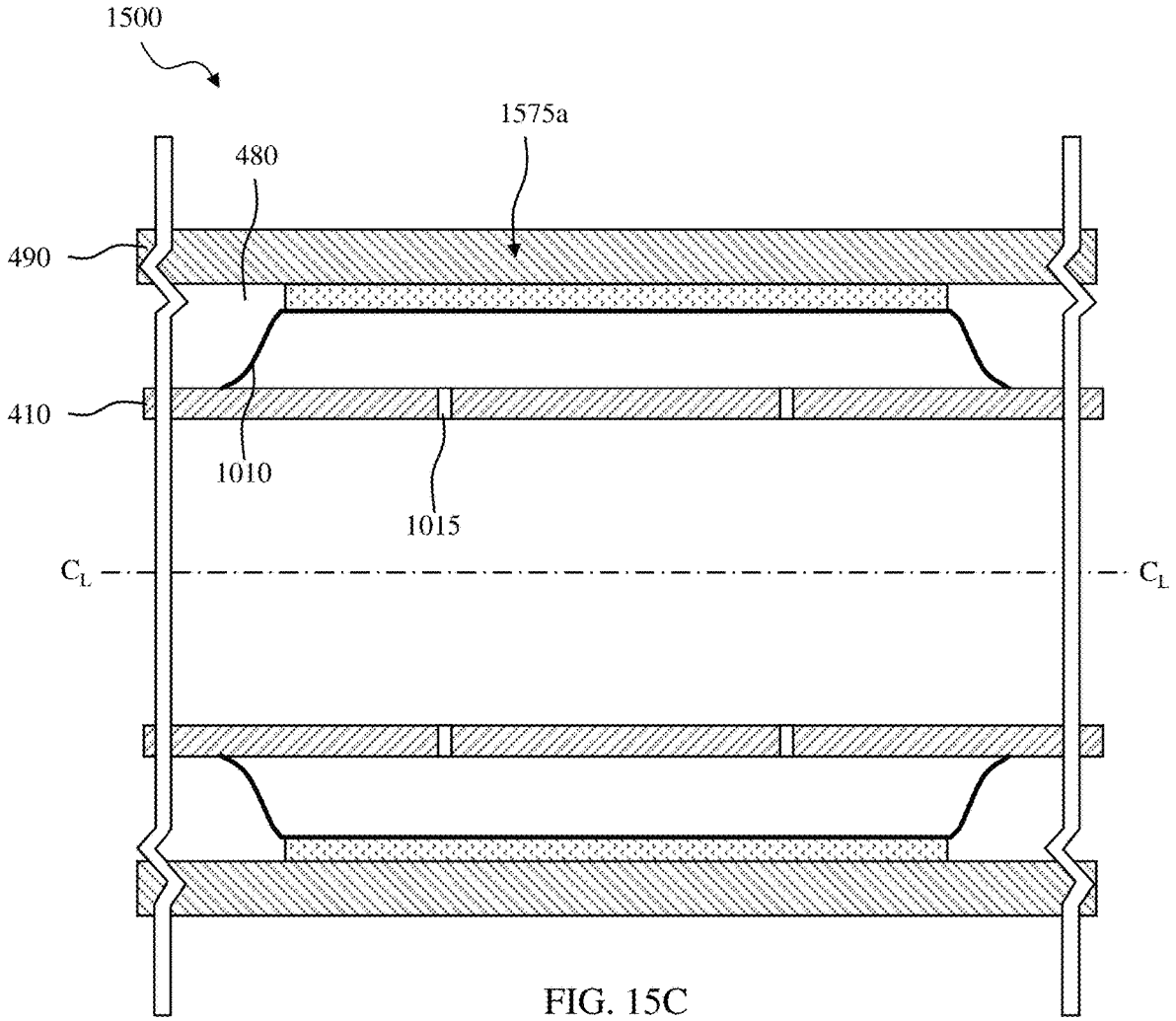
Figure 15D:
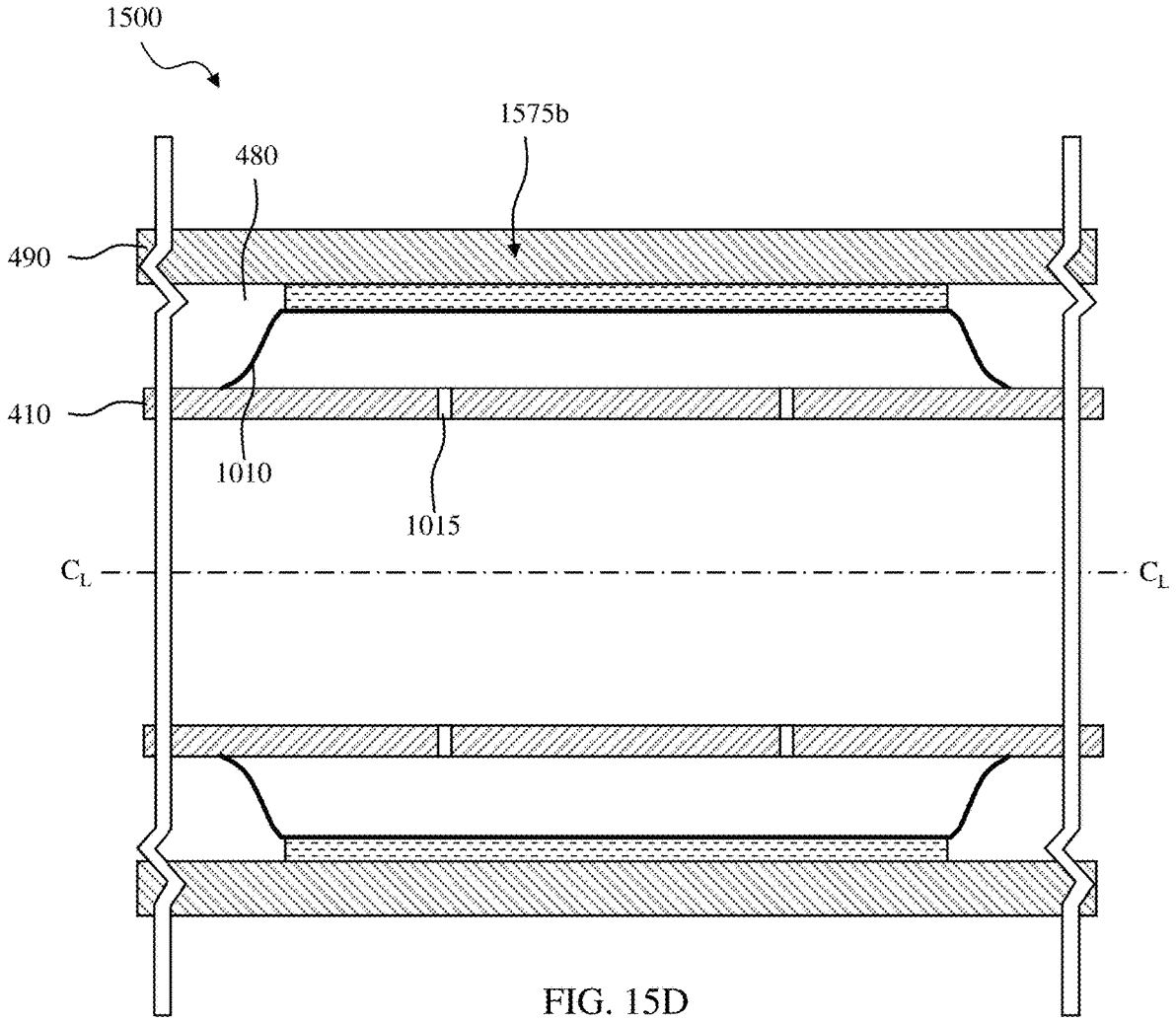

Turning to FIGS. 15A through 15D, depicted are various different deployment states for a sealing/anchoring tool 1500 designed, manufactured and operated according to an alternative embodiment of the disclosure. FIG. 15A illustrates the sealing/anchoring tool 1500 in a run-in-hole state, and thus its sealing/anchoring element is in the radially reduced mechanical state, and furthermore the expandable metal has not been subjected to reactive fluid to begin hydrolysis. In contrast, FIG. 15B illustrates the sealing/anchoring tool 1500 with its sealing/anchoring element in the radially enlarged mechanical state, but again the expandable metal has not been subjected to reactive fluid to begin hydrolysis. In contrast, FIG. 15C illustrates the sealing/anchoring tool 1500 with its radially enlarged sealing/anchoring element having been subjected to reactive fluid, and thus starting the hydrolysis reaction, thereby forming an expanded metal sealing/anchoring element (e.g., the sealing/anchoring element post-expansion). In contrast, FIG. 15D illustrates the sealing/anchoring tool 1500 with its radially enlarged sealing/anchoring element having been subjected to reactive fluid, and thus starting the hydrolysis reaction, thereby forming an expanded metal sealing/anchoring element having residual unreacted expandable metal therein (e.g., the sealing/anchoring element post-expansion). As disclosed above, the expandable metal may be subjected to a suitable reactive fluid within the wellbore, thereby forming the expanded metal sealing/anchoring element.

The sealing/anchoring tool 1500 is similar in certain respects to the sealing/anchoring tool 1000. Accordingly, like reference numbers have been used to indicate similar, if not identical, features. The sealing/anchoring tool 1500 differs, for the most part, from the sealing/anchoring tool 1000, in that the sealing/anchoring tool 1500 employs a sealing/anchoring element 1520 including a circlet 1530 that comprises a collection of individual separate chunks of the expandable metal held together within a fluid penetrable cage. What may result in one or more embodiments, after hydrolysis, is the expanded metal sealing/anchoring element 1575*a*, as shown in FIG. 15C, or the expanded metal sealing/anchoring element having residual unreacted expandable metal therein 1575*b*, as shown in FIG. 15D.

Aspects disclosed herein include:

A. A sealing/anchoring element for use with a sealing/anchoring tool, the sealing/anchoring element including: 1) a circlet having an inside surface having an inside diameter ($d_i$), an outside surface having an outside diameter ($d_o$), a width (w), and a wall thickness (t), the circlet having one or more geometric features that allow it to mechanically deform when moved from a radially reduced mechanical state to a radially enlarged mechanical state, the circlet comprising an expandable metal configured to expand in response to hydrolysis to chemically deform the circlet from a radially reduced chemical state to a radially enlarged chemical state.

B. A sealing/anchoring tool, the sealing/anchoring tool including: 1) a mandrel; 2) a wedge positioned about the mandrel; and 3) a sealing/anchoring element positioned about the mandrel and proximate the wedge, the sealing/anchoring element including: a circlet having an inside surface having an inside diameter ($d_i$), an outside surface having an outside diameter ($d_o$), a width (w), and a wall thickness (t), the circlet having one or more geometric features that allow it to mechanically deform when moved from a radially reduced mechanical state to a radially enlarged mechanical state, the circlet comprising an expandable metal configured to expand in response to hydrolysis to chemically deform the circlet from a radially reduced chemical state to a radially enlarged chemical state.

C. A well system, the well system including: 1) a wellbore; 2) a sealing/anchoring tool positioned within the wellbore, the sealing/anchoring tool including: a) a mandrel; b) a wedge positioned about the mandrel; and c) a sealing/anchoring element positioned about the mandrel and proximate the wedge, the sealing/anchoring element including: a circlet having an inside surface having an inside diameter ($d_i$), an outside surface having an outside diameter ($d_o$), a width (w), and a wall thickness (t), the circlet having one or more geometric features that allow it to mechanically deform when moved from a radially reduced mechanical state to a radially enlarged mechanical state, the circlet comprising an expandable metal configured to expand in response to hydrolysis to chemically deform the circlet from a radially reduced chemical state to a radially enlarged chemical state.

D. A method for sealing/anchoring within a wellbore, the method including: 1)

providing a sealing/anchoring tool within a wellbore, the sealing/anchoring tool including: a) a mandrel; b) a wedge positioned about the mandrel; and c) a sealing/anchoring element positioned about the mandrel and proximate the wedge, the sealing/anchoring element including: a circlet having an inside surface having an inside diameter ($d_i$), an outside surface having an outside diameter ($d_o$), a width (w), and a wall thickness (t), the circlet having one or more geometric features that allow it to mechanically deform when moved from a radially reduced mechanical state to a radially enlarged mechanical state, the circlet comprising an expandable metal configured to expand in response to hydrolysis to chemically deform the circlet from a radially reduced chemical state to a radially enlarged chemical state; 2) mechanically deforming the sealing/anchoring element by moving the circlet from the radially reduced mechanical state to the radially enlarged mechanical state; and 3) subjecting the mechanically deformed sealing/anchoring element in the radially enlarged mechanical state to reactive fluid to expand it to a radially enlarged chemical state and thereby form an expanded metal sealing/anchoring element.

E. A sealing/anchoring tool, the sealing/anchoring tool including: 1) a mandrel; 2) a hydraulically deformable member positioned about the mandrel; and 3) a sealing/anchoring element positioned about the hydraulically deformable member, the sealing/anchoring element including: a circlet having an inside surface having an inside diameter ($d_i$), an outside surface having an outside diameter ($d_o$), a width (w), and a wall thickness (t), the circlet comprising an expandable metal configured to expand in response to hydrolysis to chemically deform the circlet from a radially reduced chemical state to a radially enlarged chemical state.

F. A well system, the well system including: 1) a wellbore; 2) a sealing/anchoring tool positioned within the wellbore, the sealing/anchoring tool including: a) a mandrel; b) a hydraulically deformable member positioned about the mandrel; and c) a sealing/anchoring element positioned about the hydraulically deformable member, the sealing/anchoring element including: a circlet having an inside surface having an inside diameter ($d_i$), an outside surface having an outside diameter ($d_o$), a width (w), and a wall thickness (t), the circlet comprising an expandable metal configured to expand in response to hydrolysis to chemically deform the circlet from a radially reduced chemical state to a radially enlarged chemical state.

G. A method for sealing/anchoring within a wellbore, the method including: 1) providing a sealing/anchoring tool within a wellbore, the sealing/anchoring tool including: a) a mandrel; b) a hydraulically deformable member positioned about the mandrel; and c) a positioned about the hydraulically deformable member, the sealing/anchoring element including: a circlet having an inside surface having an inside diameter ($d_i$), an outside surface having an outside diameter ($d_o$), a width (w), and a wall thickness (t), the circlet comprising an expandable metal configured to expand in response to hydrolysis to chemically deform the circlet from a radially reduced chemical state to a radially enlarged chemical state; 2) mechanically deforming the sealing/anchoring element by moving the hydraulically deformable member from a radially reduced mechanical state to a radially enlarged mechanical state; and 3) subjecting the mechanically deformed sealing/anchoring element in the radially enlarged mechanical state to reactive fluid to expand it to the radially enlarged chemical state and thereby form an expanded metal sealing/anchoring element.

Aspects A, B, C, D, E, F and G may have one or more of the following additional elements in combination: Element 1: wherein the circlet is configured to mechanically deform from the radially reduced state to the radially enlarged state prior to chemically deforming the circlet from the radially reduced chemical state to the radially enlarged chemical state. Element 2: wherein the one or more geometric features are a full slot or partial slot in the wall thickness (t) of the circlet. Element 3: wherein the one or more geometric features are a full slot in the wall thickness (t) of the circlet that creates a C-ring. Element 4: wherein the one or more geometric features are a partial slot in the wall thickness (t) of the circlet including remaining material, the remaining material configured to snap when the circlet moves from the radially reduced mechanical state to the radially enlarged mechanical state. Element 5: wherein the circlet includes one or more angled surfaces positioned along its inside diameter ($d_i$) or outside diameter ($d_o$). Element 6: wherein the circlet includes one or more angled surfaces positioned along its inside diameter ($d_i$) and outside diameter ($d_o$), the one or more angled surfaces configured to engage with one or more associated angled surfaces to move the circlet from the radially reduced mechanical state to the radially enlarged mechanical state. Element 7: wherein the width (w) ranges from 0.3 meters to 1.2 meters. Element 8: wherein the width (w) is no greater than 2.54 cm. Element 9: wherein the thickness (t) ranges from 15 centimeters to 6 centimeters. Element 10: wherein the circlet has one or more geometric features that allow it to mechanically deform when moved from a radially reduced mechanical state to a radially enlarged mechanical state. Element 11: wherein the circlet is configured to mechanically deform from the radially reduced state to the radially enlarged state prior to chemically deforming from the radially reduced chemical state to the radially enlarged chemical state. Element 12: wherein the one or more geometric features are a full slot or partial slot in the wall thickness (t) of the circlet. Element 13: wherein the one or more geometric features are a full slot in the wall thickness (t) of the circlet that creates a C-ring. Element 14: wherein the one or more geometric features are a partial slot in the wall thickness (t) of the circlet including remaining material, the remaining material configured to snap when the circlet moves from the radially reduced mechanical state to the radially enlarged mechanical state. Element 15: wherein the hydraulically deformable member is a bladder. Element 16: wherein the hydraulically deformable member is a limited expansion hydraulically deformable member, the limited expansion hydraulically deformable member configured to prevent the circlet from contacting a bore when the hydraulically deformable member moves from a radially reduced mechanical state to a radially enlarged mechanical state. Element 17: wherein the circlet is a wire of expandable metal. Element 18: wherein the mandrel includes one or more openings therein for supplying fluid to deploy the hydraulically deformable member from a radially reduced mechanical state to a radially expanded mechanical state.

Those skilled in the art to which this application relates will appreciate that other and further additions, deletions, substitutions and modifications may be made to the described embodiments.

What is claimed is:

1. A sealing/anchoring element for use with a sealing/anchoring tool, comprising:

a circlet having an inside surface having an inside diameter ($d_i$), an outside surface having an outside diameter ($d_o$), a width (w), and a wall thickness (t), the circlet having one or more geometric features that allow it to mechanically deform when moved from a radially reduced mechanical state to a radially enlarged mechanical state, the circlet comprising an expandable metal configured to expand in response to hydrolysis to chemically deform the circlet from a radially reduced chemical state to a radially enlarged chemical state, wherein the one or more geometric features are a partial slot in the wall thickness (t) of the circlet including remaining material, the remaining material configured to snap when the circlet moves from the radially reduced mechanical state to the radially enlarged mechanical state.

2. The sealing/anchoring element as recited in claim 1, wherein the circlet is configured to mechanically deform from the radially reduced mechanical state to the radially enlarged mechanical state prior to chemically deforming the circlet from the radially reduced chemical state to the radially enlarged chemical state.

3. The sealing/anchoring element as recited in claim 1, wherein the circlet includes one or more angled surfaces positioned along its inside diameter ($d_i$) or outside diameter ($d_o$).

4. The sealing/anchoring element as recited in claim 1, wherein the circlet includes one or more angled surfaces positioned along its inside diameter ($d_i$) and outside diameter ($d_o$), the one or more angled surfaces configured to engage with one or more associated angled surfaces to move the circlet from the radially reduced mechanical state to the radially enlarged mechanical state.

5. The sealing/anchoring element as recited in claim 1, wherein the width (w) ranges from 0.3 meters to 1.2 meters.

6. The sealing/anchoring element as recited in claim 1, wherein the width (w) is no greater than 2.54 cm.

7. The sealing/anchoring element as recited in claim 1, wherein the thickness (t) ranges from 15 centimeters to 6 centimeters.

8. A sealing/anchoring tool, comprising:
a mandrel;
a wedge positioned about the mandrel; and
a sealing/anchoring element positioned about the mandrel and proximate the wedge, the sealing/anchoring element including:
a circlet having an inside surface having an inside diameter ($d_i$), an outside surface having an outside diameter ($d_o$), a width (w), and a wall thickness (t), the circlet having one or more geometric features that allow it to mechanically deform when moved from a radially reduced mechanical state to a radially enlarged mechanical state, the circlet comprising an expandable metal configured to expand in response to hydrolysis to chemically deform the circlet from a radially reduced chemical state to a radially enlarged chemical state, wherein the one or more geometric features are a partial slot in the wall thickness (t) of the circlet including remaining material, the remaining material configured to snap when the circlet moves from the radially reduced mechanical state to the radially enlarged mechanical state.

9. The sealing/anchoring tool as recited in claim 8, wherein the circlet is configured to mechanically deform from the radially reduced mechanical state to the radially enlarged mechanical state prior to chemically deforming the circlet from the radially reduced chemical state to the radially enlarged chemical state.

10. The sealing/anchoring tool as recited in claim 8, wherein the circlet includes one or more angled surfaces positioned along its inside diameter ($d_i$) or outside diameter ($d_o$).

11. The sealing/anchoring tool as recited in claim 8, wherein the circlet includes one or more angled surfaces positioned along its inside diameter ($d_i$) and outside diameter ($d_o$), the one or more angled surfaces configured to engage with one or more associated angled surfaces to move the circlet from the radially reduced mechanical state to the radially enlarged mechanical state.

12. The sealing/anchoring tool as recited in claim 8, wherein the width (w) ranges from 0.3 meters to 1.2 meters.

13. The sealing/anchoring tool as recited in claim 8, wherein the width (w) is no greater than 2.54 cm.

14. The sealing/anchoring tool as recited in claim 8, wherein the thickness (t) ranges from 15 centimeters to 6 centimeters.

15. A well system, comprising:
a wellbore;
a sealing/anchoring tool positioned within the wellbore, the sealing/anchoring tool including:
a mandrel;
a wedge positioned about the mandrel; and
a sealing/anchoring element positioned about the mandrel and proximate the wedge, the sealing/anchoring element including:
a circlet having an inside surface having an inside diameter ($d_i$), an outside surface having an outside diameter ($d_o$), a width (w), and a wall thickness (t), the circlet having one or more geometric features that allow it to mechanically deform when moved from a radially reduced mechanical state to a radially enlarged mechanical state, the circlet comprising an expandable metal configured to expand in response to hydrolysis to chemically deform the circlet from a radially reduced chemical state to a radially enlarged chemical state, wherein the one or more geometric features are a partial slot in the wall thickness (t) of the circlet including remaining material, the remaining material configured to snap when the circlet moves from the radially reduced mechanical state to the radially enlarged mechanical state.

16. A method for sealing/anchoring within a wellbore, comprising:
providing a sealing/anchoring tool within a wellbore, the sealing/anchoring tool including:
a mandrel;
a wedge positioned about the mandrel; and
a sealing/anchoring element positioned about the mandrel and proximate the wedge, the sealing/anchoring element including:
a circlet having an inside surface having an inside diameter ($d_i$), an outside surface having an outside diameter ($d_o$), a width (w), and a wall thickness (t), the circlet having one or more geometric features that allow it to mechanically deform when moved from a radially reduced mechanical state to a radially enlarged mechanical state, the circlet comprising an expandable metal configured to expand in response to hydrolysis to chemically deform the circlet from a radially reduced chemical state to a radially enlarged chemical state, wherein the one or more geometric features are a partial slot in the wall thickness (t) of the circlet including remaining material, the remaining material configured to snap when the circlet moves from the radially reduced mechanical state to the radially enlarged mechanical state;
mechanically deforming the sealing/anchoring element by moving the circlet from the radially reduced mechanical state to the radially enlarged mechanical state; and
subjecting the mechanically deformed sealing/anchoring element in the radially enlarged mechanical state to reactive fluid to expand it to a radially enlarged chemical state and thereby form an expanded metal sealing/anchoring element.

* * * * *